US005485244A

United States Patent [19]

Gotoda et al.

[11] Patent Number: 5,485,244

[45] Date of Patent: Jan. 16, 1996

[54] ELECTROPHOTOGRAPHIC APPARATUS WITH FREELY OPENABLE UPPER AND LOWER HOUSINGS

[75] Inventors: Katsuhiko Gotoda; Hisanobu Inada; Susumu Shoji; Katsuya Shiba, all of Kobe; Yasunori Tsukuda; Masanari Nakamura, both of Shizuoka, all of Japan

[73] Assignee: Star Micronics Co., Ltd., Shizuoka, Japan

[21] Appl. No.: 101,712

[22] Filed: Aug. 3, 1993

Related U.S. Application Data

[63] Continuation of Ser. No. 21,527, Feb. 23, 1993, abandoned.

[30] Foreign Application Priority Data

Aug. 3, 1992 [JP] Japan ..... 4-206833

[51] Int. Cl.[6] ..... G03G 15/00

[52] U.S. Cl. ..... 355/200; 355/210

[58] Field of Search ..... 355/200, 210, 355/245, 260, 298

[56] References Cited

U.S. PATENT DOCUMENTS

| | | | |
|---|---|---|---|
| 4,030,824 | 6/1977 | Smith . | |
| 4,214,740 | 7/1980 | Acquaviva . | |
| 4,464,042 | 8/1984 | Omori et al. . | |
| 4,486,015 | 12/1984 | Takahashi . | |
| 4,518,248 | 5/1985 | Nishikawa . | |
| 4,634,264 | 1/1987 | Takahashi | 355/200 |
| 4,705,384 | 11/1987 | Mizutani et al. | 355/200 |
| 4,789,876 | 12/1988 | Miyai et al. | 355/200 |
| 4,791,454 | 12/1988 | Takahashi et al. | 355/260 X |
| 4,908,661 | 3/1990 | Iwata et al. . | |
| 4,947,208 | 8/1990 | Komatsu et al. | 355/200 |
| 4,969,010 | 11/1990 | Tamura et al. | 355/200 X |
| 5,061,961 | 10/1991 | Jacobs et al. . | |
| 5,117,265 | 5/1992 | Matsui et al. . | |
| 5,168,308 | 12/1992 | Hiraike et al. | 355/245 X |
| 5,221,943 | 6/1993 | Hasegawa | 355/245 |
| 5,231,453 | 7/1993 | Nakai et al. | 355/210 |
| 5,285,240 | 2/1994 | Kinoshita et al. | 355/200 |
| 5,300,979 | 4/1994 | Tsukakoshi et al. | 355/200 |

FOREIGN PATENT DOCUMENTS

| | | |
|---|---|---|
| 0193170 | 9/1986 | European Pat. Off. . |
| 0296818 | 12/1988 | European Pat. Off. . |
| 0311021 | 4/1989 | European Pat. Off. . |
| 0366052 | 5/1990 | European Pat. Off. . |
| 2275809 | 1/1976 | France . |
| 3433665 | 5/1985 | Germany . |
| 4038519 | 8/1991 | Germany . |
| 3-3230 | 1/1991 | Japan . |
| 2244677 | 12/1991 | United Kingdom . |
| 79/01073 | 12/1979 | WIPO . |

OTHER PUBLICATIONS

Patent Abstracts of Japan, vol. 10, No. 232 (P–486) 12 Aug. 1986 & JP–A–61 067 050 (Katsuragawa Denki) 7 Apr. 1986.

Patent Abstracts of Japan, vol. 16, No. 50 (P–1308) 7 Feb. 1992 & JP–A–03 251 882 (Canon) 11 Nov. 1991 *abstract*.

Patent Abstracts of Japan, vol. 7, No. 196 (P–219)(1341) 26 Aug. 1983 & JP–A–58 095 773 (Matsushita Denki Sangyo) 7 Jun. 1983 *abstract*.

*Primary Examiner*—Sandra L. Brase

*Attorney, Agent, or Firm*—Wenderoth, Lind & Ponack

[57] ABSTRACT

To attach or detach a process cartridge to or from a support member of an LED printer, an upper housing is angularly displaced and opened around a supporting position relative to a lower housing. As the upper housing is gradually opening relatively to the lower housing, the support member is angularly displaced around a connection position with the lower housing to be separated from the upper housing. Then, a used process cartridge can be detached from the support member and another new process cartridge can be attached thereto, thereby allowing such maintenance operation to be easily performed.

3 Claims, 68 Drawing Sheets

(a)

(b)

(c)

ELECTROPHOTOGRAPHIC APPARATUS WITH FREELY OPENABLE UPPER AND LOWER HOUSINGS

This is a Continuation of application Ser. No. 08/021,527 filed Feb. 23, 1993, now abandoned.

BACKGROUND OF THE INVENTION

1. Field of the Invention

The present invention relates to an electrophotographic apparatus that may be realized in the form of a relatively small light-emitting diode (LED) printer or the like.

2. Description of the Related Art

FIG. 68 is a schematic view illustrating construction of an electrophotographic apparatus 501 typical of the prior art. The electrophotographic apparatus 501 comprises a lower housing 502 of box-like shape having an open top and an upper housing 503 having an open bottom. A paper cassette 504 is installed in one side of the lower housing 502, with a portion of the paper cassette 504 extending outwardly of the lower housing 502. A recording paper delivered from the paper cassette 504 is transported through the electrophotographic apparatus 501 in a transporting direction indicated by arrow A1. The terms "upstream" and "downstream" are used in a relative sense in relation to the recording paper transporting direction indicated by arrow A1, unless otherwise noted. The upper housing 503 is swingably joined to the lower housing 502 by means of a shaft 514 near the lower end portion of the upper housing 503 at the downstream end of the transporting direction A1. In the upstream side of the upper housing 503, there is detachably installed a process cartridge 510 that contains a charge unit 506 for uniformly charging a photoconductor drum 505, a developing device 508 for forming a toner image on the photoconductor drum 505 on which an electrostatic latent image has been formed by the illumination of light from an optical head 507, and a cleaning device 509 for removing residual toner on the photoconductor drum 505 after transfer. The optical head 507 forms a desired optical image on the charged photoconductor drum 505.

In the lower housing 502, downstream of the paper cassette 504 and below the photoconductor drum 505, are disposed a transfer device 511 for transferring a toner image on the photoconductor drum 505 onto a recording paper fed from the paper cassette 504, a guide 512 for guiding the recording paper after transfer, and a fixing device 513 for fixing the toner image to the recording paper. The recording paper with the toner image fixed thereon passes an inverting member 515, through which its travelling direction is inverted, and is discharged onto a stacker 516 mounted on the upper housing 503.

The process cartridge 510 is detachably mounted to the underside of the upper housing 503. When the toner contained in the developing device 508 has run out, for example, the upper housing 503 is opened by turning it about the shaft 514, the process cartridge 510 is removed from the underside of the upper housing 503, and a new process cartridge 510 is installed in place. After that, the upper housing 503 is closed. The electrophotographic apparatus 501 thus becomes ready for use.

The electrophotographic apparatus 501 of the above prior art has various problems as enumerated below.

(1) As described, the upper housing 503 is connected to the lower housing 502 by means of the shaft 514 provided near the lower end of the upper housing 503 at the downstream end of the transporting direction A1. With this construction, when the upper housing 503 is opened, the upper housing 503 protrudes outwardly from the downstream end of the electrophotographic apparatus 501, as shown by two-dot chain lines in FIG. 68. The resulting problem is an increased space requirement for installation since the protrusion of the upper housing 503 must be taken into consideration when securing the installation space for the electrophotographic apparatus 501.

(2) The process cartridge 510 is mounted on the underside of the upper housing 503. Therefore, removal of the process cartridge 510 or installation of a new process cartridge 510 has to be performed in the narrow space positioned very close to the upper housing 503. This reduces work efficiency for removal and installation of the process cartridge 510.

FIG. 69 is a schematic view further illustrating the construction of the electrophotographic apparatus 501 shown in FIG. 68. A recording paper fed from the paper cassette 504 by means of a paper feed roller 520, is transported by transport rollers 521 through guides 522 and 525, and is carried between resist rollers 523 through a guide 524 to reach the transfer device 511. The recording paper with a toner image transferred thereon by the transfer device 511 is directed along a guide 512 to the fixing device 513 where the toner image is fixed by heat, etc. After fixing, the recording paper is passed along a guide 528, and discharged outside the apparatus by means of paper discharge rollers 530, or stacked on the stacker 516 shown in FIG. 68, if necessary.

In the electrophotographic apparatus 501 of FIG. 69, the guides, 524 and 512, and the transfer device 511 are the components used to support the recording paper during the process from the time the recording paper is delivered from the resist rollers 523 for transfer, until it is delivered to the fixing device 513 for fixing. These components are separately mounted to the housing, etc. of the electrophotographic apparatus 501.

However, in the above prior art arrangement, the provision of the various components between the resist rollers 523 and the fixing device 513 increases the complexity of the entire construction. Furthermore, separate structures are required to mount the guides 524 and 512 and the transfer device 511 to the housing, etc. of the electrophotographic apparatus 501, which presents the problem of further increasing the complexity of the construction.

Also, the electrophotographic apparatus 501 of the above prior art employs a construction that enables the apparatus to be opened along the recording paper transport path into two sections, the upper and lower sections, to expose the transport path. This construction is employed to facilitate removal of the recording paper when the recording paper is jammed during a printing operation. FIG. 70 is a schematic view showing the upper housing 503 turned upward around the shaft 514 relative to the lower housing 502 on which the upper housing 503 is swingably supported. In this condition, the recording paper transport path is exposed so that a jammed paper can be removed easily.

Furthermore, in the electrophotographic apparatus 501 of the above prior art arrangement, the developing device 508 is detachably mounted into the apparatus body to facilitate developer replenishment and parts replacement operations. Besides such construction, the photoconductor drum and the cleaning unit are often constructed as an integral unit for detachable mounting on the apparatus. In the apparatus of such construction, however, the developer tends to fall through openings, etc. of the developing device 508. This tendency is particularly noticeable when a shock is applied to the apparatus or the unit, for example, when removing the developing device 508 from the apparatus for replacement or when opening or closing the upper housing. As a result, the falling developer is scattered over the paper transport path upstream of the photoconductor drum, that is, over the guide 522. If the guide 522 is contaminated with toner, the toner adheres to the recording paper during the printing operation, resulting in degradation of the print quality.

The developing device 508 includes a developing roller 531 and a toner box 532 for supplying toner for development to the developing roller 531. The toner in the toner box 532 is distributed downward by the rotation of a toner supply roller 534 disposed adjacent to a toner supply port 533. The falling toner is carried by a toner moving member 535 and moved toward an agitator 536 which mixes the toner with carrier. The toner moving member 535 is formed, for example, from a plate-like member, and is rotated to move the toner.

However, in the above prior art electrophotographic apparatus 501, the toner moving member 535 in the developing device 508 is a plate-like member that only works to push the toner toward the agitator 536. The toner is therefore not scattered over the agitator 536, which presents a problem in terms of toner/carrier mixing efficiency.

Furthermore, in the developing device 508, carrier formed from filings of ferromagnetic material is stored in a space 537 that also houses therein the developing roller 531 to which toner is supplied from the toner box 532. The carrier with toner adhering thereto is made to adhere to the circumference of the developing roller 531, forming a so-called magnetic brush and thereby applying toner to the photoconductor drum 505.

To seal the carrier in the developing device 508, a sleeve is mounted on the shaft of the developing roller 531, and the sleeve is used as a slide bearing for supporting the shaft installed through the housing of the developing device 508. Transmission of power to the developing device 508 is achieved by rotating the developing roller 531 via a gear or the like mounted on a portion of the shaft extending outwardly from the housing of the developing device 508. Therefore, carrier and toner tend to leak from the developing device 508, which may result in contamination of the interior of the electrophotographic apparatus 501 that uses the developing device 508 of such construction, and hence the contamination of the recording paper travelling therethrough. This may also lead to the problem of soiling the hands and fingers of the operator when handling the developing device 508. On the other hand, if the developing device 508 is to be hermetically sealed, the construction of the bearing for the shaft will become complex.

In the electrophotographic apparatus 501 of FIG. 68, a waste toner box 538 for storing waste toner removed by the cleaning device 509 from the photoconductor drum 505 is accommodated in the lower housing 502, not in the process cartridge 510. That is, when the upper housing 503 is closed around the lower housing 502, the process cartridge 510, in particular, the cleaning device 509, becomes connected to the waste toner box 538 so that the waste toner removed by the cleaning device 509 is collected into the waste toner box. This construction allows the continued use of the process cartridge 510 just by replacing the waste toner box 538.

The above construction, however, has the problem that, each time the upper housing 503 is opened to expose the lower housing 502 for maintenance of the process cartridge 510 or for removal of jammed paper in the electrophotographic apparatus 501, the joint between the cleaning device 509 and the waste toner box 538 is opened, causing toner to spill over the interior of the electrophotographic apparatus 501.

To solve such a problem, the process cartridge 510 may be constructed to include a built-in waste toner box. This, however, introduces certain problems of its own. One is that the size of the process cartridge has to be increased to accommodate the waster toner box. Another is that the service life of the process cartridge becomes short as it has to be discarded when the waste toner box becomes fully loaded with waste toner.

As shown in the perspective view of FIG. 71, the upper housing 503 comprises a rectangular top plate part 539 and rectangular side plate parts 540, 541 extending downward from both widthwise ends of the top plate part 539 toward the lower housing 502, the width of the top plate part 539 being taken orthogonal to the transporting direction A1. At the lower ends of the side plate parts 540 and 541 are formed stop pieces 542 and 543 extending toward each other. Protrusions 544 and 545 are formed on the opposing inner surfaces of the side plate parts 540 and 541. The lower end faces of the protrusions 544 and 545, i.e., the faces thereof facing the stop pieces 542 and 543, are formed to match the shape of the upper surface of the process cartridge 510. These faces are formed as stop faces 546 and 547 curving closer to the stop pieces 542 and 543 with decreasing distance from the shaft 514.

That is, when the process cartridge 510 is mounted into the upper housing 503, side parts **510*a* and 510*b* at both widthwise ends of the process cartridge 510 are held from above by the stop faces 546 and 547 and from below by the stop pieces 542 and 543 so that the process cartridge 510 can be positioned inside the upper housing 503, with a predetermined distance maintained from the transfer device 511 and without any play in vertical directions relative to the upper housing 503. Furthermore, the horizontal positioning of the process cartridge 510 is achieved by the side parts 510*a* and 510*b* thereof abutting the inside surfaces of the upper housing 503**.

In the above prior art arrangement, the process cartridge 510 is mounted into the upper housing 503 of the above construction so that the process cartridge 510 can be held in position without any play either in vertical or width directions. However, when determining the dimensions of the outer shape of the process cartridge 510, the intervals of the inner surfaces of the side plate parts 540, 541 and the intervals between the stop faces 546, 547 and the stop pieces 542, 543, there must be clearance to such extent as to allow the process cartridge 510 to move inside the upper housing 503 in order that the process cartridge 510 can be detachably mounted into the upper housing 503.

This inevitably introduces certain play of the process cartridge 510 in the vertical and width directions when mounted in the upper housing 503. The play in the vertical direction will affect the quality of the image produced by transferring a toner image on the photoconductor drum onto the recording paper, and the play in the width direction will cause the image produced on the recording paper to be displaced widthwise thereof. Such image formation problems will become particularly noticeable when, for example, a plurality of toner images are superimposed to print an image on a single recording paper. The play in the width direction may also cause problems in transportation of the recording paper delivered from the paper cassette 504.

FIG. 72 is a perspective view showing a housing construction of the electrophotographic apparatus 501 of the typical prior art arrangement shown in FIG. 68. The electrophotographic apparatus 501 includes a lower housing 502 having an open top 550 and upper housing 503 covering the open top 550 of the lower housing 502. The upper housing 503 is swingably joined to the lower housing 502 by means of a pinned connection. In the lower housing 502, a pair of stop levers 551, 552 spaced apart from each other and rising toward the open top 550 are fixed on a shaft 553. The stop levers 551 and 552 are provided at their respective ends with stop pawls 551*a* and 552*a* extending toward the open top 550. Adjacent to the stop levers 551 and 552 are torsion springs 554 and 555 wound around the shaft 553. Respective ends of the torsion springs 554 and 555 abut spring stop pieces 551*b* and 552*b* provided on the stop levers 551 and 552, respectively, from sides thereof opposite from the sides facing toward the open top 550. Opposite ends of the torsion springs 554 and 555 are fixed to the lower housing 502, so that the torsion springs 554 and 555 urge the stop levers 551 and 552 in the direction of arrows D1. The shaft 553 is rotatably supported in both sides of the lower housing 502.

An upper end portion of the stop lever 552 extends in a direction opposite to the direction of the stop pawls 552*a*, and is swingably joined to a driving member 556 by means of a pinned connection. An upper end of the driving member 556 protrudes upward from an upper end face 502*a* of the lower housing 502 so that the operator can hold the protruding portion and move it in the direction of arrow D2. On the other hand, the upper housing 503 is provided with a pair of rod members 559, 560 supported by respective pairs of brackets 557, 558 at positions opposite the stop pawls 551*a*, 552*a* of the stop levers 551, 552 when the upper housing 503 is closed to cover the lower housing 502. The upper ends of the stop pawls 551*a* and 552*a* of the stop levers 551 and 552 are formed as sloping faces 561 and 562 sloping gradually downward away from the upper housing 503.

According to the above construction, when the upper housing 503 is turned to close the lower housing 502 of the electrophotographic apparatus 501, the rod members 559 and 560 hit the sloping faces 561 and 562 of the stop levers 551 and 552, causing the stop levers 551 and 552 to turn in the direction opposite to the direction of arrow D1 against the spring forces of the torsion springs 554 and 555. When the upper housing 503 is further turned downward, the stop pawls 551*a* and 552*a* are engaged into respective spaces between the upper housing and the rod members 559, 560, respectively, thereby locking the upper housing in position with respect to the lower housing 502.

On the other hand, to release the upper housing 503 from the lower housing 502, the driving member 556 is moved in the arrow direction D2 to turn the stop levers 551 and 552 in the direction opposite to the direction of arrows D1. This causes the stop pawls 551*a* and 552*a* to disengage from the rod members 559 and 560, so that the upper housing 503 can be turned upward and opened.

However, in the above electrophotographic apparatus 501, the integral construction incorporating the stop levers 551, 552 and torsion springs 554, 555 requires the extra operation of fixing the stop levers 551, 552 onto the shaft 553 by caulking, for example, as well as the construction that permits such operation. It also requires the use of torsion springs 554, 555 that are different parts from the stop levers 551, 552. Thus the above prior art arrangement has the problems of increasing the complexity of the construction and the number of components as well as the number of production steps. Such prior art arrangement has the further problem that the sloping faces 561, 562 and the stop levers 551, 552 abutting them can easily wear.

Furthermore, in the prior art electrophotographic apparatus 501 of FIG. 69, the transport rollers 521, the upper guide 525, the lower guide 522, and the resist rollers 523, which together constitute a transport device, are separately fixed to the housing of the electrophotographic apparatus 501. Therefore, when a paper jam has occurred in the vicinity of the transport rollers 521 or between the upper and lower guides 525 and 522 or near the resist rollers 523, the transport rollers 521 or the resist rollers 523 have to be rotated by hand to remove the jammed paper. When the jammed paper is lying between the upper and lower guides 525 and 522, an appropriate tool has to be used to remove the paper. Such manner of paper removal is cumbersome and labor consuming.

One approach to solving this problem is by constructing the housing in two separate sections, the upper housing and the lower housing, one being swingably joined to the other at one end thereof. In such construction, the photoconductor drum, developing unit, etc. are mounted inside the upper housing, and when the upper housing is opened, the transport device is exposed. Further, the upper guide 525 is swingably joined to the lower guide 522. However, this construction has the problem that if it is attempted to close the upper housing of the electrophotographic apparatus 501 with the upper guide 525 left open relative to the lower guide 522, the inside of the upper housing hits against the end of the upper guide 525 and may damage important parts, such as the photoconductor drum, developing device, etc., held inside the upper housing, FIG. 73 is a perspective view showing a paper exit section in the electrophotographic apparatus 501 of the typical prior art arrangement shown in FIG. 68. The electrophotographic apparatus 501 includes the rectangular box-like housing 503 in which inverting member 515 for changing the paper travelling direction upward and redirecting the paper toward the upstream side of the transporting direction A1, is provided near the downstream end of the transporting direction A1. The recording paper passed through the inverting member 515 is discharged onto a recording paper collection part 580 formed on the upper surface of the housing 503. Adjacent to the entrance to the inverting member 515 is a shaft 572 rotatably supported between side plate parts 570 and 571 of the housing 503. A plurality of driving rollers 573 spaced apart from each other by a prescribed distance are fixed on the shaft 572. Arranged upwardly of the driving rollers 573 in contacting relationship thereto are driven rollers 574. The driving rollers 573 and the driven rollers 574 constitute pairs of paper discharge rollers 530.

Each driven roller 574 has a shaft 581 that extends axially outward from both axial ends thereof in parallel to the axis of the shaft 572. The shaft 581 extending axially outward from both axial ends of each driven roller 574 is rotatably mounted to a mounting member 575, fixed from the rear side thereof, in the vicinity of an end part 503*a* of the housing 503 at the downstream end of the transporting direction A1.

The mounting member 575 is fixed at an end thereof to the end part 503*a* of the housing 503 and includes a connecting part 575*a* extending upstream from the end part 503*a* along the transporting direction A1, and support pieces 575*b*, 575*c* extending downward from both widthwise ends of the connecting part 575*a*. The shaft 581 is rotatably supported on the support pieces 575*b*, 575*c*.

Furthermore, there is provided for each driven roller 574 a plate spring 576 which, with a spring force thereof, presses down the shaft 581 from above as viewed facing FIG. 73. The plate spring 576 is essentially U-shaped in plan view, and includes a rectangular plate-like connecting part 577 fixed to the end part 503*a* and extending in parallel to the transporting direction A1, and a pair of pressure parts 578 and 579 extending from both widthwise ends of the connecting part 577 toward the downstream side of the transporting direction A1 and pressing downward the portions of the shaft 581 protruding from both axial ends of each driven roller 574. A plate spring 576 of such construction is provided for each of the driven rollers 574.

The paper discharge rollers 530 of the above prior art arrangement operate as follows. When the recording paper has reached the transporting direction A1 area after transfer, the recording paper is guided and caught between the driving rollers 573 and the driven rollers 574. The recording paper is further transported downstream along the transporting direction A1 by the rotation of the driving rollers 573. At this time, the pressure parts 578, 579 of each plate spring 576 press the shaft 581 downward with their spring force, and at the same time, are bent in the thickness direction thereof according to the thickness of the recording paper, thereby allowing vertical displacement of each driven roller 574.

When, for example, a relatively small-sized and stiff paper such as a post card is fed between the paper discharge rollers 530 of the above prior art arrangement, the post card will pass between one or two pairs of paper discharge rollers 530 near the widthwise center of the housing. After that, the travelling direction of the post card will be turned 180 degrees by passing along the inverting member 515. However, at this time, the leading edge of the post card may be bent upward along the inverting member 515 when the trailing edge thereof has not yet exited the paper discharge rollers 530. If this happens, since the post card is relatively stiff, there is a possibility that the driven roller 574 that should hold down the post card may be displaced upward by the post card against the spring force of the plate spring 576 and may not be able to sufficiently press the post card onto the driving roller 573. In this case, the rotation of the driving roller 573 cannot be transmitted to the driven roller 574, causing the post card to stop partway through the inverting path.

Furthermore, in an electrophotographic apparatus of typical prior art construction comprising a cleaning device for removing toner remaining on the surface of a photoconductor drum, and a waste toner container for collecting waste toner discharged from the cleaning device, there is provided a shutter at a waste toner exhaust port to prevent the waste toner from spilling out of the cleaning device when the cleaning device and the waste toner container are separated each other in an operation of exchanging the cleaning device or the waste toner container.

FIGS. 74(*a*)–74(*c*) are schematic cross-sectional view showing the shutter mechanism of the waste toner exhaust port of such prior art. As shown in FIG. 74 (*a*), on part of the cleaning device is mounted a cylindrical waste toner transport member 594 provided with a waste toner exhaust port opening downward. A shutter 593 which can cover the waste toner exhaust port and slide around the outer circumference of the waste toner transport member 594 prevents the waste toner 595 inside from leaking out.

In this condition, when waste toner container 591 provided with an opening 592 is moving rightward in FIG. 74(*b*), first a corner portion 591*a* of the waste toner container 591 comes in contact with a lever 593*a* integrated with the shutter 593. As the waste toner container 591 is further moving rightward, the shutter 593 is displaced angularly in the counterclockwise direction as shown in FIG. 74 (*b*), until the opening 592 takes a position just under the waste toner exhaust port as shown in FIG. 74 (*c*) and the waste toner falls down by its own weight out of the waste toner exhaust port.

Thus, most of the waste toner 595 accommodated inside the waste toner transport member 594 can be collected into the waste toner container 591.

According to another prior art shutter mechanism, there is provided a protrusion on a portion of the housing frame which can open and close relatively to the electrophotographic apparatus body upon the housing frame closing, such protrusion engaging a shutter mounted at the waste toner exhaust port and opening or closing the shutter.

However, in the prior art shutter mechanism shown in FIGS. 74(*a*)–74(*c*), the arrangement that the lever 593*a* of the shutter 593 and the waste toner container 591 come in contact directly is likely to bring about a restriction on the order of the attaching/detaching operation of the cleaning device provided with shutter 593 and the attaching/detaching operation of the waste toner container 591. Therefore, there are difficulties of operation that one is not attachable if the other is not attached to the electrophotographic apparatus body.

Furthermore, as shown in FIG. 74 (*b*), since there exists a state that the shutter 593 is gradually opening in the process of the attaching operation of the waste toner container 591, a part of the waste toner 595 is likely to leak out of the opening of the shutter 593 until the waste toner container 591 takes a regular position, resulting in the problem that all of the waste toner 595 cannot be collected into the waste toner container 591 and a part thereof may be scattered.

On the other hand, in such prior art arrangement, whether the waste toner container is set in the electrophotographic apparatus body or not, the opening / closing operation of the housing frame causes the shutter to open, resulting in the problem that a portion of the waste toner is likely to be scattered inside the apparatus in case the housing frame closes without attaching the waste toner container.

SUMMARY OF THE INVENTION

It is an object of the invention to provide an electrophotographic apparatus that overcomes the above enumerated technical problems and that permits a compact construction in a reduced installation space while enhancing the serviceability.

It is another object of the invention to provide an electrophotographic apparatus that realizes a drastic simplification in construction and achieves a reduction in the number of parts used.

It is yet another object of the invention to provide an electrophotographic apparatus that can greatly ease maintenance operations while achieving an improvement in image printing quality.

It is yet another object of the invention to provide an electrophotographic apparatus that is equipped with a developing device capable of providing improved toner agitating efficiency.

It is yet another object of the invention to provide an electrophotographic apparatus that is equipped with a developing device that achieves a drastic improvement in reliability of sealing.

It is yet another object of the invention to provide an electrophotographic apparatus that has a construction capable of preventing toner spillage and assuring improved printing quality, while achieving compactness and extended service life of the construction.

It is yet another object of the invention to provide an electrophotographic apparatus that achieves an improvement in the quality of images formed on a recording sheet and is capable of transporting the recording sheet without stopping abruptly.

It is yet another object of the invention to provide an electrophotographic apparatus that achieves a reduction in the number of parts used and simplification in the construction while achieving a reduction in the number of production steps.

It is yet another object of the invention to provide an electrophotographic apparatus that can greatly ease maintenance operations while enhancing reliability of the apparatus by preventing damage thereto.

It is yet another object of the invention to provide an electrophotographic apparatus that has a roller support construction capable of preventing a recording sheet from abruptly stopping during transportation, and thereby improving the reliability of transportation.

It is yet another object of the invention to provide an electrophotographic apparatus having a shutter structure of a waste toner exhaust port that can collect waste toner discharged out of a toner accommodation device such as a cleaning device without scattering.

The invention provides an electrophotographic apparatus comprising:

a lower housing of box-like shape having an open top;

an upper housing swingably joined to the lower housing at one end of the upper housing as viewed along a predetermined transporting direction of a recording sheet;

a process cartridge that holds in a housing thereof a photoconductor drum and a developing device in integral fashion, the process cartridge being detachably mounted into the upper housing and swingably supported to the upper housing at one end of the process cartridge as viewed along the transporting direction opposite a predetermined mounting position on the lower housing in such a way that, when the upper housing is opened, the process cartridge is disengaged from the mounting position and is angularly displaced with the other end of the process cartridge as viewed along the transporting direction opening relatively to the upper housing; and a guide member for guiding and positioning the process cartridge into the mounting position when the upper housing is closed, the construction of the apparatus being such that the process cartridge is mounted into the upper housing with the upper housing set in an open position, that the process cartridge is engaged into the mounting position in the apparatus when the upper housing is closed, and that the process cartridge is removed from the upper housing with the upper housing opened and with the process cartridge disengaged from the upper and lower housings.

In a preferred mode of the invention, the position at which the process cartridge is supported to the upper housing is chosen to be lower than the position at which the upper housing is joined to the lower housing when the upper housing is set in a closed position.

According to the invention, when installing or removing the process cartridge, the upper housing is turned about its support position on the lower housing to set it in an open position. As the upper housing is opened relatively to the lower housing, the process cartridge is angularly displaced about its support position on the upper housing and is disengaged from the mounting position on the lower housing, the angular displacement being such that the process cartridge becomes separated from the upper housing at said other end thereof as viewed along the transporting direction. The process cartridge, thus disengaged from the upper and lower housings, can be easily removed from the upper housing. This also facilitates the installation of a new process cartridge and other maintenance operations. Furthermore, since the support point about which the upper housing is turned relatively to the lower housing is provided near the upper end of the one end portion of the upper housing as viewed along the transporting direction, the one end portion of the upper housing does not protrude outwardly from the one end portion of the lower housing when the upper housing is opened to separate away from the lower housing. This contributes to reducing the space required for installation of the electrophotographic apparatus.

Furthermore, according to the invention, when the upper housing is closed, the process cartridge is guided by the guide member and engaged into the mounting position on the lower housing. This serves to ease the positioning accuracy of the upper housing construction and thus contributes to simplifying the construction and the production process associated therewith.

The support position of the process cartridge is chosen to be lower than the support position of the upper housing on the lower housing. Therefore, when the upper housing is opened, the process cartridge moves upward while moving toward said other side of the transporting direction. This construction greatly eases the removal and installation of the process cartridge.

The invention also provides an electrophotographic apparatus having a transfer device installed in close proximity to a photoconductor drum, wherein the transfer device has an integral construction comprising:

a transfer charger disposed facing a transfer area where a toner image on the photoconductor drum is transferred onto a recording sheet;

a first guide member for guiding the recording sheet toward a path between the transfer charger and the photoconductor drum; and a second guide member for guiding the recording sheet after transfer from the transfer charger;

at least one or the other of the first and second guide members being connected to a predetermined reference voltage.

According to the invention, the transfer device is installed in close proximity to the photoconductor drum. The transfer device has an integral construction, comprising a transfer charger, a first guide member disposed upstream of the transfer charger as viewed along the transporting direction of the recording sheet, and a second guide member disposed downstream of the transfer charger. As the recording sheet travels toward the transfer area between the photoconductor drum and the transfer charger, the recording sheet is first guided by the first guide member and fed between the transfer charger and the photoconductor drum, and after the toner image on the photoconductor drum is transferred by the transfer charger, the recording sheet is guided out of the transfer charger by the second guide member.

Furthermore, at least one or the other of the first and second guide members is connected to a prescribed reference voltage. Therefore, even if the recording sheet is charged with static electricity through friction during transportation before reaching the transfer area, the voltage of the recording sheet is reduced to the reference voltage through the first guide member, thereby eliminating the adverse effects that may otherwise be caused to the subsequent transfer operation. Further, after transfer, the voltage of the recording sheet is reduced to the reference voltage through the second guide member, which serves to facilitate the handling of the recording sheet after transfer.

Moreover, the first guide member, the transfer charger, and the second guide member are integrally constructed to complete the transfer device. As compared to the prior art construction in which these components are separately provided, the construction of the invention serves to simplify the structure for mounting to the housing, etc. of the electrophotographic apparatus, and also makes it possible to reduce the number of parts used.

The invention also provides an electrophotographic apparatus having a transport device, wherein the transport device includes:

a first guide member for guiding thereon a recording sheet being transported along a predetermined transporting direction; and a second guide member, located below a developing device, for receiving toner spilt from the developing device and for guiding the recording sheet along a path between the first and second guide members, the second guide member being swingably joined to the first guide member at one end thereof as viewed along the transporting direction.

According to the invention, the transport device comprises a first guide member and a second guide member between which a recording sheet is transported. In the event that the recording sheet stops partway through the transport device, either the first guide member or the second guide member is opened relatively to the other around a point near the one end thereof as viewed in the transporting direction of the recording sheet. As a result, the transport path of the recording sheet defined by the first and second guide members is exposed, which greatly eases maintenance work as well as removal of the recording sheet lying therein.

The second guide member is located below the developing device. Therefore, in case of toner spillage from the developing device, the spilt toner is received on the second guide member, preventing contamination of the first guide member on which the recording sheet travels. Thus, the recording sheet is prevented from being soiled with split toner, which contributes to greatly improve the image print quality.

The invention also provides an electrophotographic apparatus having a developing device, wherein the developing device includes:

a toner containing section for containing toner used for developing;

a housing defining a developing section that contains developing means;

agitating means, contained in the developing section of the housing, for agitating the toner; and a toner carrying member disposed below a toner supply port formed between the toner containing section and the developing section, and having an elastic blade formed from elastic material and extending over a distance longer than the distance to an inner circumferential face of the housing, the construction of the toner carrying member being such that, with the rotation of the toner carrying member, the elastic blade is bent by being pressed against the inner circumferential face of the housing, and after further rotation of the toner carrying member, the elastic blade springs back into shape, thereby scattering the toner carried thereon toward the agitating means.

According to the invention, the toner in the toner containing section is supplied to the developing section through the toner supply port formed in the housing. As the toner carrying member, located below the toner supply port, is rotated, the elastic blade of the toner carrying member is bent by being pressed against the inner circumferential face of the housing. As the toner carrying member is further rotated, the elastic blade springs back into shape, thereby scattering the toner carried thereon toward the agitating means. Since the agitating means agitates the toner distributed in a scattered manner, the agitating efficiency is greatly increased.

The invention also provides an electrophotographic apparatus having a developing device, wherein the developing device includes:

a bearing installed at the position of a housing through which a rotation shaft accommodated in the developing device is passed;

a sealing cylinder, formed from a porous and resilient material, mounted inside the bearing and facing the interior of the housing, the rotation shaft being inserted through the sealing cylinder; and a magnetic piece which generates a magnetic force and through which the rotation shaft is inserted, the magnetic piece being mounted on the end of the sealing cylinder on the interior side of the housing, the developing device being characterized in that developer containing powder of magnetic material is attracted between the inner circumferential surface of the magnetic piece and the rotation shaft, to form a ring and thereby seal the developer in the housing.

According to the invention, powder consisting of ferromagnetic material is contained in the housing of the developing device. When the powder in the housing is likely to move, for example, along the rotating shaft of the agitator, etc., toward the outside of the housing, the powder is attracted by the magnetic force of the magnetic piece mounted on the rotating shaft in the vicinity of the housing wall, as a result of which the attracted powder is formed in a ring shape between the magnetic piece and the rotating shaft. That is, the ring of powder is, as it were, bonded to the magnetic piece by its magnetic force, and with this ring of powder, the developer consisting of powder and toner is prevented from moving toward the outside along the rotating shaft.

On the other hand, when any part of the powder formed in a ring shape by the magnetic force is likely to further move toward the outside of the housing, such powder is prevented from moving further outward by the presence of the sealing cylinder of porous and resilient material mounted on the outward side of the magnetic piece as viewed along the rotation shaft. Thus, the leakage of the developer outside the housing is doubly prevented by the presence of the magnetic piece and the sealing cylinder. This construction greatly enhances the reliability of sealing.

The invention also provides an electrophotographic apparatus comprising:

a lower housing of box-like shape having an open top;

an upper housing swingably joined to the lower housing at one end thereof as viewed along a predetermined transporting direction of a recording sheet;

a support member swingably mounted to the upper housing and opposite the lower housing in such a way that the support member opens toward the other end as viewed along the transporting direction;

a process cartridge detachably mounted to the support member, and holding in integral fashion in a housing thereof a photoconductor drum, a developing device, and a cleaning device for removing toner from the surface of the photoconductor drum after transfer of a toner image therefrom; and a waste toner containing member, detachably mounted to the support member, for containing waste toner collected by the cleaning device of the process cartridge.

According to the invention, the waste toner containing member for containing waste toner collected by the cleaning device of the process cartridge is detachably mounted to the support member that detachably holds the process cartridge. The support member is swingably mounted to the upper housing and opposite the lower housing. Therefore, when the upper housing is opened relatively to the lower housing, the waste toner containing member moves with the movement of the upper housing.

Accordingly, during opening or closing operations of the upper housing, the cleaning device mounted to the process cartridge and the waste toner containing member are prevented from repeatedly attaching and detaching from each other. This construction is effective in preventing toner spillage and serves to enhance the image print quality. Furthermore, according to the invention, since the waste toner containing member is connected with the process cartridge, the process cartridge can be notably simplified in construction and reduced in size. Also, since the waste toner removed from the photoconductor drum is not stored inside the process cartridge, the process cartridge can be used until the service life of the components contained therein, such as the photoconductor drum, runs out, thus achieving an extended service life.

The invention also provides an electrophotographic apparatus having a lower housing and an upper housing that opens and closes relatively to the lower housing, comprising:

the upper housing swingably joined to the lower housing at one end thereof as viewed along a predetermined transporting direction of a recording sheet;

a process cartridge swingably supported to the upper housing, and holding in integral fashion in a housing thereof a photoconductor drum, a developing device, and a cleaning device for removing toner from the surface of the photoconductor drum after transfer of a toner image therefrom, the process cartridge having an engaging protrusion extending at least from one side thereof;

the lower housing of box-like shape having an open top, and provided with: a stop member swingably attached near the upper end of a side thereof, and consisting of a pressing face, formed at one end across the swinging point, for pressing the engaging protrusion substantially from above to prevent it from lifting up, and an upwardly extending stop piece formed at the other end; and a mounting plate consisting of a supporting face for supporting the engaging protrusion from below and an engaging groove having an essentially V-shaped guide face for guiding the engaging protrusion to the supporting face, wherein, when the upper housing is closed, the engaging protrusion of the process cartridge is guided by the guide face of the mounting plate, supported by the supporting face, and engaged into the engaging groove in the mounting plate by being pressed by the pressing face of the stop member, with the upper housing abutting the stop piece of the stop member from above and with the process cartridge being held in the lower housing by the stop member.

According to the electrophotographic apparatus of the invention, the action of opening and closing the upper housing relatively to the lower housing proceeds in the following manner. To close the upper housing, the upper housing is turned toward the lower housing. With this action, the process cartridge swingably mounted in the upper housing also turns toward the lower housing. The engaging protrusion on each side of the process cartridge is guided by the guide face of the mounting plate of the lower housing, supported by the supporting face, and engaged into the engaging groove in the mounting plate. In this condition, the upper housing abuts the stop piece of the stop member from above, thereby stopping the angular displacement of the stop member.

Thus, the engaging protrusion on the process cartridge is maintained in engagement with the engaging groove in the mounting plate. As a result, the process cartridge is held in a predetermined position relatively to the lower housing by means of the mounting plate, and any play is eliminated when the upper housing is closed.

To release the process cartridge from its locked position described above, the upper housing is turned in an opening direction relatively to the lower housing. As a result, a gap is created between the stop piece of the stop member and the upper housing, and the stop member is angularly displaced to disengage the engaging protrusion of the process cartridge from the pressing face of the stop member, thus allowing the upper housing to be opened with a wide angle relatively to the lower housing.

As described, according to the invention, when the upper housing is closed, the process cartridge is held in position in the lower housing with the mounting plate engaging the process cartridge. As compared with the prior art construction in which the upper housing is provided with a framework for holding the process cartridge therein, there is no need to provide clearance to allow for the removal and installation of the process cartridge, and therefore, the process cartridge can be positioned with high accuracy relatively to the lower housing. Thus, the construction of the invention overcomes the problem of positional displacement of images formed on a recording sheet caused by the play described in connection with the prior art example, and thereby assures a significant improvement in the image quality. The construction also serves to prevent transportation troubles that may occur to a recording sheet travelling in the vicinity of the photoconductor drum of the process cartridge.

The invention also provides an electrophotographic apparatus comprising:

a lower housing of box-like shape having an open top and provided with an engaging member swingably mounted at one end thereof as viewed along a transporting direction of a recording sheet, the engaging member consisting of an upwardly extending engaging pawl and a spring member; and an upper housing swingably joined to the lower housing at the other end thereof as viewed along the transporting direction of the recording sheet, the upper housing being provided, at the one end of the upper housing as viewed along the transporting direction, with an engaging part for engaging the engaging pawl and a pressure part for pressing the spring member from above, wherein, when the upper housing is closed, the pressing part presses the spring member to angularly displace the engaging member, thereby engaging the engaging pawl with the engaging part of the upper housing.

According to the invention, when the upper housing is closed relatively to the lower housing, the engaging part of the upper housing is positioned opposite the engaging pawl of the engaging member mounted on the lower housing. Thereupon, the pressing part of the upper housing presses the spring member of the engaging member to angularly displace the engaging member mounted on the lower housing, thereby engaging the engaging pawl with the engaging part of the upper housing. The upper housing is thus locked in position relatively to the lower housing. To release the upper housing from the locked position, the engaging member is angularly displaced against the spring force of the spring member in a direction that the engaging pawl of the engaging member disengages from the engaging part of the upper housing. The upper housing is thus unlocked from the lower housing.

The integral construction for locking and unlocking the upper housing on the lower housing, as described above, is achieved by the engaging member of the construction that can maintain substantial coordination between the engaging pawl and the spring member. That is, the construction of the invention eliminates the need for such parts as stop levers that need caulking and torsion springs wound around a shaft, as required in the prior art construction, and thus contributes to reducing the number of parts used and to simplifying the construction. Furthermore, since such extra operations as mounting the torsion springs, etc., and fixing such engaging parts on the shaft, are not needed, the invention also achieves a reduction in the number of manufacturing steps.

The invention also provides an electrophotographic apparatus having a transport device comprising a first guide member for guiding thereon a recording sheet being transported along a predetermined transporting direction and a second guide member for guiding the recording sheet along a path between the first and second guide members, the second guide member being swingably joined to the first guide member near one end thereof as viewed along the transporting direction, wherein the second guide member, when not supported, closes by itself around the first guide member.

According to the invention, the transport device comprises a first guide member and a second guide member between which a recording sheet is transported. In the event that the recording sheet stops partway through the transport device, either the first guide member or the second guide member is opened relatively to the other around a point near the one end thereof as viewed in the transporting direction of the recording sheet. As a result, the sheet transport path defined by the first and second guide members is exposed, which greatly eases maintenance operations as well as removal of the recording sheet lying therein. Furthermore, since the second guide member, when not supported, closes by itself around the first guide member, the situation is prevented where the second guide member hits the upper housing and thereby damages important parts, such as the photoconductor drum, when the upper housing is closed to cover the second guide member. This serves to greatly enhance reliability.

The invention also provides an electrophotographic apparatus having a transport device comprising a first guide member for guiding thereon a recording sheet being transported along a predetermined transporting direction and a second guide member for guiding the recording sheet along a path between the first and second guide members, the second guide member being swingably joined to the first guide member near one end thereof as viewed along the transporting direction, the apparatus comprising:

holding means for holding the second guide member in an open position when it is opened; and a protecting member for protecting component damage caused by hitting against a free end of the second guide member, the protecting member being mounted at a position facing the free end of the second guide member when the second member is held in the open position.

According to the invention, the transport device comprises a first guide member and a second guide member between which a recording sheet is transported. In the event that the recording sheet stops partway through the transport device, either the first guide member or the second guide member is opened relatively to the other around a point near the one end thereof as viewed in the transporting direction of the recording sheet. At this time, the second guide member is held in its open position by the holding means. On the other hand, the protecting member is mounted in the upper housing at a position facing the free end of the second guide member when the second guide member is set in its open position.

As described, since the recording sheet transport path defined by the first and second guide members can be exposed, the construction greatly eases maintenance operations as well as removal of the recording sheet lying therein. Furthermore, the provision of the protecting member effectively prevents the situation where the second guide member hits the upper housing and thereby damages important parts, such as the photoconductor drum, when the upper housing is closed. This serves to greatly enhance reliability.

The invention also provides an electrophotographic apparatus having a roller support structure for transporting a sheet by pressing it between rollers and for reversing the travelling direction of the sheet immediately after the sheet has passed the rollers, wherein the roller support structure comprises:

a plurality of driving rollers for rotation, arranged spaced apart from each other by a predetermined distance along the axial direction thereof and mounted in such a manner as to face one side of the sheet;

a plurality of first driven rollers arranged facing the driving rollers and urged toward the driving rollers; and a second driven roller mounted at a position between the first driven rollers, the position including at least the midpoint along the arranging direction of the first driven rollers, and supported or urged with an amount of elastic displacement being smaller than that of the first driven rollers, wherein the sheet is pressed between the driving rollers and the first driven rollers with the displacement of the sheet being limited by the second driven roller.

According to the invention, when a relatively large-sized and yielding sheet is transported, the sheet is pressed between the plurality of driving roller/first driven roller pairs and is transported by the rotation of the driving rollers. Even if the sheet passing the driving rollers and driven rollers abruptly changes its travelling direction, the yielding sheet remains pressed onto the driving rollers under the spring force resulting from the resilience of the spring members, so that the sheet remains pressed between the driving rollers and driven rollers and keeps travelling.

On the other hand, when a relatively small-sized and stiff sheet is transported and abruptly changes its travelling direction after passing the driving rollers, the sheet is in contact with only a few of the plurality of driving rollers. This means fewer spring members acting, and hence, less spring force applied on the sheet. On the other hand, according to the invention, a second driven roller is mounted at a position between the first driven rollers, the position including at least the midpoint along the arranging direction of the first driven rollers. The second driven roller is supported in such a way as to limit the displacement in a direction away from the driving rollers.

Accordingly, when a relatively small-sized and stiff sheet, such as a post card, is fed, the second driven roller applies enough pressure to press such stiff sheet toward the driving roller side since the second driven roller is supported by a second support member having a greater stiffness than that of the first-mentioned spring members. The second driven roller of the invention is not provided with a mating driving roller, and therefore, presses the stiff sheet to curve it along the previously mentioned width direction. This causes the sheet to contact firmly on the driving rollers and the second driven roller, so that the driving force can be transmitted via the driving rollers. Thus, the invention prevents transportation difficulties, etc., regardless of the thickness of the sheet used, and ensures greatly improved performance of the paper transport operation.

The invention also provides an electrophotographic apparatus having a shutter structure of a waste toner exhaust port, wherein a waste toner accommodation device for accommodating waste toner is mounted in such a manner as to be displaced upward and downward, a shutter is mounted at a waste toner exhaust port of the waste toner accommodation device, a waste toner container for collecting waste toner discharged out of the waste toner exhaust port is mounted under the waste toner exhaust port, and the shutter opens in such a manner that a lever interlocked with the shutter is displaced in contact with a portion of the waste toner container when the waste toner accommodation device is displaced downward.

According to the invention, the waste toner container is mounted under the waste toner exhaust port. When the waste toner accommodation device is displaced downward, the shutter opens in such a manner that the lever interlocked with the shutter is displaced in contact with a portion of the waste toner container, thereby allowing waste toner discharged during the opening/closing operation of the shutter to be collected without leakage.

In addition, since the shutter remains closed even though the waste toner accommodation device is displaced downward when the waste toner container is not mounted, the waste toner is not scattered, thereby preventing the waste toner from contaminating the inside of the electrophotographic apparatus.

Furthermore, the lever interlocked with the shutter and the waste toner container separate from each other by a predetermined distance when the waste toner accommodation device is not displaced downward. Accordingly, there is no mutual interference in attaching either the waste toner accommodation device or the waste toner container. This eases the removal and installation thereof.

BRIEF DESCRIPTION OF THE DRAWINGS

Other and further objects, features, and advantages of the invention will be more made explicit from the following detailed description taken with reference to the drawings wherein.

DETAILED DESCRIPTION OF THE PREFERRED EMBODIMENTS

Figure 1:
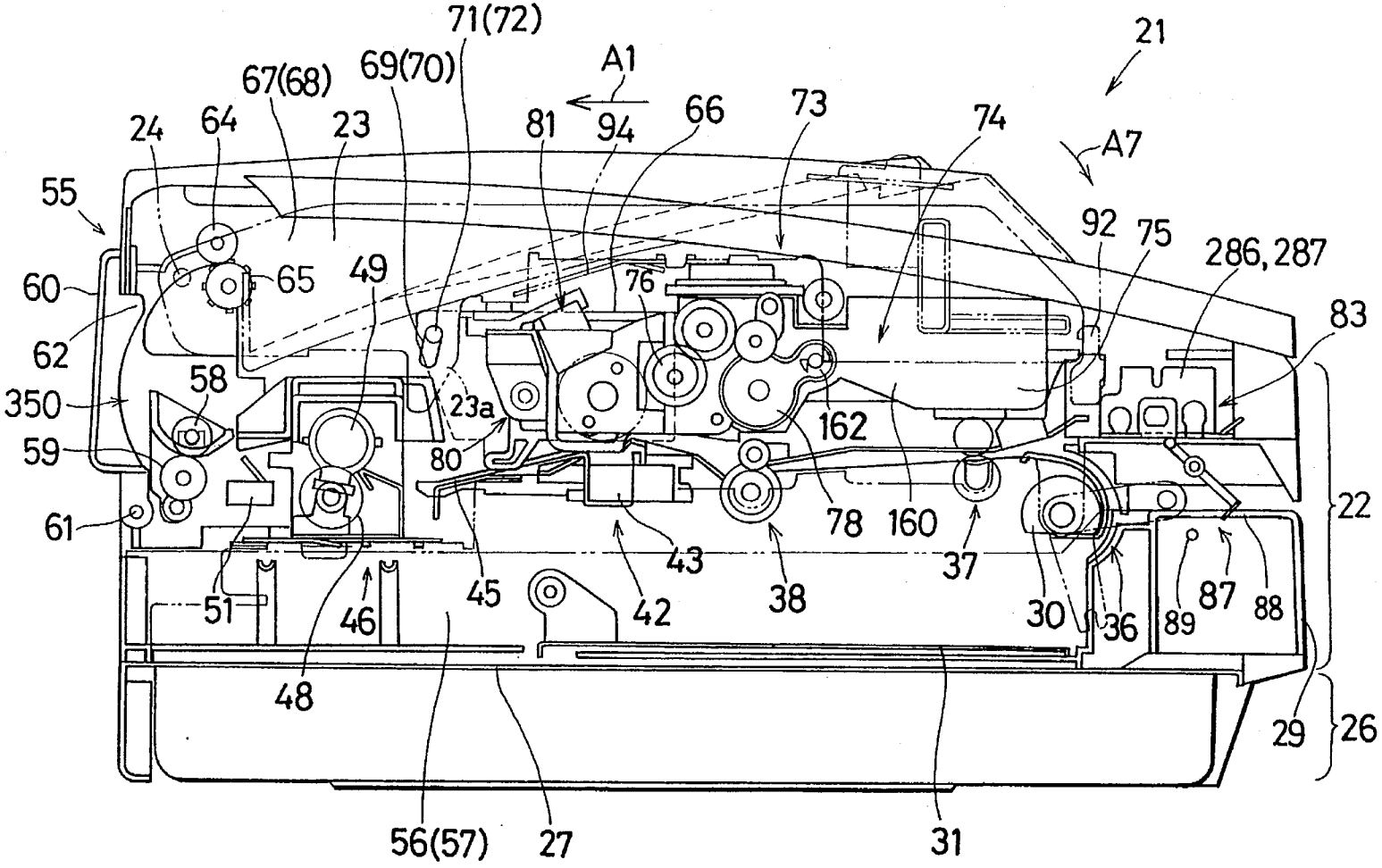
FIG. 1 is a front view of an LED printer according to one embodiment of the invention.

Now referring to the drawings, preferred embodiments of the invention are described below.

(1) Description of the general construction

Figure 2:
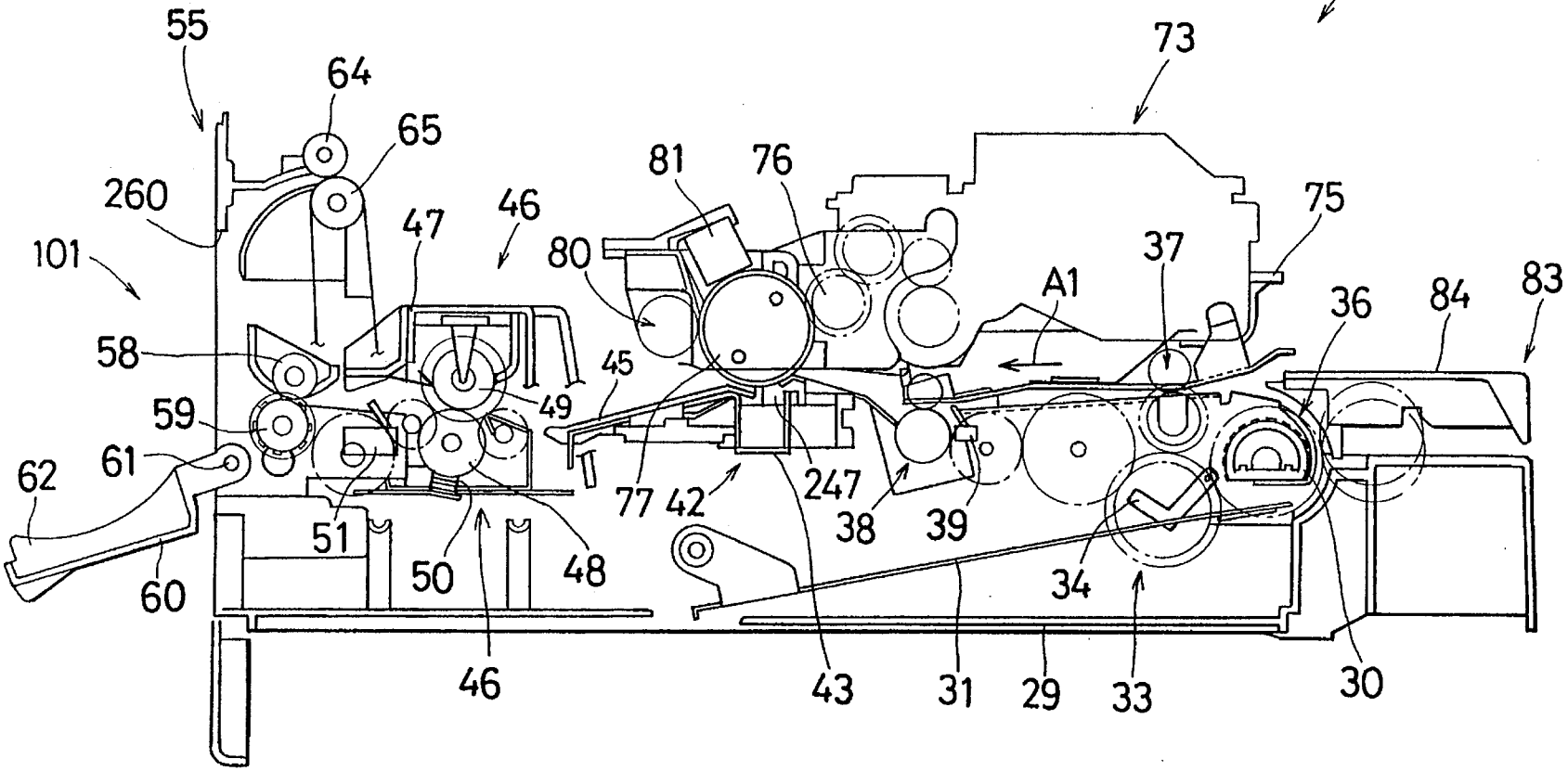
FIG. 2 is a schematic view showing the construction of the LED printer.
Figure 3:
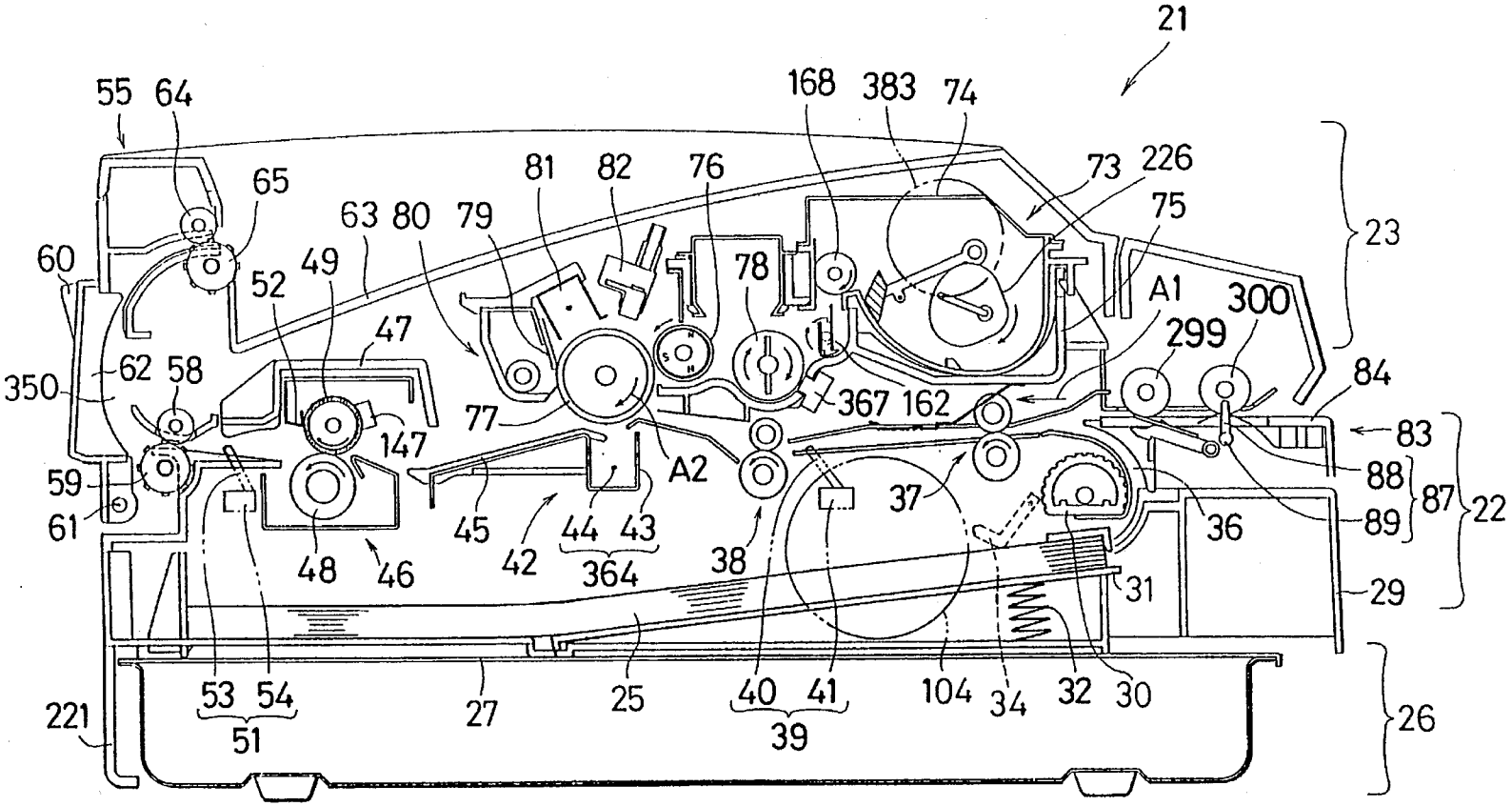
FIG. 3 is a schematic view showing an arrangement of rollers and recording paper detecting means in the LED printer.
Figure 4:
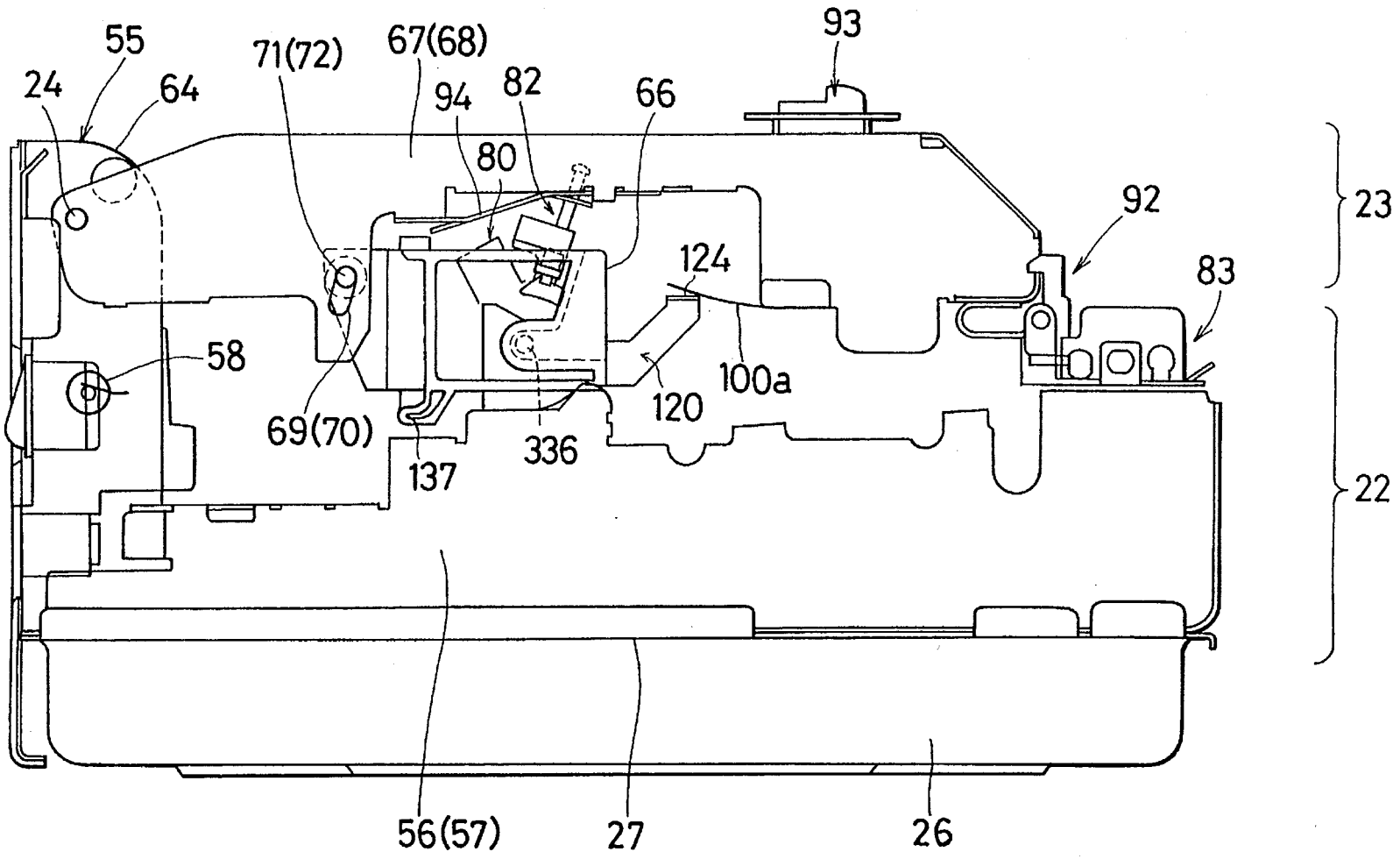
FIG. 4 is a front view of a lower housing and an upper housing.

FIG. 1 is a general cross sectional view of an LED printer 21 in one embodiment of an electrophotographic apparatus according to the present invention, FIG. 2 is a schematic view showing the construction of the LED printer 21, and FIG. 3 is a schematic view showing an arrangement of components such as sensors and rollers in the LED printer 21. The LED printer 21 generally comprises an essentially box-like lower housing 22 having an open top, and an upper housing 23 having a shape to cover the lower housing 22. The upper housing 23 is mounted swingably about a support shaft 24 near the upper end portion of a downstream end section of the LED printer 21. The lower housing 22 has an open top, as noted above. FIG. 4 is a front view showing the lower housing 22 and the upper housing 23 assembled together.

Throughout this specification, the terms "upstream" and "downstream" are used in a relative sense in relation to a recording paper transporting direction indicated by arrow A1, unless otherwise noted.

A paper cassette 29 holding a stack of recording paper sheets 25 is detachably mounted from the upstream side into the lower housing 22. The paper cassette 29 is provided with a lift plate 31 which is urged upward by a spring 32 to bring the recording paper 25 into close proximity to an essentially semi-cylindrical paper feed roller 30 located in the right side of FIG. 2. The paper feed roller 30 is semi-cylindrical in shape, as noted, so that the recording paper 25 is fed and then stopped as the roller 30 revolves by one turn.

The paper feed roller 30 is rotatably mounted in the upstream side of the lower housing 22, with its axis running in parallel to the width direction of the LED printer 21 and crossing at right angles with the transporting direction A1, that is, perpendicular to the plane of FIG. 2. Downstream of the paper feed roller 30 and upward of the lift plate 31 is installed a detecting means 33 for detecting the presence or absence of the recording paper 25 in the paper cassette 29. The detecting means 33 consists of an essentially L-shaped detection lever 34 mounted rotatably about a shaft extending parallel to the width direction, and a photosensor 35 (see FIG. 28) for optically detecting the position of the detection lever 34, the photosensor 35 being located at a corresponding position under the lift plate 31. That is, the lift plate 31 is provided with a throughhole (not shown) through which the detection lever 34 is allowed to turn and protrude downward. More specifically, when there is no recording paper 25 on the lift plate 31, the detection lever 34 is allowed to rotate downwardly and protrude below the lift plate 31 through the throughhole provided therein. FIG. 2 shows the condition in which no recording paper is loaded. When the photosensor 35 detects the detection lever 34 in this condition, it signals that no recording paper 25 is loaded in the paper cassette 29.

The recording paper 25, delivered by the paper feed roller 30 toward the upstream side, is passed through an inverting path 36 provided near the upstream end of the LED printer 21. By passing through the inverting path 36, the paper feed direction is inverted and the recording paper 25 is now directed toward the downstream side and transported downstream while being pressed between a pair of transport rollers 37 until the leading edge of the recording paper 25 is caught between a pair of resist rollers 38. On the upstream side of the resist rollers 38 is disposed a detecting means 39 for detecting the recording paper. This detecting means 39 again consists of a detection lever 40, and a photosensor 41 for optically detecting the end portion of the detection lever 40 which is rotatable according to the presence or absence of the recording paper.

The recording paper 25 that passed the resist rollers 38 is fed to a transfer device 42 where image transfer processing is performed, as will be described later. The transfer device 42 is a box-like unit extending longitudinally along the width direction of the LED printer 21, and comprises a transfer charge unit 364 consisting of a shielded metal case 43 having an open side extending along the width direction and a charge wire 44 stretched along the shielded case 43, and a guide plate 45 extending downstream from the periphery of the opening of the shielded case 43, the guide plate 45 being formed from a low-friction plastic material or the like for smoothly guiding the recording paper 25. The guide plate 45 of the transfer device 42 constitutes a part of a guide path for the recording paper 25.

When the transfer operation by the transfer device 42 is completed, the recording paper is transported to a fixing device 46. The fixing device 46 comprises an essentially box-like housing 47 accommodating therein a pressure roller 48 and a heating roller 49 which are disposed contacting each other, the pressure roller 48 being pressed against the heating roller 49 by spring force. Downstream of the fixing device 46 is installed a detecting means 51 for detecting the recording paper 25. The detecting means 51 has a construction similar to that of the detecting means 33, 39, and includes a detection lever 53 protruding in the transport path of the recording paper 25 and a photosensor 54 for detecting the angular displacement of the detection lever 53 when pressed by the recording paper 25. The detecting means 51 constitutes a part of a rear unit 55 that forms the downstream end section of the lower housing 22.

The rear unit 55 is secured to the downstream end of a pair of side frames, described later, installed in upright position on both sides of the lower housing 22 across the width thereof, i.e. on both sides thereof as viewed along a direction perpendicular to the plane of FIG. 2. Inside the rear unit 55 and downstream of the detecting means 51, there are mounted a pair of paper discharge rollers 58 and 59, opposite each other, for discharging the recording paper after fixing outside the printer. The rear unit 55 has an opening 101 formed on the downstream side of the paper discharge rollers 58 and 59, and a rear cover 60 that can cover the opening 101 is mounted swingably about shafts 61 installed below the opening 101 of the rear unit 55.

Inside the rear cover 60 there is provided an inverting member 62 having an essentially semi-circular inner surface rising from the vicinity of the contact position between the paper discharge rollers 58 and 59, thus forming an inverting path 350 through which the traveling direction of the recording paper being transported by the paper discharge rollers 58, 59 is changed upward and then turned toward the upstream side. Near the exit of the inverting member 62, there are installed a pair of paper discharge rollers 64 and 65, opposite each other, for discharging the transported recording paper onto a stacker 63 mounted on the upper housing 23.

A support member 66 having an open end at the upstream side thereof is mounted substantially centrally in the upper housing 23 with respect to the longitudinal direction thereof. The support member 66 is mounted in place with support shafts 71, 72 formed on both sides of the support member 66 across the width thereof being rotatably engaged into elongated holes 69, 70 formed in the respective side frames 67, 68 of the upper housing 23, the elongated holes 69, 70 being formed slanting downward from the upstream to the downstream side. A process cartridge 73 is detachably mounted on the support member 66 to form an assembly therewith.

The process cartridge 73 has a housing 75 in which a toner box 74 containing toner is detachably mounted. The housing 75 also holds a developing roller 76 and a photoconductor drum 77 which are rotatably mounted with their axes parallel to each other and spaced apart by a predetermined distance. The process cartridge 73 is also provided with an agitator 78 for mixing carrier with the toner supplied from the toner box 74 and distributing the mixture as developer to the developing roller 76. Disposed in close proximity to the agitator 78 is a toner sensor 367 for detecting the toner density in the developer. Around the photoconductor drum 77 in the housing 75 and downstream of the developing roller 76 in the rotating direction A2 of the photoconductor drum 77, i.e, in the left side of FIG. 3, there are mounted a cleaning device 80 having a cleaning blade 79 for scraping toner remaining on the photoconductor drum 77 after the transfer operation by the transfer device 42, and a charge unit 81, such as a corona charger, for applying a uniform .charge of predetermined polarity to the surface of the photoconductor drum 77. A spacing is provided between the charge unit 81 and the developing roller 76, and in this space, an LED array 82 is positioned which emits light for forming a desired optical image on the surface of the photoconductor drum 77 charged by the charge unit 81. The LED array 82 is swingably mounted to the upper housing 23, as will be described later.

A manual feed device 83 used for manually feeding recording paper into the LED printer 21 is mounted near the upstream end of the lower housing 22 and adjacent to the upper end of the inverting path 36, shown in FIGS. 1 and 2, where the recording paper 25 delivered from the paper cassette 29 is inverted for transportation toward the downstream side. The manual feed device 83 comprises a loading tray 84 on which recording paper is placed for manual feeding, and mounting plates 286, 287 installed on both sides of the loading tray 84 across the width thereof. The loading tray 84 is provided thereon with paper feed rollers 299, 300 for feeding the recording paper into the LED printer 21. Below the loading tray 84 is installed a detecting means 87 for detecting the presence or absence of recording paper on the loading tray 84 and switching the paper feed operation in the LED printer 21 between the paper feed cassette 29 and the manual feed device 83. The detecting means 87 has a construction similar to that of the detecting means 33, 39, etc., and includes a detection lever 88 that is turned when a recording paper is placed on the loading tray 84, and a photosensor 89 for detecting the angular motion of the detection lever 88.

Recording paper is fed from the manual feed device 83 by the paper feed rollers 299 and 300 toward the downstream side, and is caught between the transport rollers 37 near the upper end of the inverting path 36 for further transportation to the resist rollers 38. In this manner, when a recording paper is placed on the manual feed device 83, the presence of the recording paper is detected by the detecting means 87. In such case, even when the paper feed cassette 29 is installed in the LED printer 21, the paper feed roller 30 will not be operated, but the manual feed operation by the manual feed device 83 will be first serviced, as will be described later.

(2) Description of the upper housing 23

Figure 5:
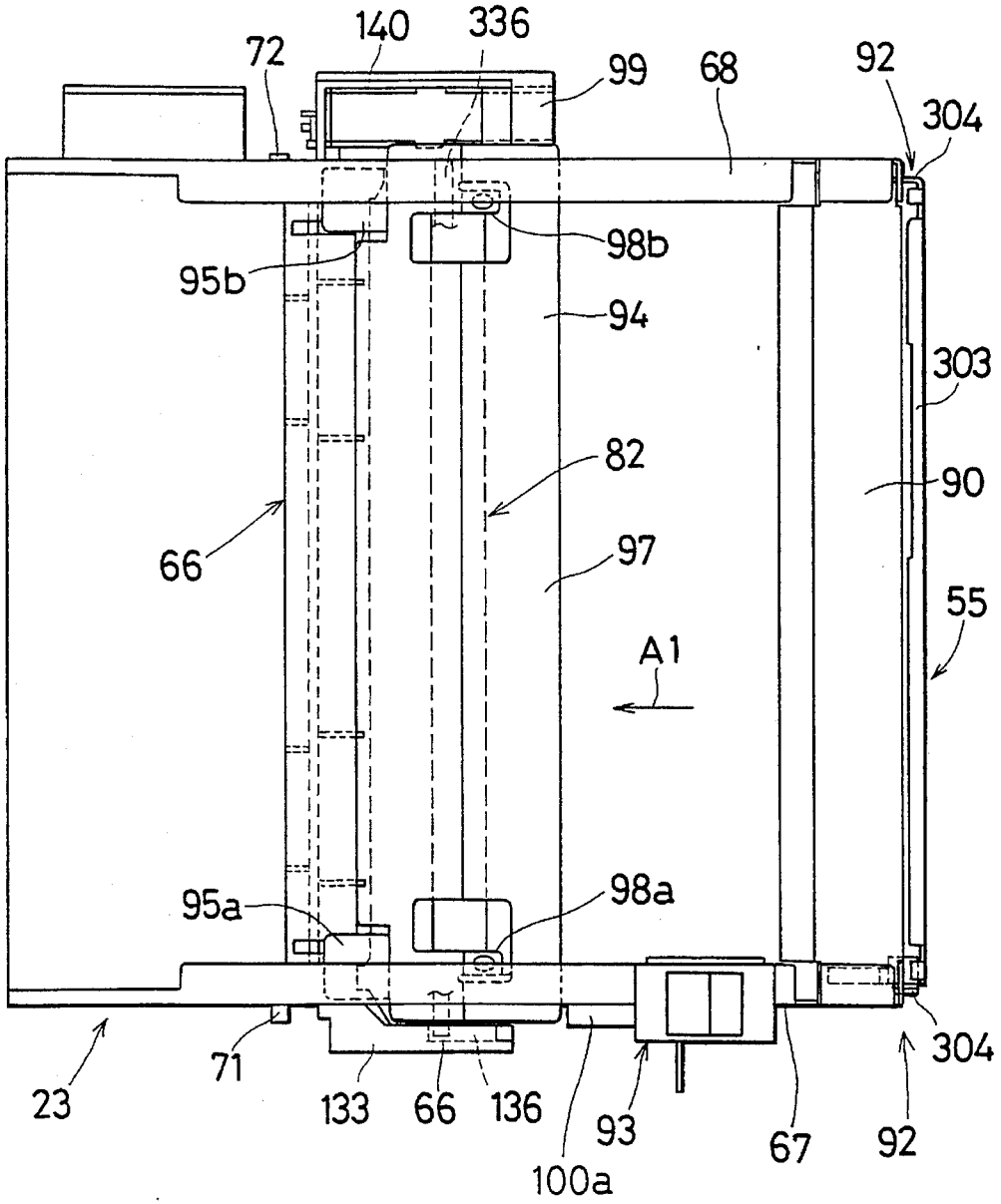
FIG. 5 is a plan view of the upper housing shown in FIG. 4.
Figure 6:
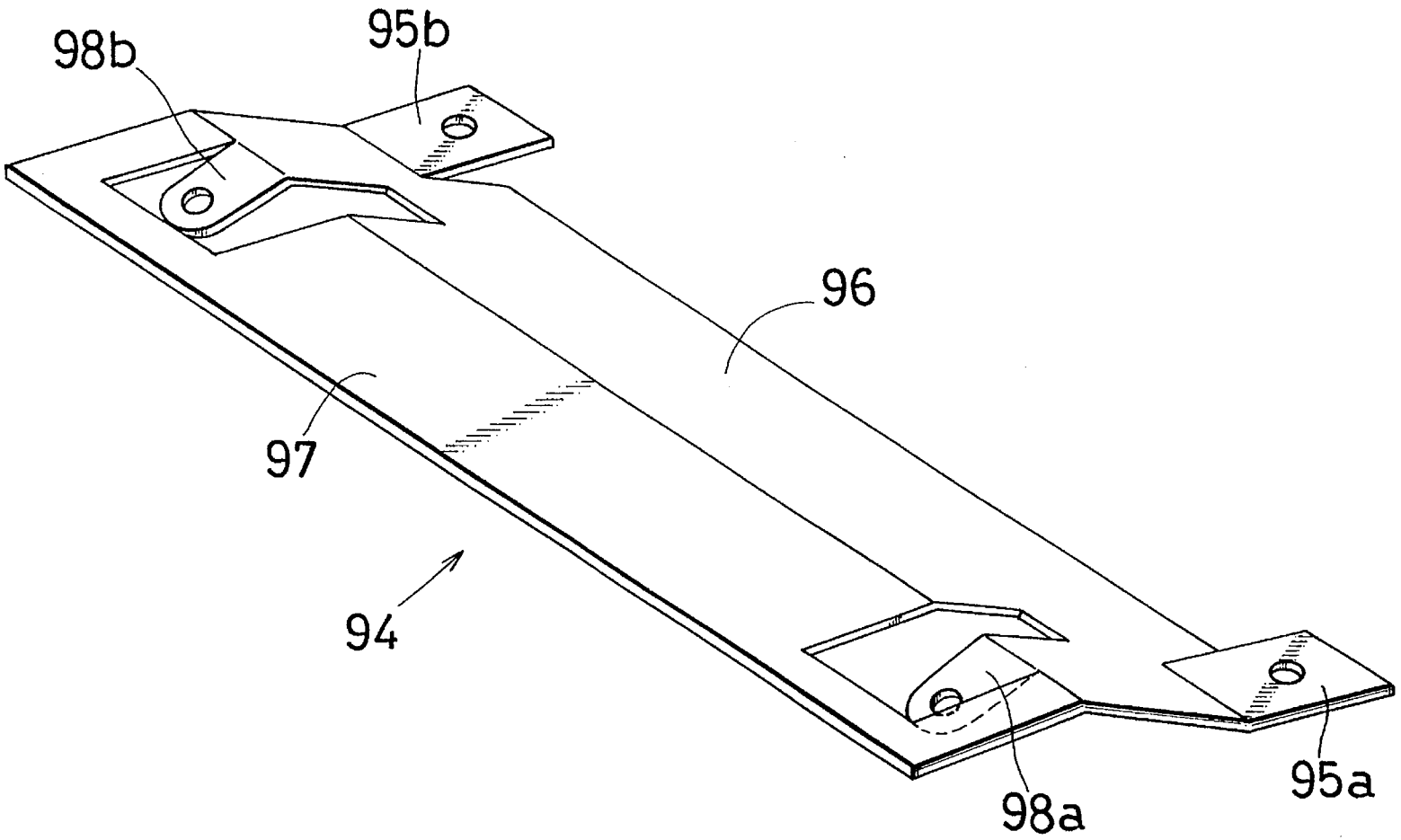
FIG. 6 is a perspective view of a mounting member.
Figure 7:
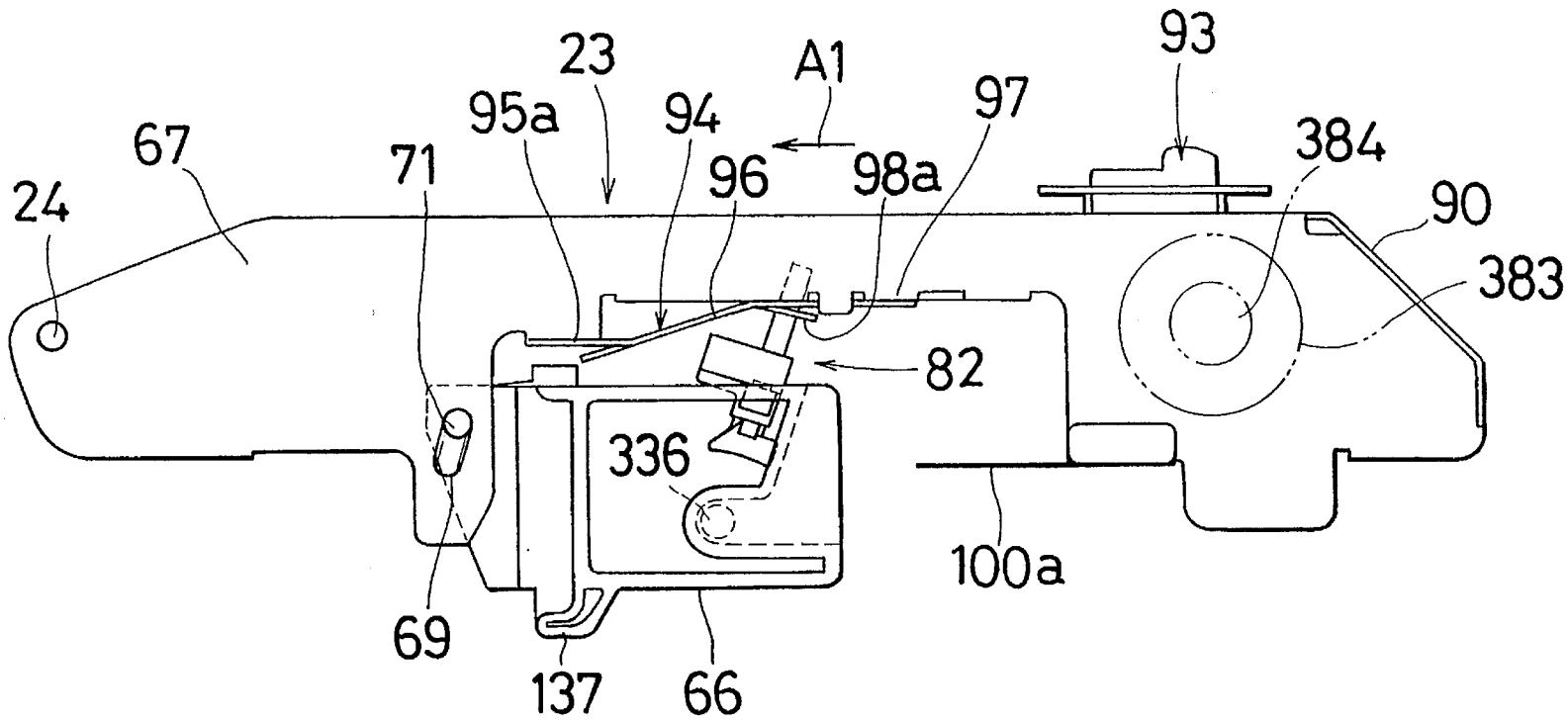
FIG. 7 is a front view of the upper housing.
Figure 8:
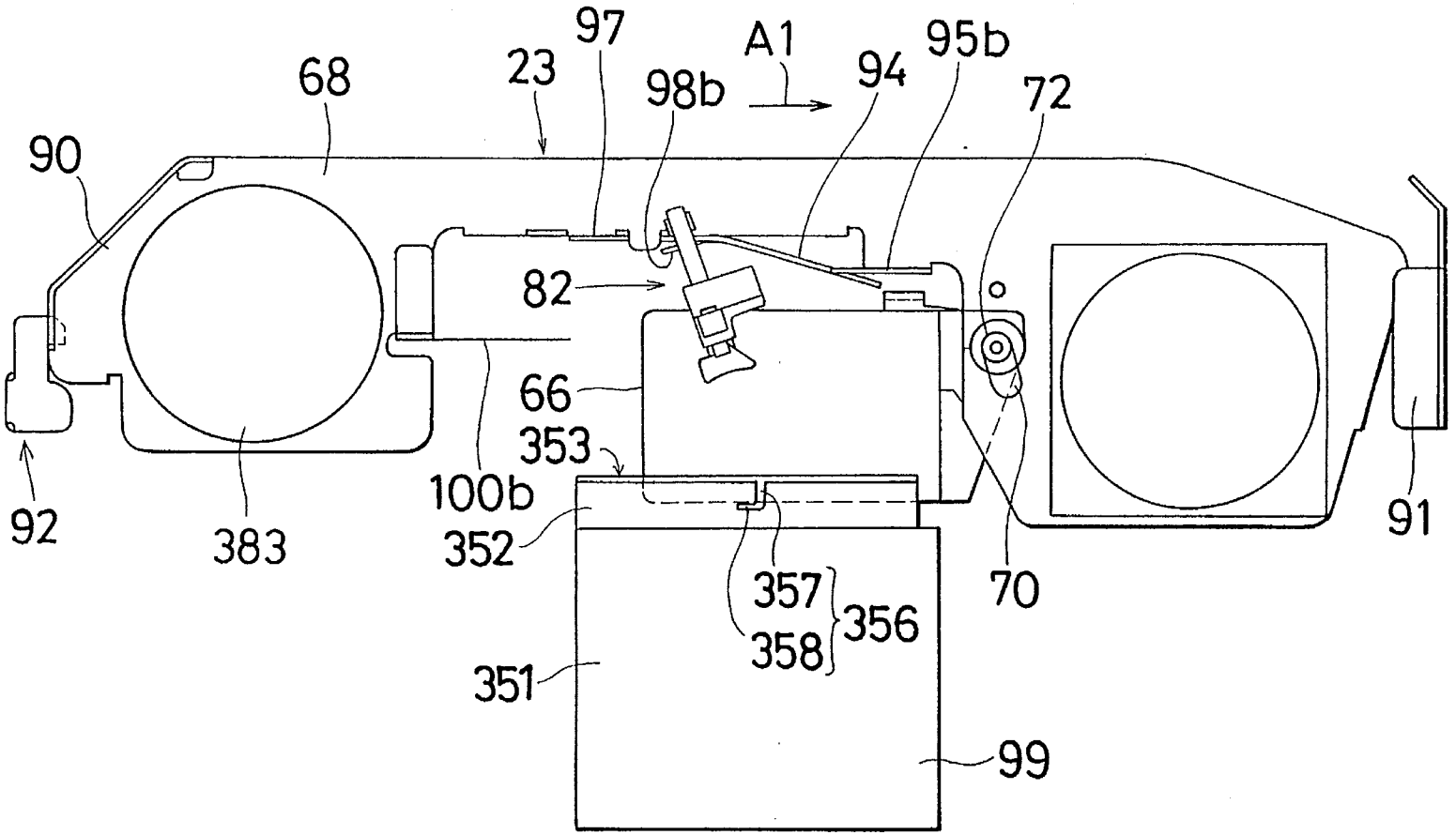
FIG. 8 is a rear view of the upper housing.

FIG. 5 is a plan view of the upper housing 23, FIG. 6 is a perspective view of a mounting member 94, FIG. 7 is a front view of the upper housing 23, and FIG. 8 is a rear view of the upper housing 23. As shown in FIGS. 5 to 8, the upper housing 23 includes, side frames 67, 68 having an essentially plate-like shape and installed in parallel to the transporting direction A1, and a front end frame 90 and the mounting member 94 respectively interconnecting the side frames 67, 68 at the upstream end and at the center of the transporting direction A1. Near the upper end of the lower housing 22 directly below the front end frame 90, there is provided a lock mechanism 92 that has the structure described later and that is used for locking and unlocking the upper housing 23 to and from the lower housing 22. A lock release member 93 for releasing the lock mechanism 92 from the lock position hereinafter described is installed on the side frame 67 of the upper housing 23 in slidable fashion along directions parallel to the transporting direction A1.

The mounting member 94 mounts the LED array 82 on the upper housing 23 and is secured to the side frames 67, 68 at approximately the center position of the upper housing 23 across the transporting direction A1. The mounting member 94 is formed from an essentially rectangular plate bent in opposite directions at two places along the transporting direction A1. Mounting member 94 and includes mounting portions 95*a*, 95*b* attached, e.g. by bolts to the side frames 67, 68, a sloping or inclined portion 96 sloping upward from the mounting portions 95*a*, 95*b* toward the upstream side of the transporting direction A1, a mounting portion 97 extending from the upper end of the sloping portion 96 and in parallel to the transporting direction A1 and attached, e.g. by bolts to the side frames 67, 68 and support portions 98*a*, 98*b*, formed near the widthwise ends of the sloping portion 96 by cutting portions of the mounting portion 97 and bending them slightly downward in the direction opposite to the transporting direction A1, for supporting the LED array 82 in a slightly swingable fashion.

The elongated holes 69, 70 slanting from the upper side to the lower side of FIGS. 7 and 8 along the transporting direction A1 are respectively formed in the side frames 67, 68 of the upper housing 23. The support shafts 71, 72 formed on the support member 66 are fitted through the elongated holes 69, 70 from inside the side frames 67, 68 to mount the support member 66 in position. That is, the support member 66, when mounted, is swingable at the support shafts 71, 72 and is movable along the longitudinal direction of the elongated holes 69, 70. On the rear side of the support member 66 as viewed in FIG. 4, that is, on the upper end thereof as viewed in FIG. 5, a waste toner box 99 for collecting waste toner discharged from the process cartridge 73 installed on the support member 66 is mounted detachably, as described later. Upstream of the support member 66 in the upper housing 23 are engaging pieces 100*a*, 100*b* that are secured at first ends thereof to the side frames 67, 68, respectively, the other ends of the engaging pieces 100*a*, 100*b* extending downstream in the transporting direction A1.

(3) Description of the lower housing 22

Figure 9:
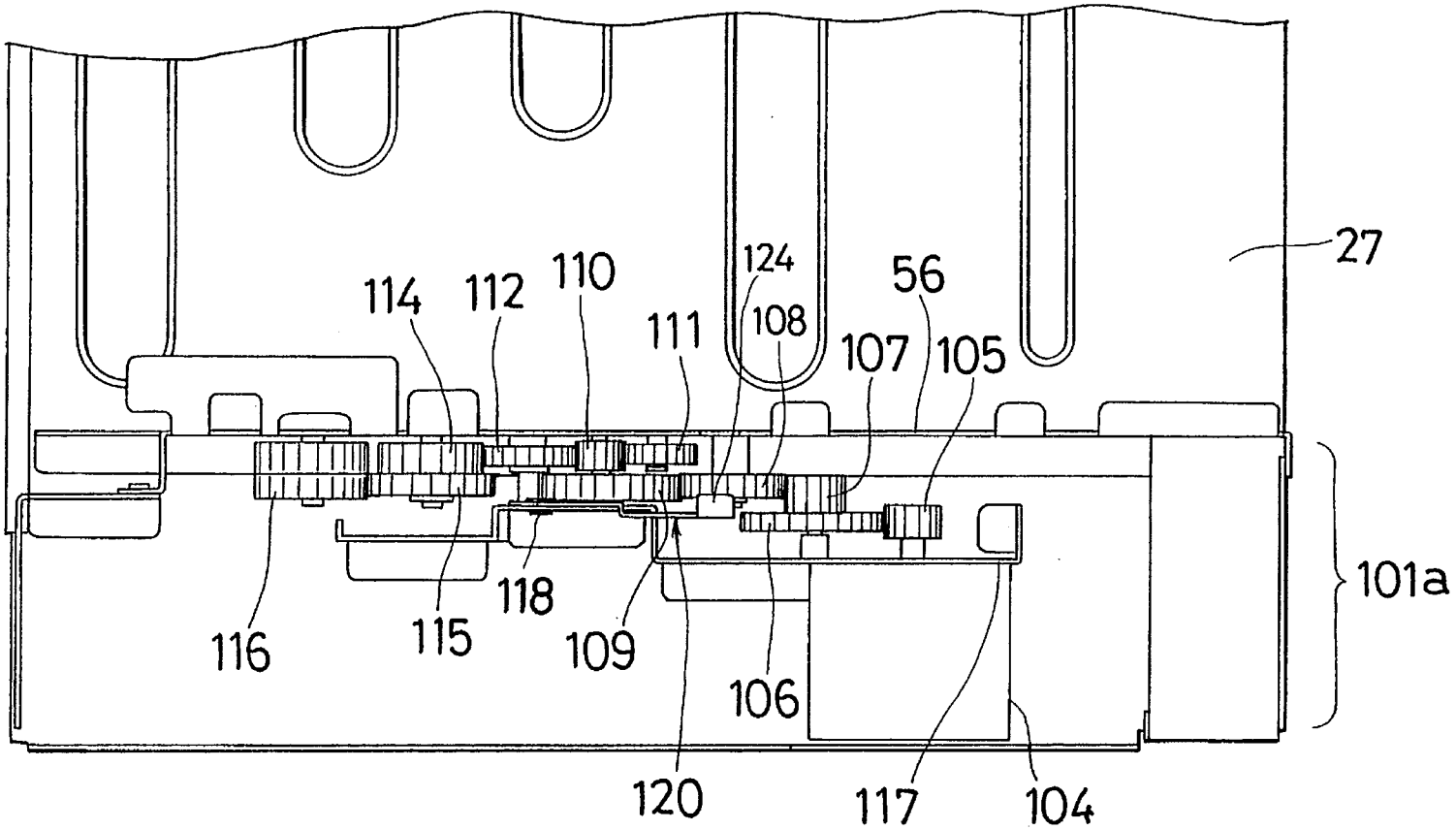
FIG. 9 is a plan view showing a portion of the lower housing.
Figure 10:
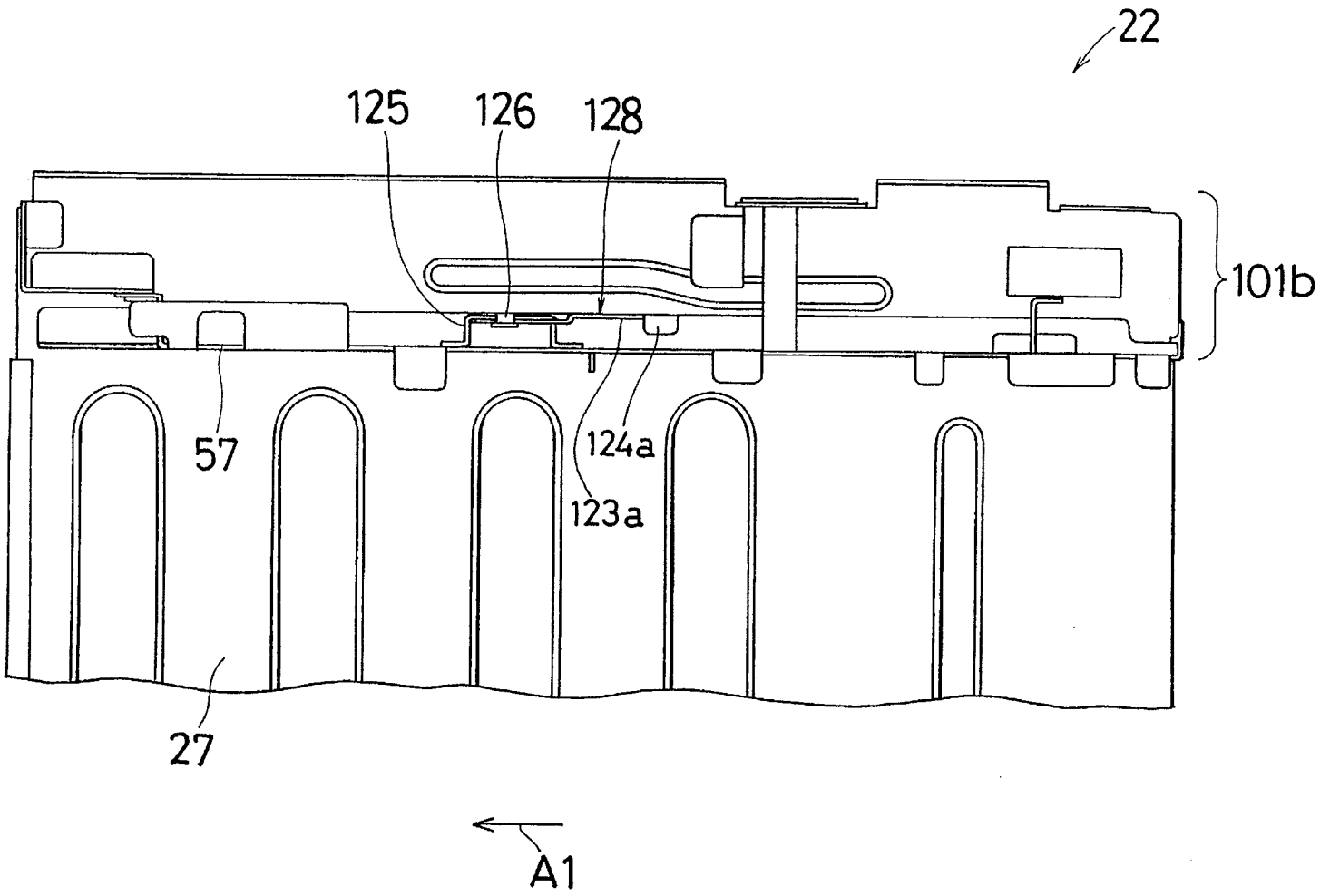
FIG. 10 is a plan view showing another portion of the lower housing.
Figure 11:
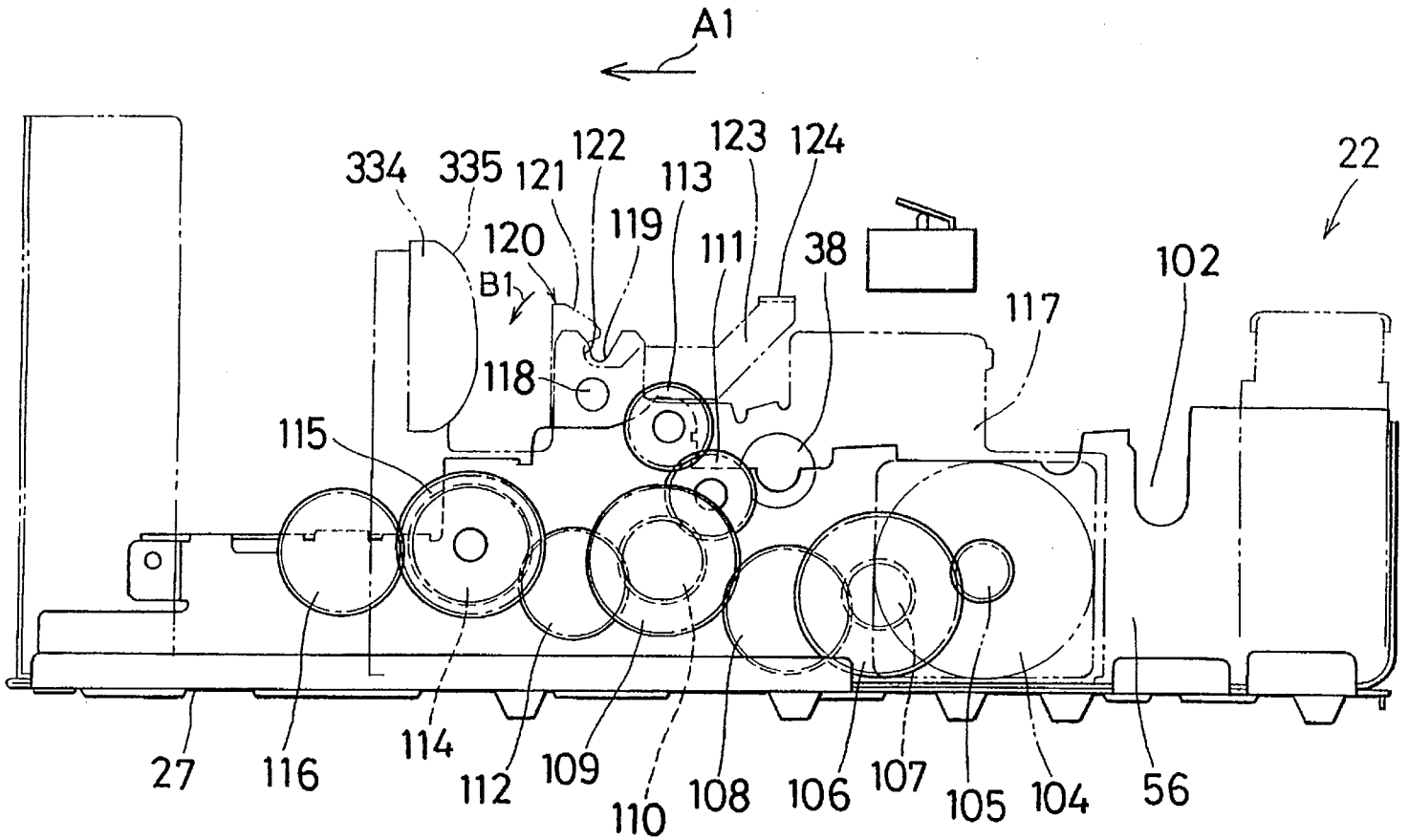
FIG. 11 is a front view of the lower housing.
Figure 12:
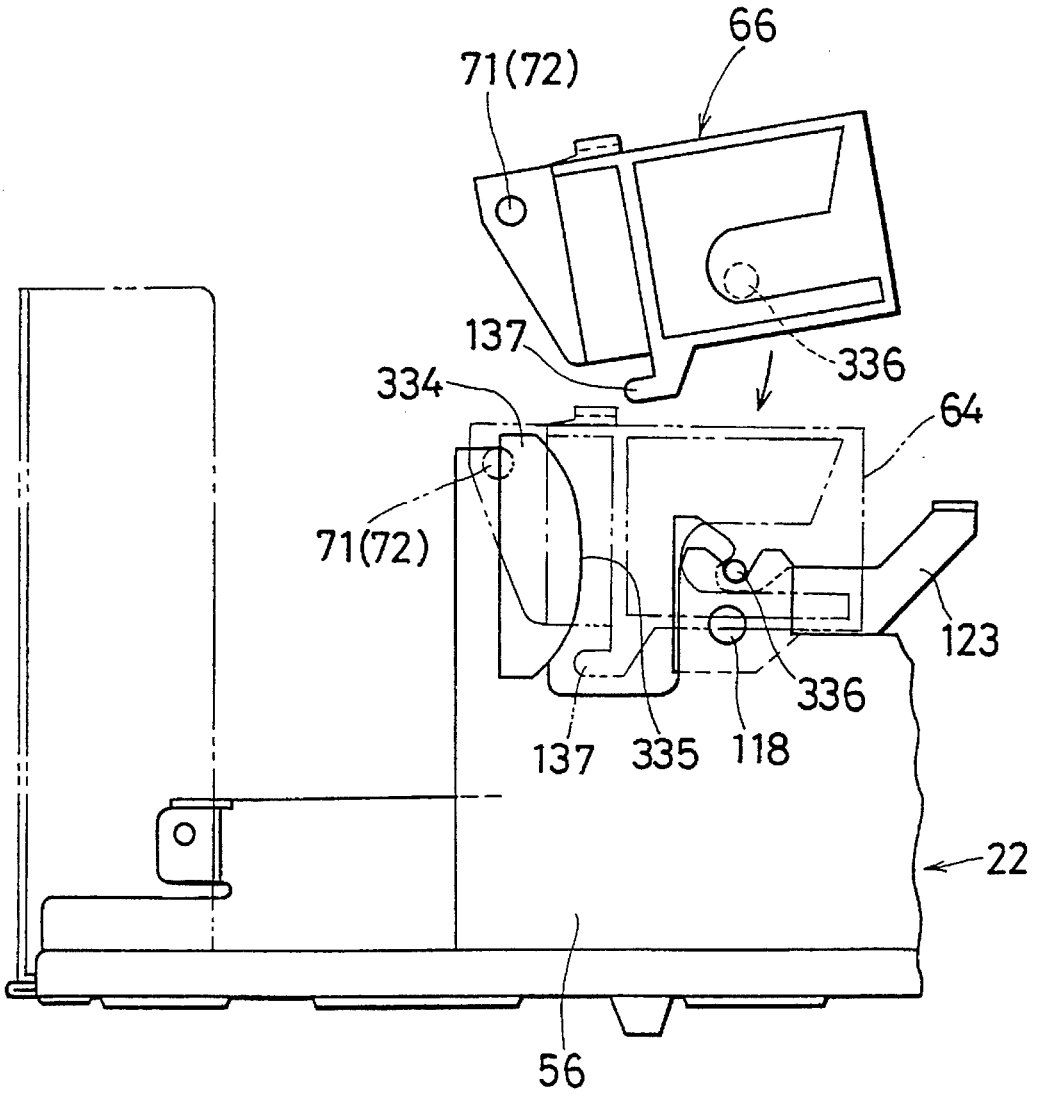
FIG. 12 is a front view showing how a support member is mounted.
Figure 13:
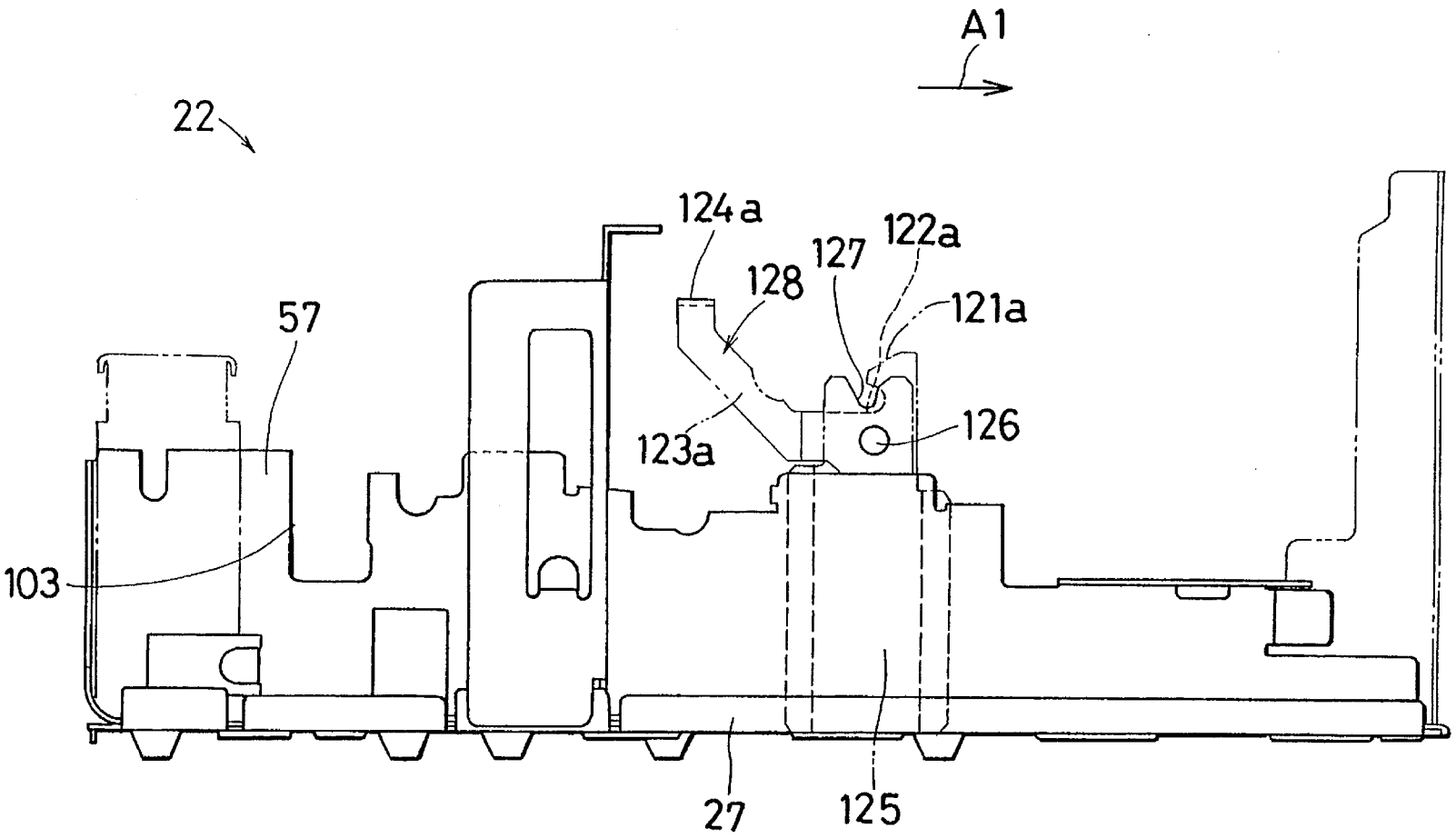
FIG. 13 is a rear view of the lower housing.

FIG. 9 is a plan view showing a portion of the lower housing 22 on the front side of the plane of FIG. 4, FIG. 10 is a plan view showing a portion of the lower housing 22 on the rear side of the plane of FIG. 4, FIG. 11 is a front view of the lower housing 22, and FIG. 12 is a front view showing how the support member 66 is mounted. FIG. 13 is a rear view of the lower housing 22. In the lower housing 22, side frames 56, 57 are secured to an essentially rectangular partition plate 27 with predetermined spacing provided from the respective sides of the partition plate 27 in the width direction thereof. The spacings between the side frames 56, 57 and the respective sides of the partition plate 27 are formed as mounting portions 101*a*, 101*b* where gears for transmitting power to the photoconductor drum 77, etc. and various electric circuit elements for controlling the LED printer 21 are mounted.

In an upstream portion of the side frame 56, there is formed an engaging hole 102 that is open upwardly for mounting the paper feed roller 30. The side frame 57 has an engaging hole 103 formed at a position corresponding to the engaging hole 102. A motor 104 for supplying power to various rollers in the LED printer 21 is mounted on the mounting portion 101*a* at a position downstream of the engaging hole 102.

A gear 105 is mounted on the rotation shaft of the motor 104. The gear 105 engages with a gear 106 which is the larger diameter gear of the two gears 106 and 107 fixed to a common shaft. The smaller diameter gear 107 fixed to the common shaft engages with another gear 108. The gear 108 engages with a gear 109 which is the larger diameter gear of the two gears 109 and 110 fixed to a common shaft. The smaller diameter gear 110 engages with gears 111 and 112. The rotation of the gear 111 is transmitted to the resist roller 38 via a clutch mechanism 216 shown in FIG. 26, as described later, as well as to the photoconductor drum 77 via a gear 113. On the other hand, the rotation of the gear 112 is transmitted to a gear 114 which is the smaller diameter gear of the two gears 114 and 115 fixed to a common shaft. The larger diameter gear 115 transmits the rotation to the pressure roller 48 in the fixing device 46 via a gear 116.

A mounting plate 117 running parallel to the side frame 56 is installed in upright position on the mounting portion 101*a* of the partition plate 27. A shaft 118 is mounted to the mounting plate 117 at a predetermined position with respect to the transporting direction A1 and at a predetermined height from the partition plate 27. Formed above the shaft 118 is a positioning groove 119 recessed downward. A plate-like lock piece 120 is mounted rotatably on the shaft 118, The lock piece 120 has a sloping portion 121, formed upwardly of the shaft 118, sloping downward in the direction opposite to the transporting direction A1. The sloping portion 121 is provided at its upstream end with a U-shaped clearance recess 122 recessed toward the downstream side of the transporting direction A1. The lock piece 120 also has a connecting portion 123 sloping upward in the direction opposite to the transporting direction A1. The upstream end portion of the connecting portion 123 is bent inwardly along the width direction of the lower housing 22, thus forming a plate-like stop piece 124 parallel to the horizontal plane.

As shown in FIGS. 10 and 13, an outwardly protruding support plate 125 is attached to the outer side of the side frame 57, i.e., on the upper side of the side frame 57 as viewed in FIG. 10. In the upper end portion of the support plate 125 is mounted a shaft 125 at a position opposite from the shaft 118 mounted to the mounting plate 117. A U-shaped positioning groove 127 is formed above the shaft 126 at a position opposite from the positioning groove 119. A lock piece 128 symmetrical in shape to the lock piece 120 in the mounting plate 117 is mounted rotatably on the shaft 126. The portions of the lock piece 128 corresponding to the portions of the lock piece 120 are designated by the same reference numerals 121-124 with a suffix "a".

Downstream of the positioning groove 119 formed in the mounting plate 117, a guide member 334 is secured to a position at a predetermined height from the partition plate 27. The guide member 334 has a guide face 335 having an essentially semi-circular shape protruding in the direction opposite to the transporting direction A1.

(4) Description of the support member 66

Figure 14:
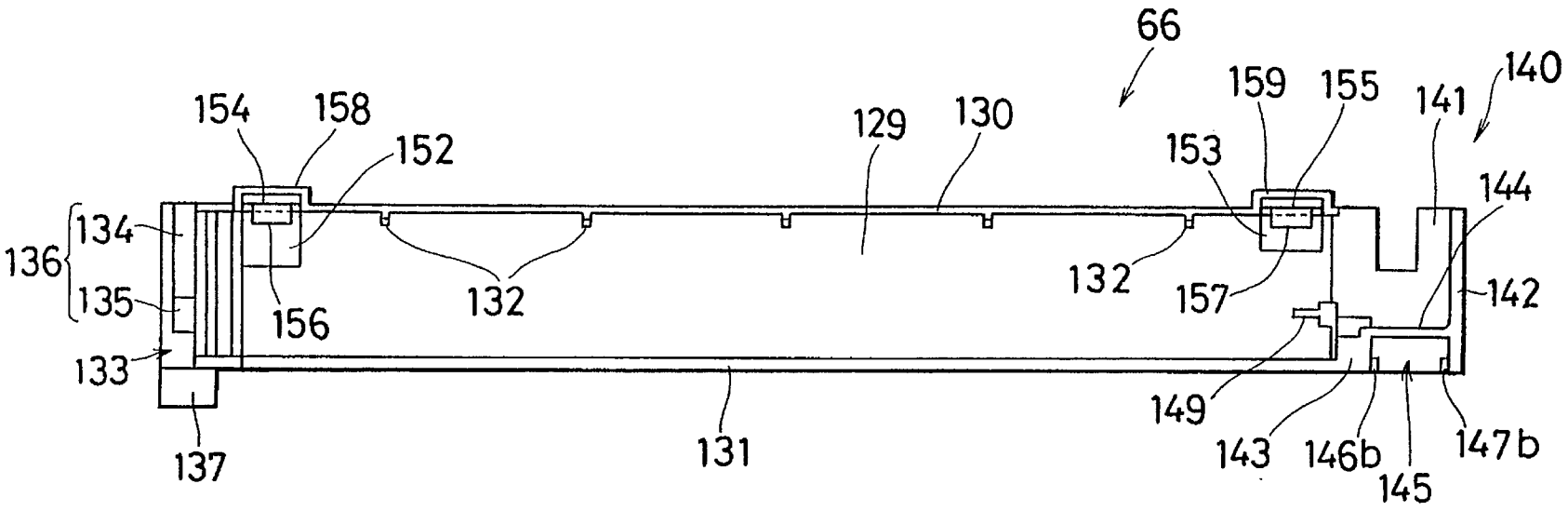
FIG. 14 is a right side view of the support member.
Figure 15:
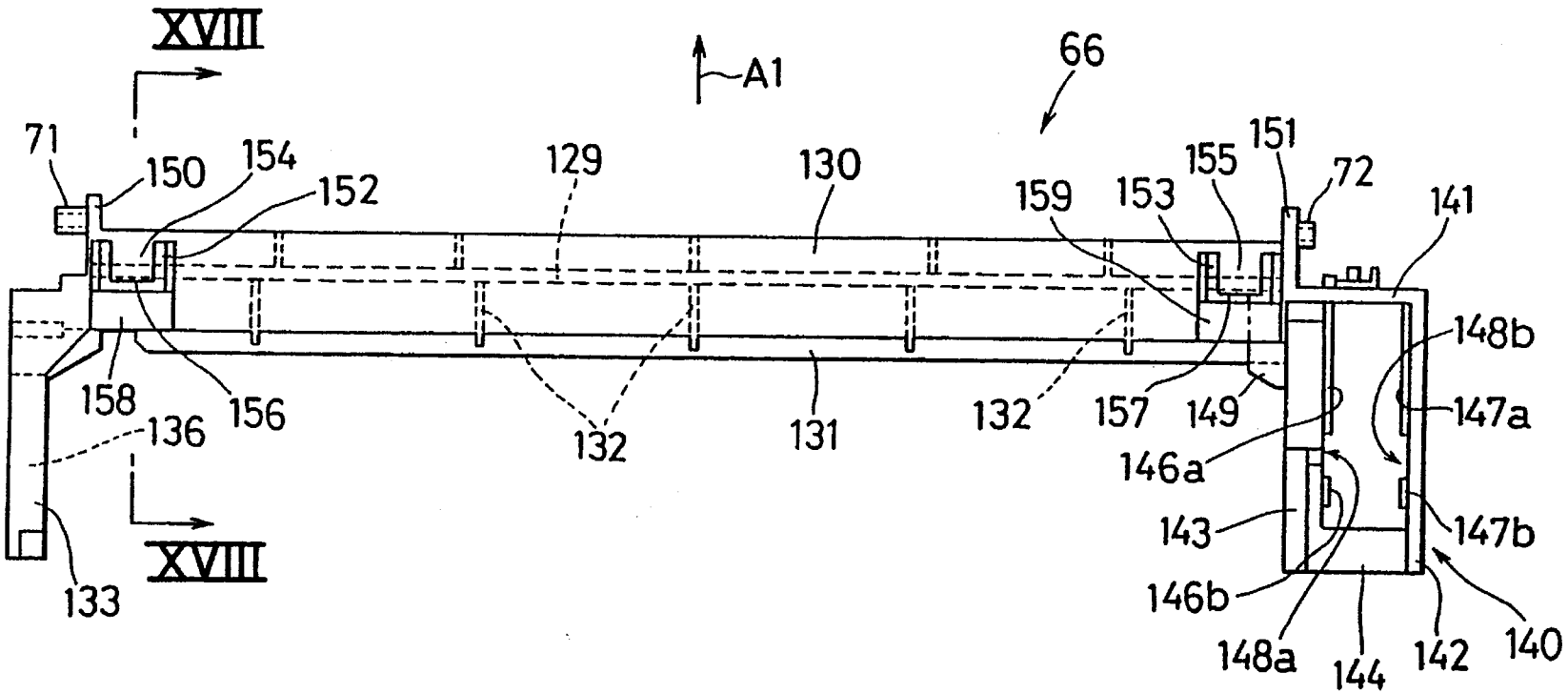
FIG. 15 is a plan view of the support member.
Figure 16:
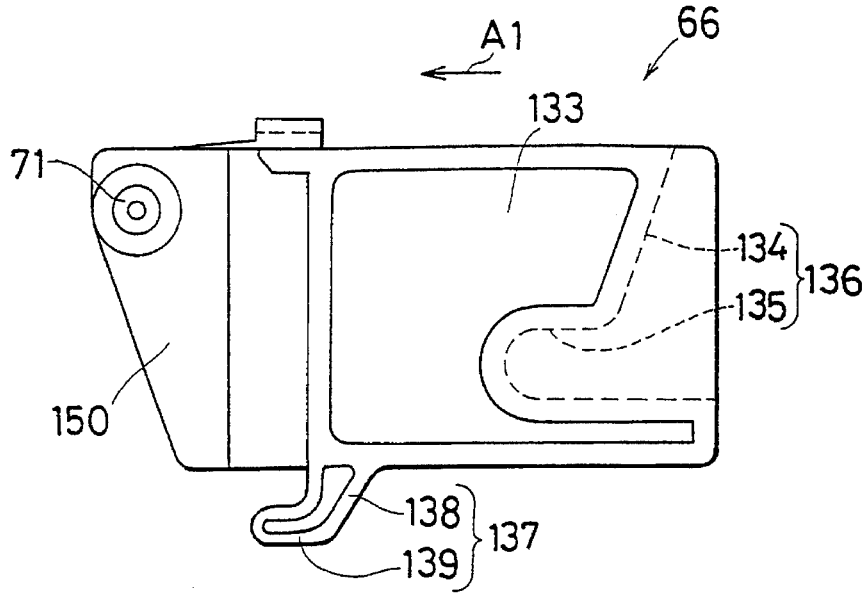
FIG. 16 is a front view of the support member.
Figure 17:
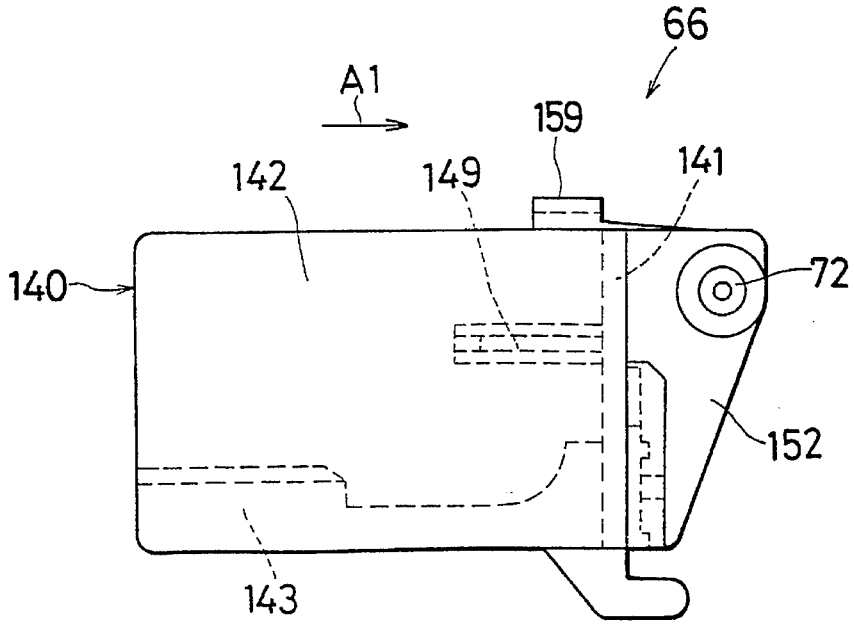
FIG. 17 is a rear view of the support member.
Figure 18:
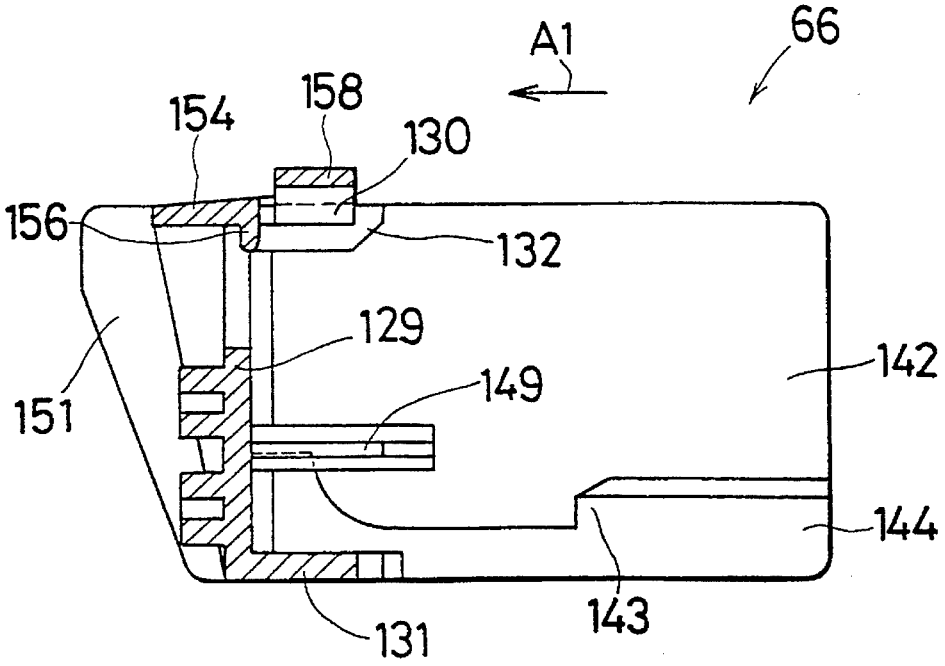
FIG. 18 is a cross sectional view taken along line XVIII—XVIII in FIG. 15.

FIG. 14 is a right side view of the support member 66, FIG. 15 is a plan view of the support member 66, FIG. 16 is a front view of the support member 66, FIG. 17 is a rear view of the support member 66, and FIG. 18 is a cross sectional view taken along line XVIII—XVIII in FIG. 15. The entire construction of the support member 66 is formed from plastic materials and includes a back plate 129 extending longitudinally along the width direction of the upper housing 23 and in a vertical direction and provided at a downstream side of the construction, and an upper plate 130 and a lower plate 131 respectively extending from the upper and lower sides of the back plate 129 toward the upstream side of the transporting direction A1. A plurality of guide projections 132 extending parallel to the transporting direction A1 are formed integrally on the underside of the upper plate 130.

At the leftmost end of the back plate 129 as viewed facing FIGS. 14 and 15, there is formed a side plate 133 extending in the direction opposite to the transporting direction A1. A positioning recess 136 is formed in the inside surface of the side plate 133 viewed in the width direction perpendicular to the transporting direction A1. The positioning recess 136 includes a sloping face 134 recessed outwardly in the width direction and sloping downward from the upstream toward the downstream side, and an elongated groove 135 extending from the lower end of the sloping face 134 toward the downstream side of the transporting direction A1. At the lower end of the side plate 133 and near the downstream end thereof, a guide piece 137 extending further downward is formed integrally with the side plate 133. The guide piece 137 comprises a sloping portion 138 sloping downward from the upstream toward the downstream side and a protruding portion 139 extending further downstream in the transporting direction A1 from the end of the sloping portion 138.

Mounted integrally with and extending further rightward from the rightmost end of the back plate 129 of FIG. 15 is a mounting member 140 which is open on the left side in FIG. 15, on the side facing the viewer of FIG. 15, and on the side facing the upstream side of the transporting direction A1. The mounting member 140 comprises a connecting plate 141 extending further rightward from the rightmost end of the back plate 129 of FIGS. 14 and 15, and an elongated side plate 142 extending from the end of the connecting plate 141 toward the upstream side of the transporting direction A1. Furthermore, a connecting portion 143 is formed extending from the rightmost end of the lower plate 131 of FIG. 15 toward the upstream side of the transporting direction A1, and from the end of the connecting portion 143 extends a connecting portion 144 that is connected to the upstream end of the side plate 142. The connecting portion 144 is spaced by a predetermined distance from the lower end of the side plate 142 and the connecting portion 143, i.e, from the lower end of the members shown in FIG. 14, so that a housing space 145 is formed therebetween for housing the upper end portion of the waste toner box shown in FIGS. 5 and 8, as will be described later.

A plurality of projections 146*a*, 146*b* and 147*a*, 147*b*, facing each other, are formed on the lower end portions of the connecting portion 143 and the side frame 142, respectively. Gaps 148*a* and 148*b* are provided between the projections 146*a* and 146*b* and between 147*a* and 147*b*, respectively. A rectangular plate-like guide piece 149 extending in the direction opposite to the transporting direction A1 is formed on the rightmost end portion of the back plate 129 in FIG. 15.

Side plates 150 and 151, respectively, are formed extending downstream from the leftmost and rightmost ends of the back plate in FIG. 15. The aforementioned support shafts 71 and 72 protruding in opposite directions from each other are formed on the side plates 150 and 151, respectively. The support shafts 71 and 72 are respectively fitted into the elongated holes 69 and 70 formed in the side frames 67 and 68 of the upper housing 23.

Throughholes 152 and 153 are respectively formed in the left and right end portions of the upper plate 130 in FIG. 15, and in the respective throughholes 152 and 153 are formed engaging pieces 154 and 155 that extend in the direction opposite to the transporting direction A1. At the free ends of the engaging pieces 154 and 155 are formed engaging pawls 156 and 157 protruding downward as viewed in FIGS. 14 and 18. Protruding portions 158 and 159 are formed upstream of the throughholes 152 and 153 on the side of the upper plate 130 opposite to the side facing the lower plate 131. The engaging pieces 154 and 155 engage the process cartridge 73 when mounting the process cartridge 73 onto the support member 66, as shown in FIG. 1.

(5) Description of the process cartridge 73

Figure 19:
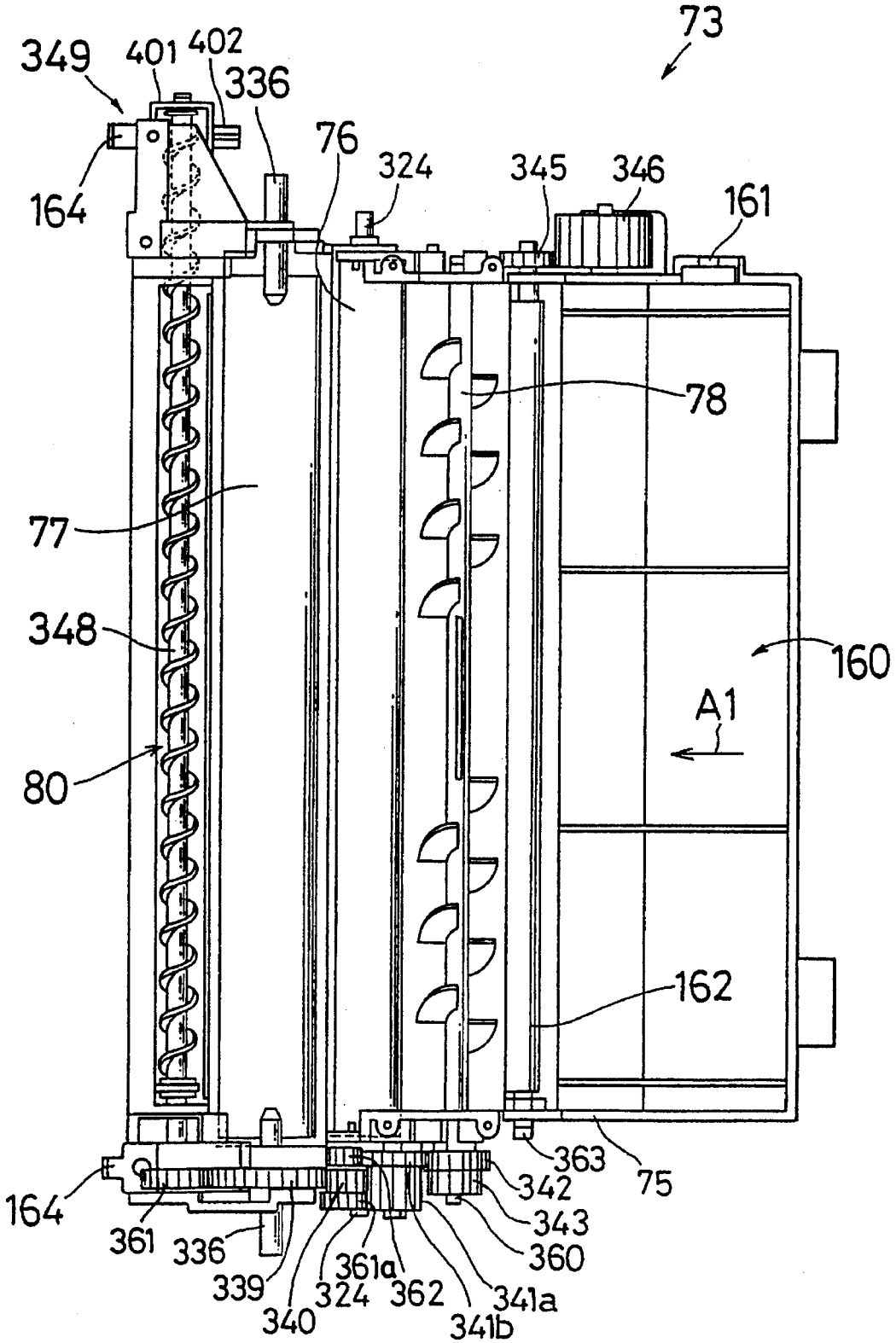
FIG. 19 is a plan view, partly in cross section, of a process cartridge.
Figure 20:
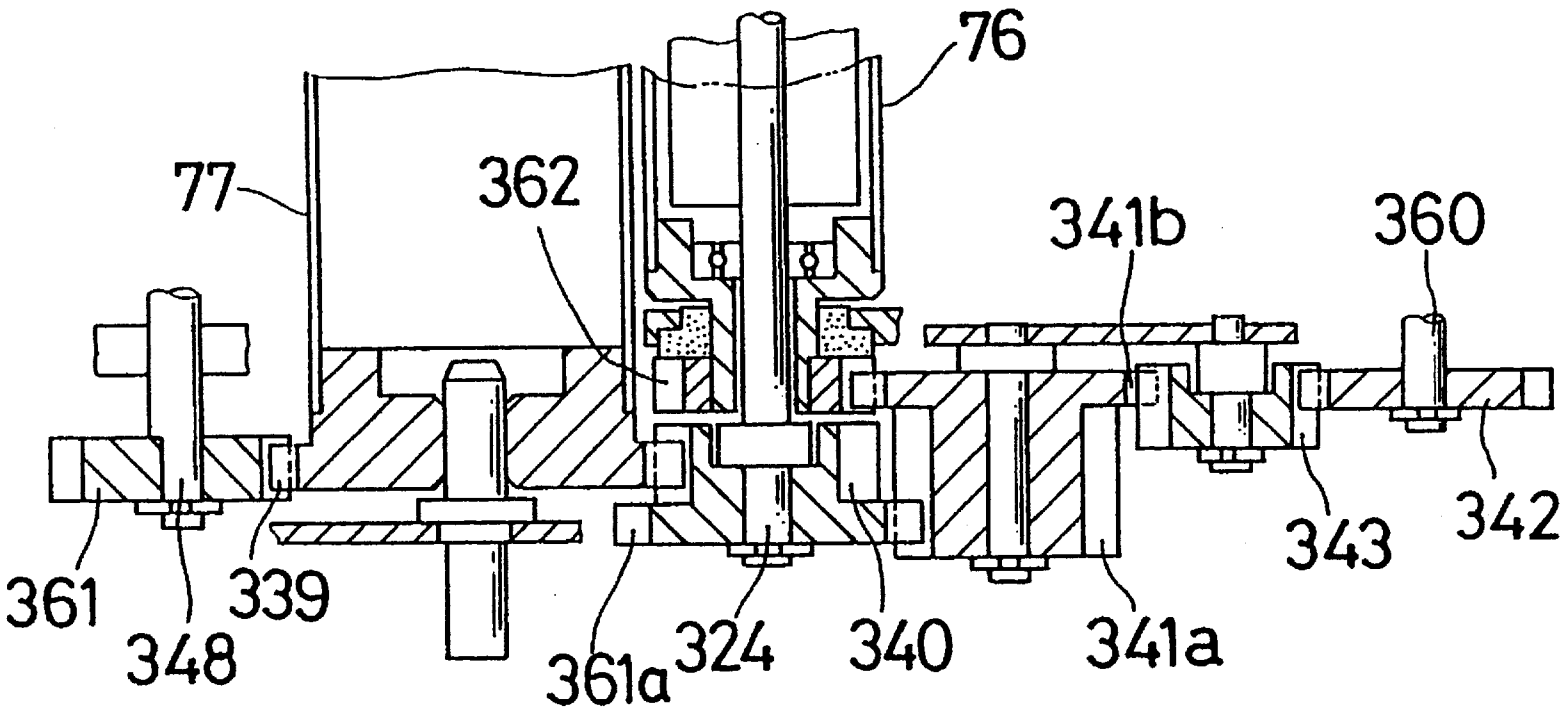
FIG. 20 is a transverse sectional view of a gear train in the process cartridge.
Figure 21:
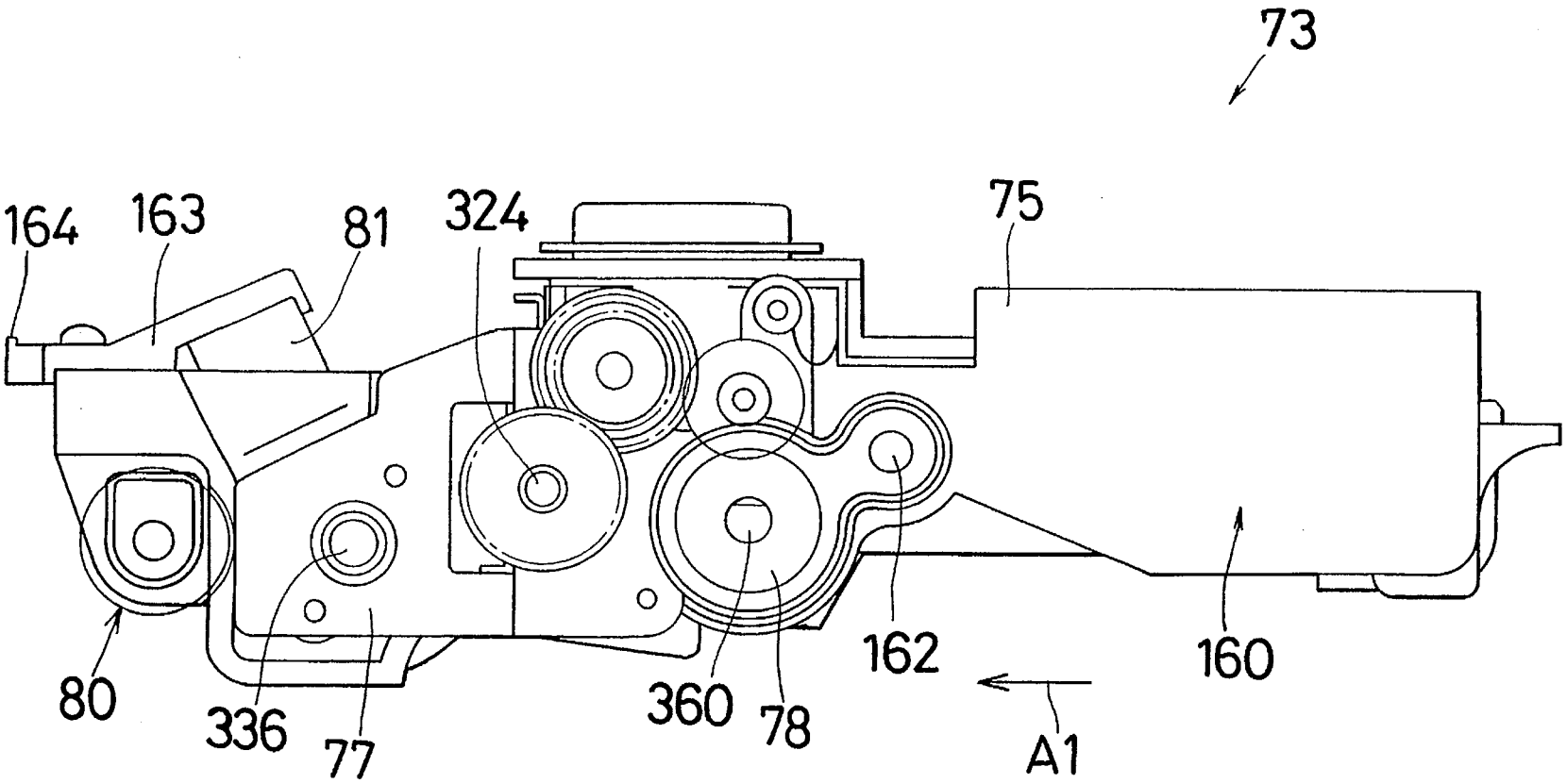
FIG. 21 is a front view of the process cartridge.
Figure 22:
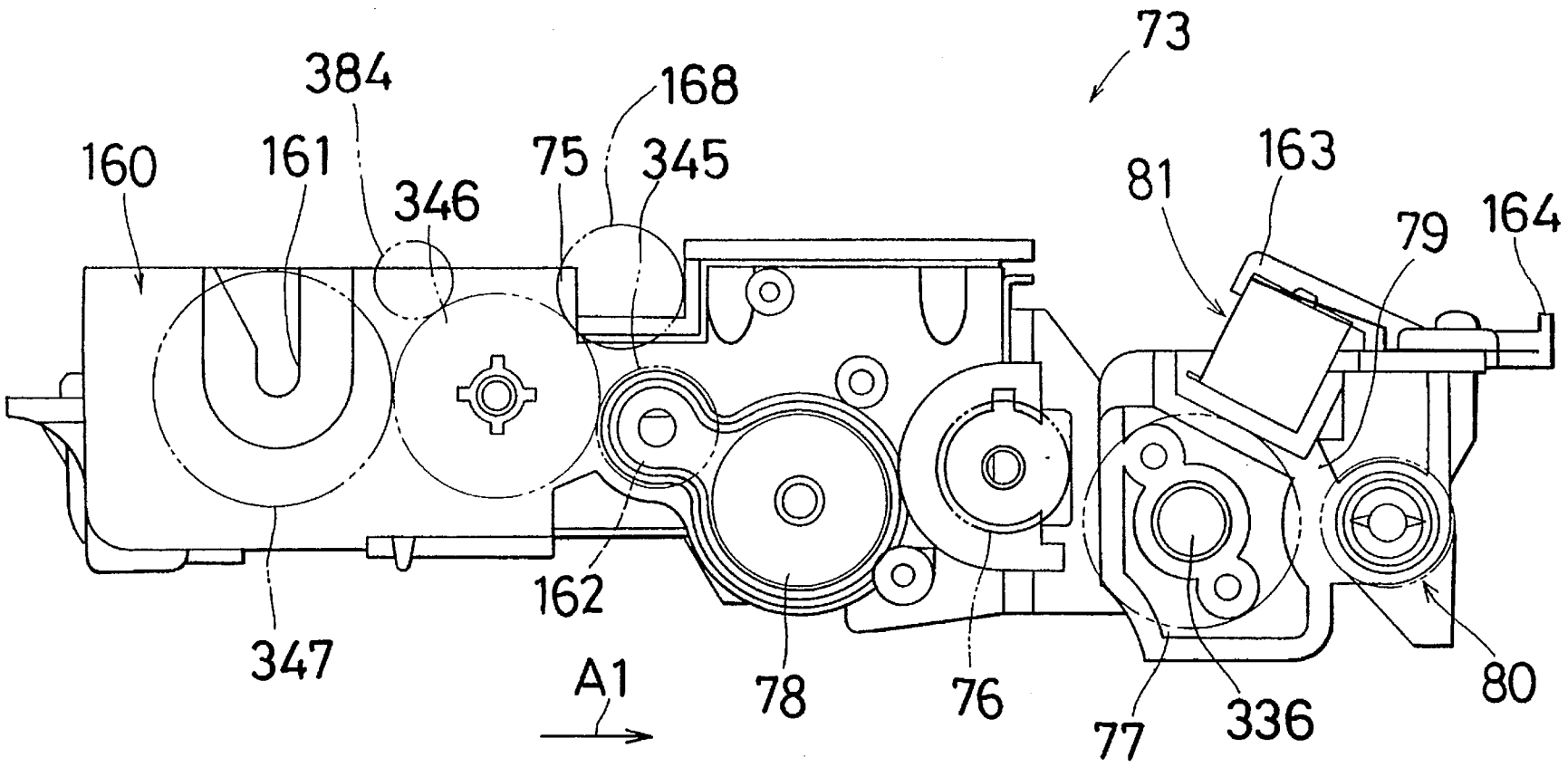
FIG. 22 is a rear view of the process cartridge.
Figure 23:
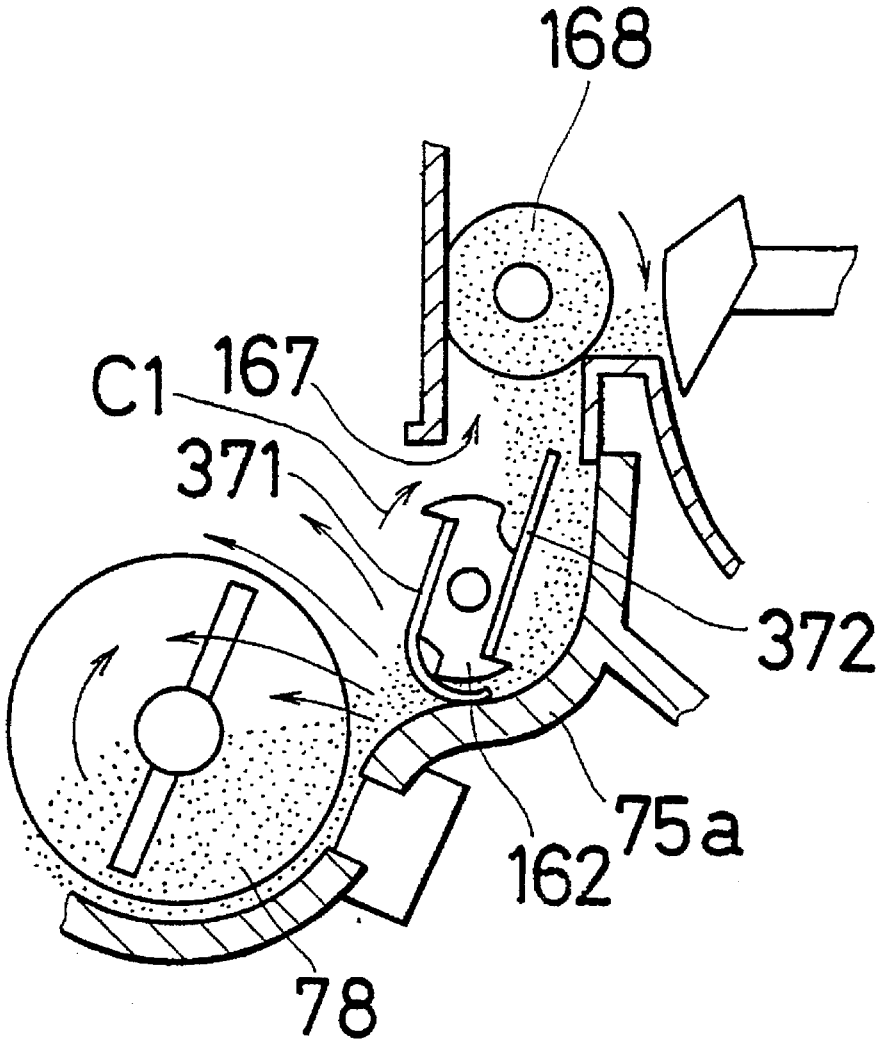
FIG. 23 is an enlarged cross sectional view showing a sub-agitator and its adjacent area in the process cartridge.
Figure 24:
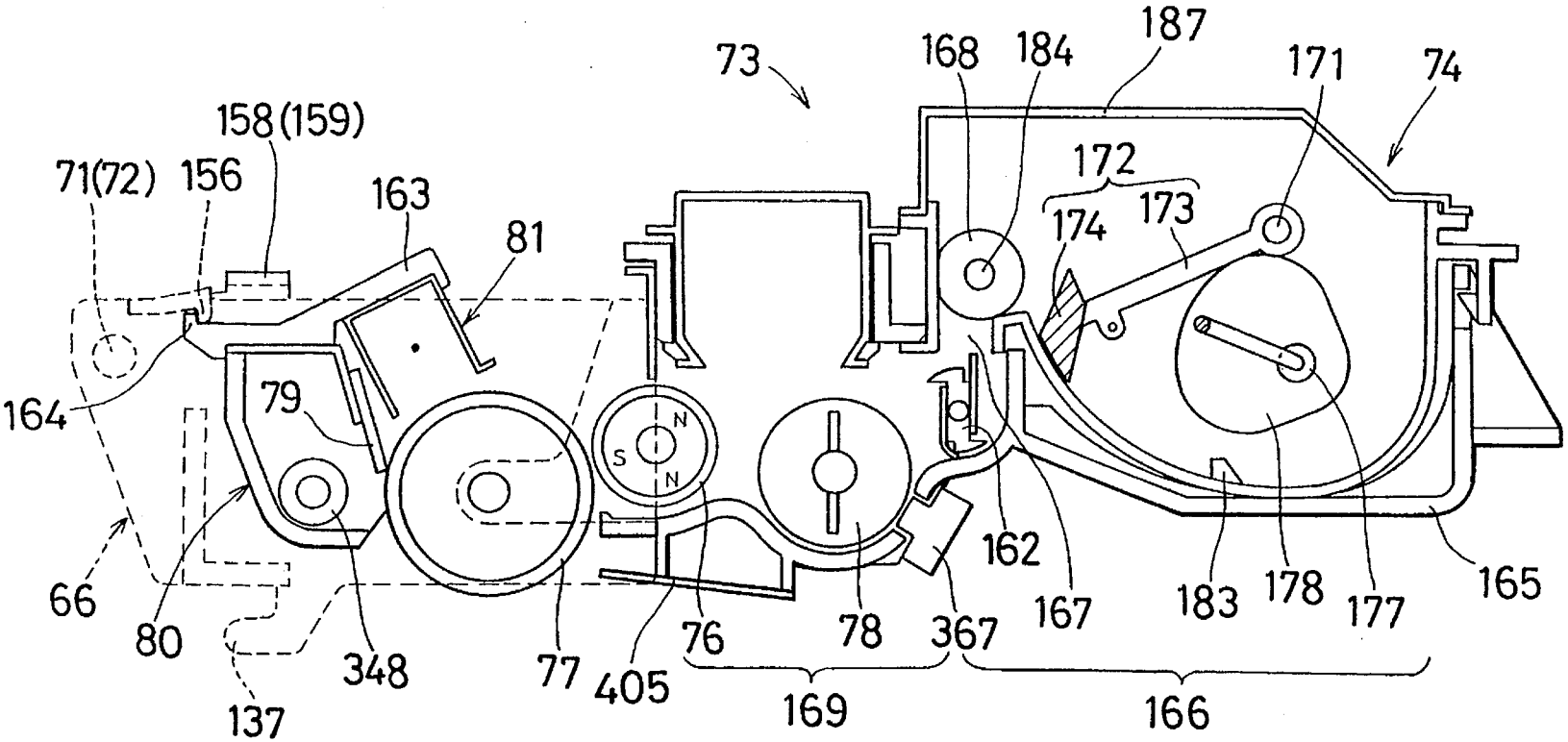
FIG. 24 is a cross sectional view of the process cartridge.

FIG. 19 is a plan view, partly in cross section, of the process cartridge 73, FIG. 20 is a transverse sectional view of a gear train in the process cartridge 73, FIG. 21 is a front view of the process cartridge 73, FIG. 22 is a rear view of the process cartridge 73, FIG. 23 is an enlarged cross sectional view showing a sub-agitator 162 and its adjacent area in the process cartridge 73, and FIG. 24 is a cross-sectional view of the process cartridge 73. The process cartridge 73 has housing 75 that includes a toner box housing section 160 in which the toner box 74 is detachably mounted from above. A cutout 161 opening upward is formed on the rear side of the housing section 160. A sub-agitator 162 for distributing the toner supplied from the toner box 74 shown in FIG. 1 to the agitator 78 is provided on the upstream side of the agitator 78 in the housing 75.

An anchoring member 163 is attached to a position near the downstream end of the housing 75 of the process cartridge 73. Anchoring member 163 anchors the charge unit 81 to the housing 75. Projections 164 projecting upward as shown in FIG. 21 are formed at the downstream end and at both widthwise ends of the anchoring member 163. When mounting the process cartridge 73 onto the support member 66 to form an assembly therewith, the projections 164 engage with the engaging pawls 156 and 157 of the engaging pieces 154, 155 formed on the support member 66, as will be described later, to hold the process cartridge 73 on the support member 66.

A shaft 336 that holds the photoconductor drum 77 for rotation protrudes from the side of the housing 75 nearer to the operator, that is, from the lower side wall of the housing 75 as viewed facing FIG. 19. Rotational force is transmitted from the gear 113 shown in FIG. 11 to a gear 339 which is fixed concentrically with the photoconductor drum 77. The gear 339 engages with a gear 361 fixed concentrically with a screw 348 inside the housing 75, the screw 348 constituting a part of the cleaning device 80. On the other hand, the gear 339 engages with a gear 340 which is the smaller diameter gear of the two gears 340 and 361*a* fixed concentrically on a shaft 324 of the developing roller 76, while the larger diameter gear 361*a* engages with a gear 341*a* which is fixed concentrically with a gear 341*b*. The gear 341*b* engages with a gear 362 fixed concentrically with the developing roller 76, thus transmitting the rotation of the photoconductor drum 77 to the developing roller 76. Further, the gear 341*b* engages with a gear 343 which in turn engages with a gear 342 fixed on a shaft 360 of the agitator 78.

Figure 25:
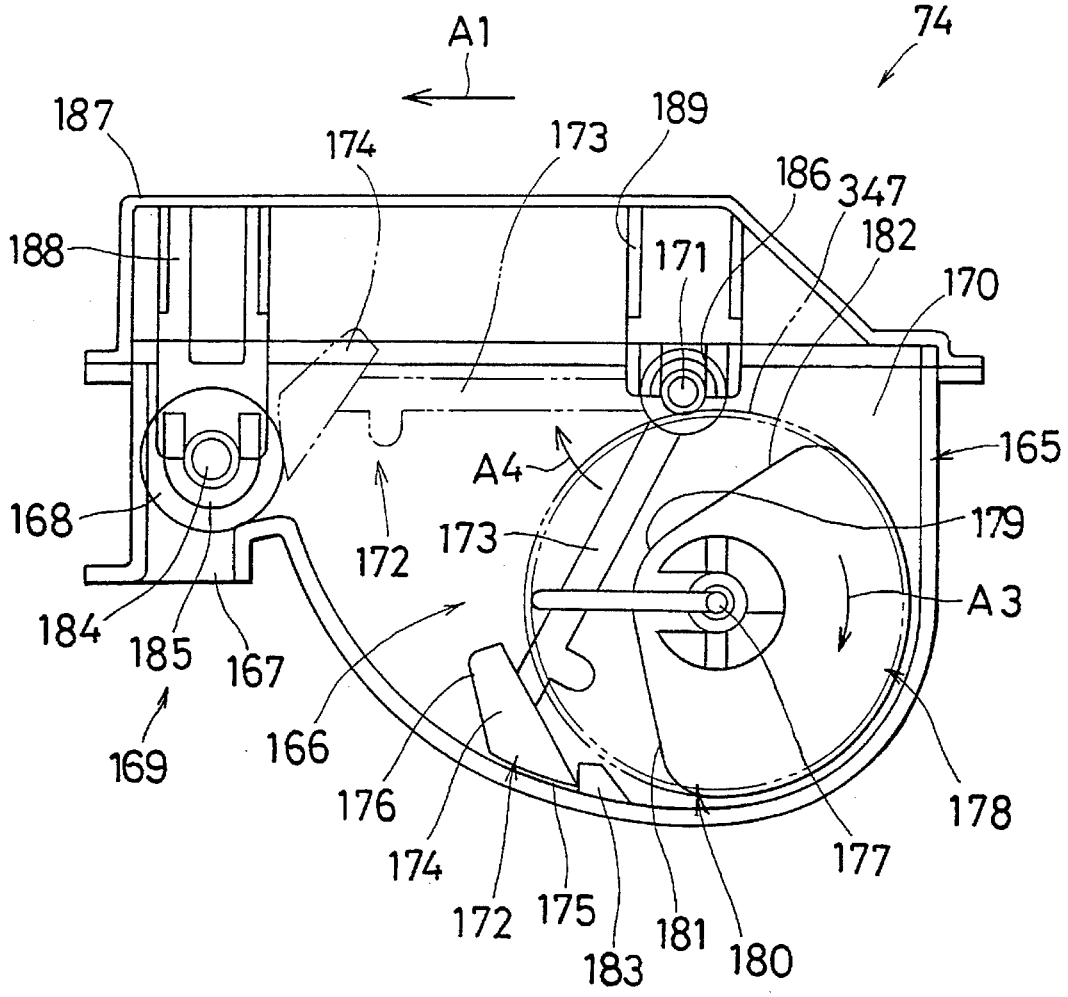
FIG. 25 is a front view showing a toner box 74 in cross section.

The toner box 74, which is housed in the housing section 160 of the process cartridge 73, has the structure shown in FIG. 25. The toner box 74 has a housing 165 that is formed curving downward to match the shape of the housing section 160 of the housing 75 of the process cartridge 73. The housing 165 forms a toner container section 166 with an open top. Communicating with the downstream side of the toner container section 166 is a toner supply port 167 that has an open end facing downward. In a position that blocks the toner supply port 167, there is installed a toner supply roller 168 formed from a porous material such as sponge. The toner supply roller 168 has a shaft 184 extending in parallel to the width direction of the housing. The toner supply port 167 and the toner supply roller 168 together form a toner supply section 169.

In the toner container section 166, a shaft 171 extending between both side walls 170 of the housing 165 is mounted near the upper end of the side walls 170. A toner moving member 172 has an end allowed to move along the inside wall of the toner container section 166 and is mounted swingably on the shaft 171. The toner moving member 172 and the toner supply roller 168 are driven by a toner motor 383 (see FIG. 3) installed in the upper housing 23. The toner moving member 172 consists of a support frame 173 coupled rotatably to the shaft 171 and a toner moving blade 174 fixed to the radially outermost portion of the support frame 173. The radially outermost portion of the toner moving blade 174 is formed in an essentially arced shape to match the shape of the inside wall of the toner container section 166, thus forming a sliding face 175 for scraping toner along the inner circumferential surface of the toner container section 166. The side of the toner moving blade 174 that faces the toner supply roller 158 is formed in a shape sloping in a radially inward direction to form a toner collecting face 176 for collecting toner in the toner container section 166.

Mounted below the shaft 171 and extending between the two side walls 170 is a shaft 177 on which a fan-shaped driving cam 178 is rotatably mounted. The driving cam 178 is rotated with the rotation of the shaft 177 to swing the toner moving member 172 back and forth. The driving cam 178 consists of a small arc section 179 and an arc section 180 that is larger in radius than the small arc section 179 and that is formed in an arc shape not greater than a semi-circle and matching the inner circumferential surface of the toner container section 166. Connecting portions 181 and 182 for connecting the two circumferential ends of the arc section 180 with the small arc section 179 are formed spaced less than 180 degrees apart.

When the driving cam 178 is rotated in the direction of arrow A3, the connecting portion 181 pushes the support frame 173 of the toner moving member 172 so that the toner moving member 172 is moved to a position indicated by two-dot chain lines in FIG. 25. Then, the toner moving member 172 is moved between the position indicated by the two-dot chain lines and the position indicated by the solid lines in FIG. 25. It will also be noted that a stopper piece 183 is provided on the inner circumferential surface of the toner container section 166 at a position corresponding to the position of the toner moving member 172 indicated by the solid lines. The stopper piece 183 works to prevent the toner moving member 172 from moving in further counterclockwise direction as viewed facing FIG. 25.

The toner supply roller 168 is inserted in the housing 165 from above and mounted in position with its ends rotatably supported in U-shaped support pieces 185 formed on the inside surfaces of the side walls 170 of the housing 165. On the other hand, the shaft 171 of the toner moving member 172 is mounted with its ends rotatably supported in cutout portions 186, each having an arced bottom, formed in the upper ends of the side walls 170.

The housing 165 has an open top, which is closed by mounting a cover 187 thereon. The cover 187 is, for example, screwed to the periphery of the housing 165. Support pieces 188 and 189 are formed integrally on the inside surface of the cover 187 at positions that come just above the toner supply roller 168 and the shaft 171, the support pieces 188 and 189 extending downward and having their respective end portions formed in recessed shapes. The recessed portions fit onto the shafts 184 and 171 to hold them in position from above, thereby preventing the shafts from moving off the intended position thereof.

A receiver plate 405 for protecting the process cartridge 73 is provided below the lower side of the process cartridge 73 on the upstream side from where the photoconductor drum 77 is exposed.

(6) Description of a transport device 190

Figure 26:
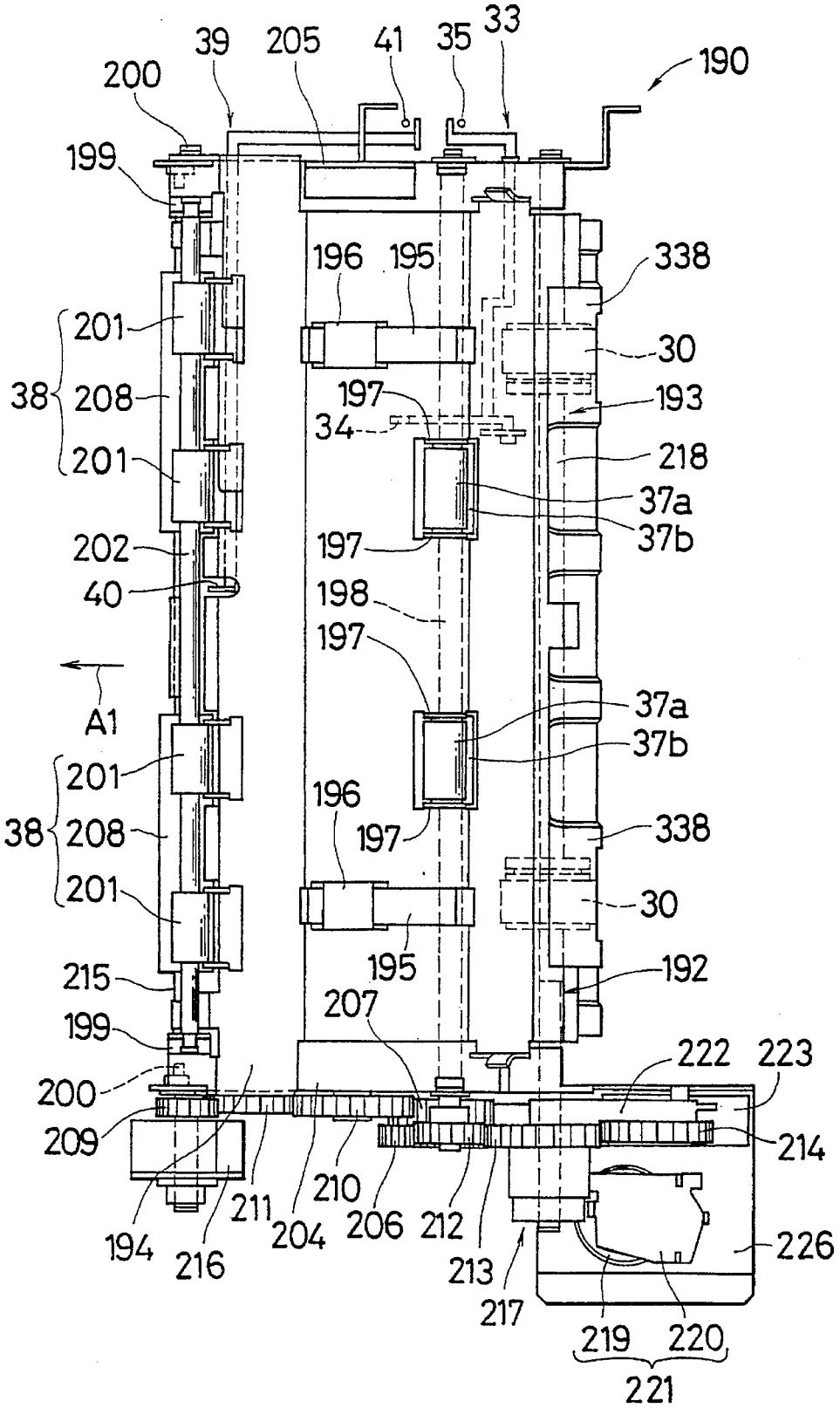
FIG. 26 is a plan view of a transport device.
Figure 27:
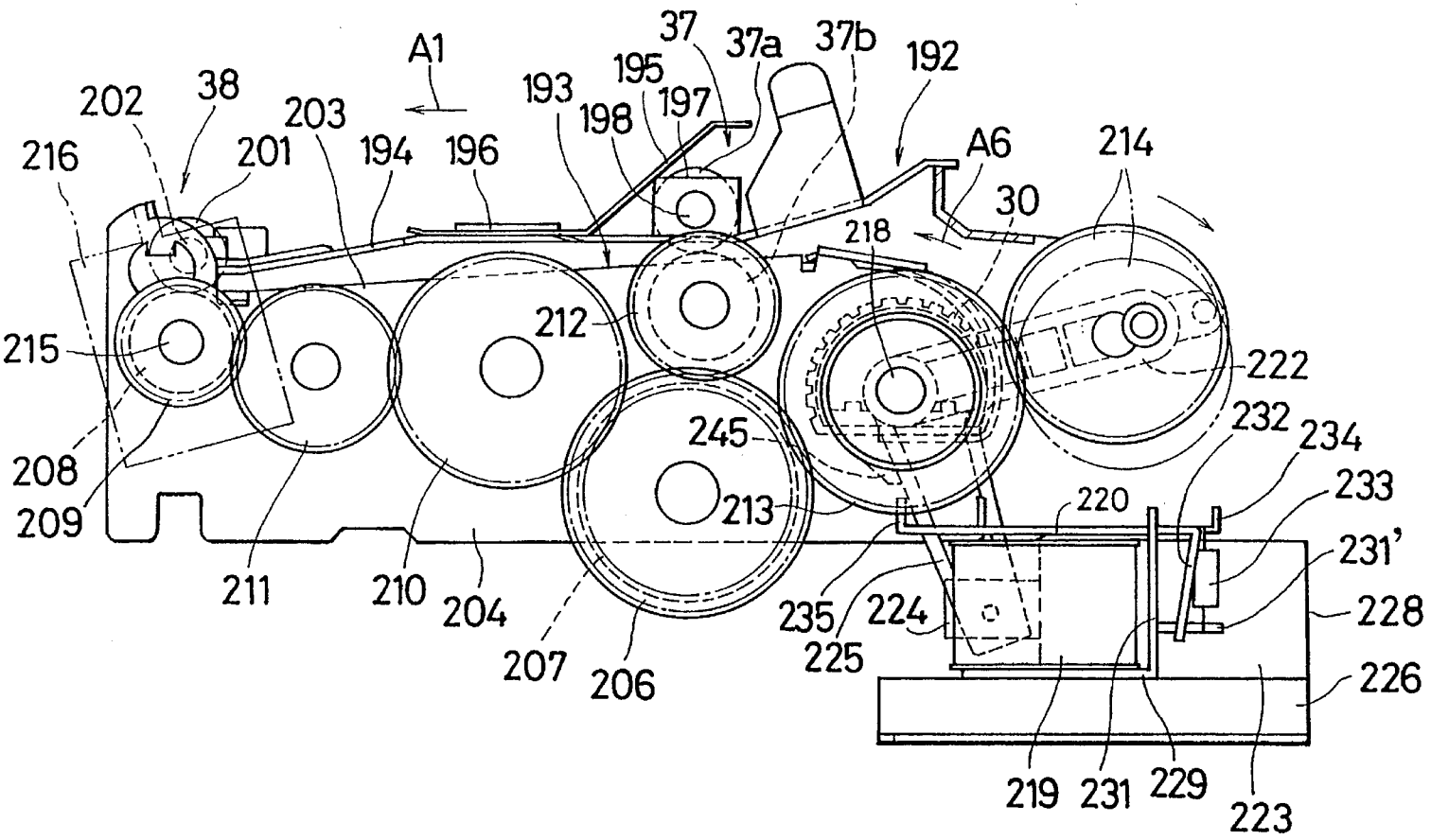
FIG. 27 is a front view of the transport device.
Figure 28:
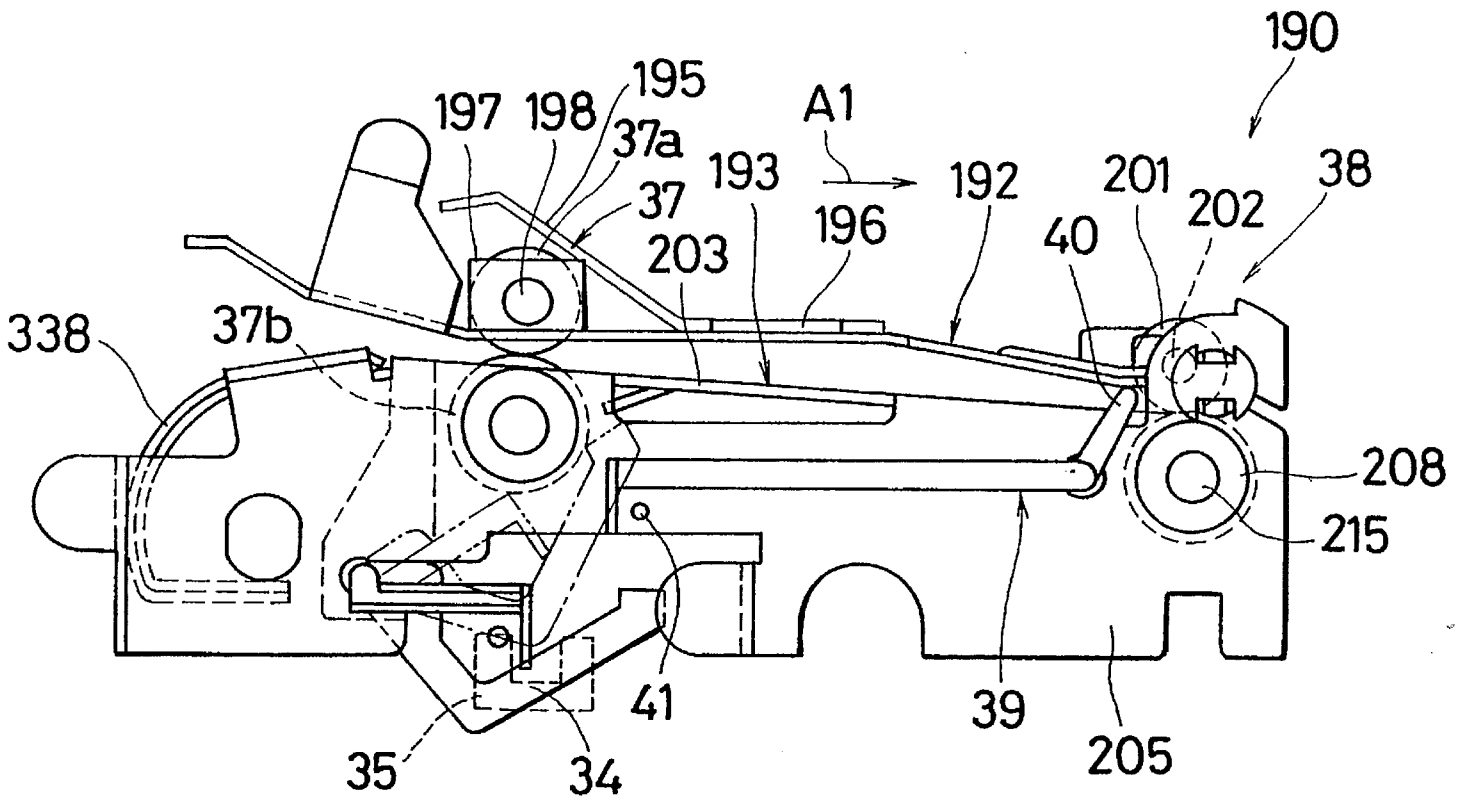
FIG. 28 is a rear view of the transport device.
Figure 29A:
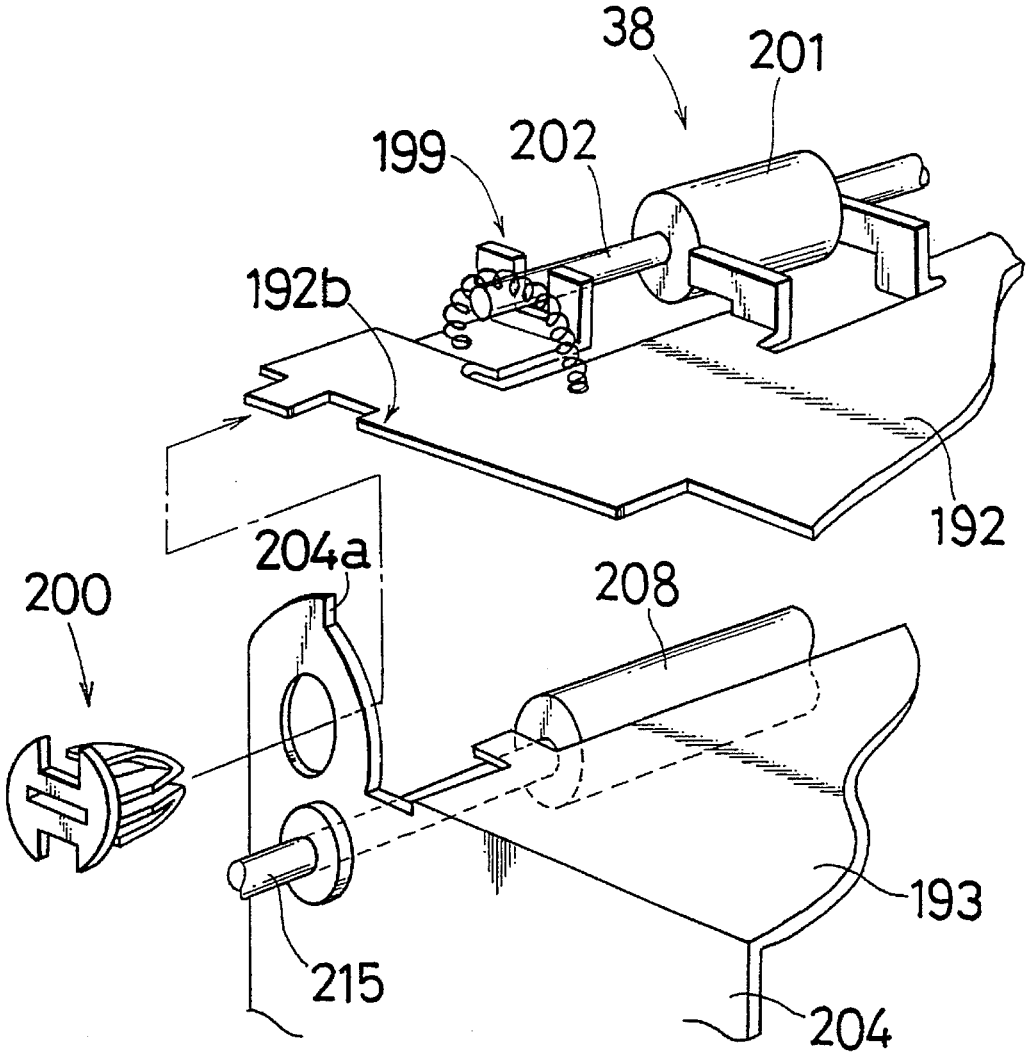
FIG. 29A is an exploded perspective view showing a resist roller and its adjacent area.
Figure 29B:
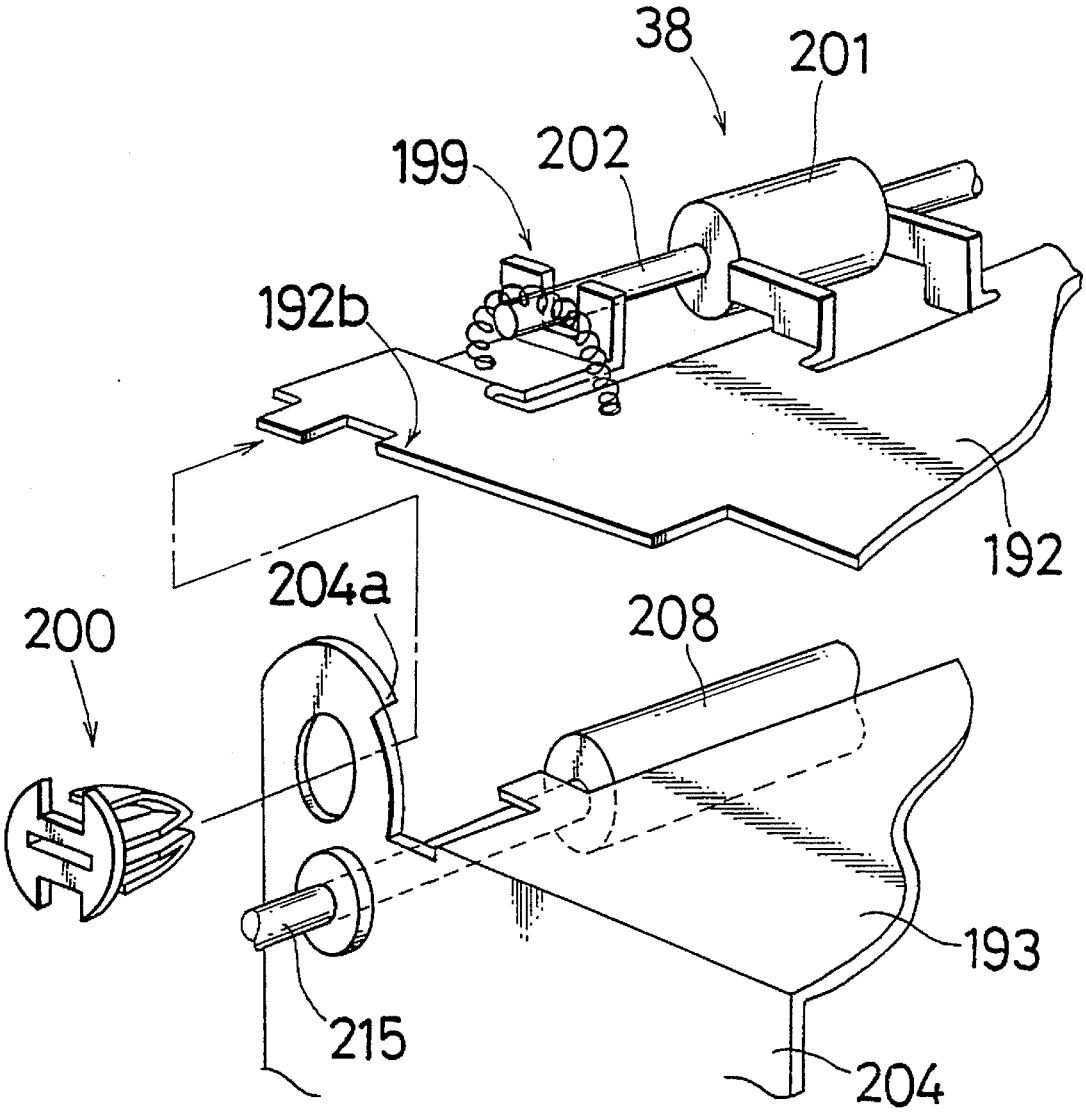
FIG. 29B is an exploded perspective view showing the state where a position of a rotation limiting portion of FIG. 29A is changed.
Figure 30:
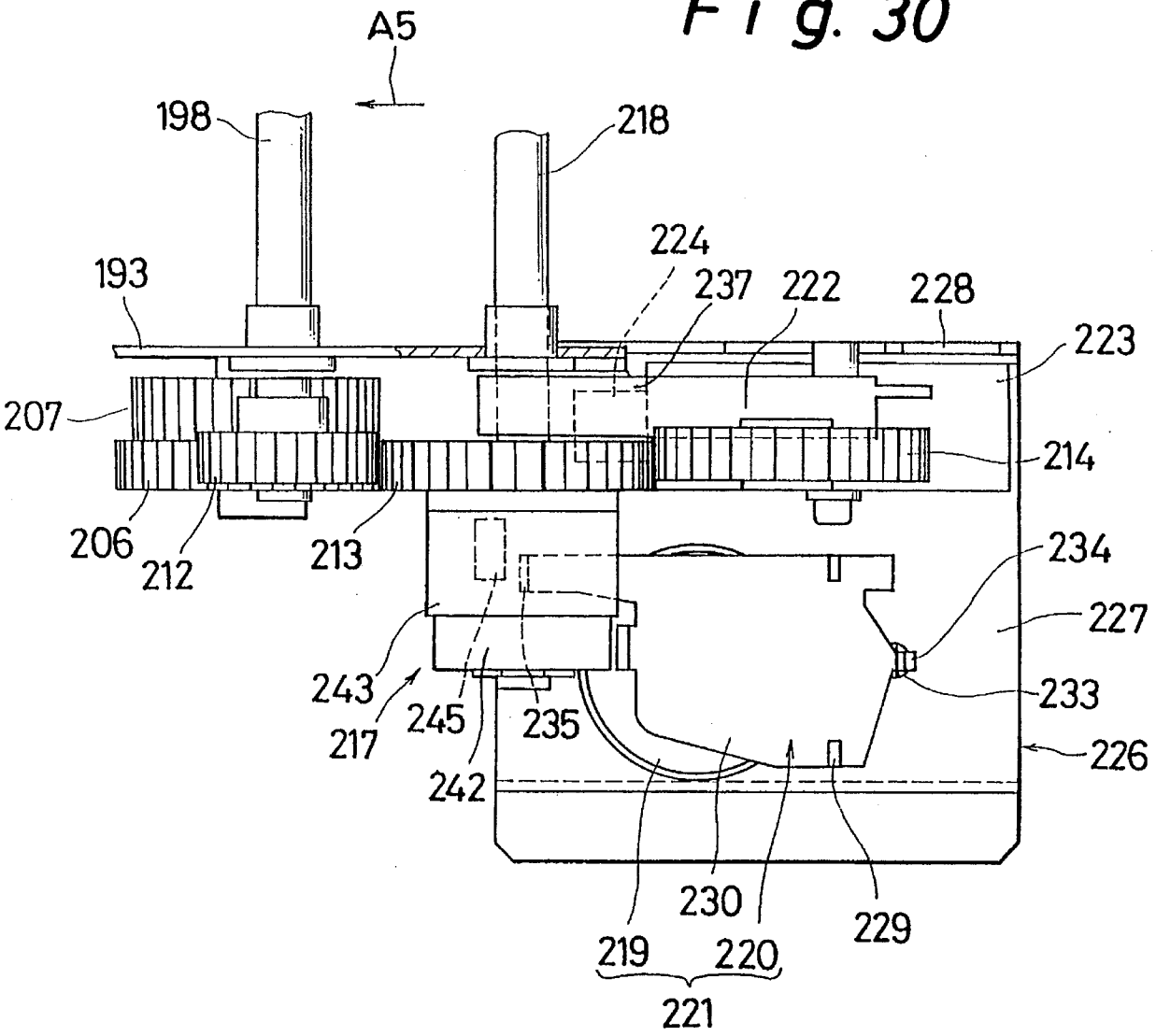
FIG. 30 is an enlarged plan view of a portion of the transport device.
Figure 31:
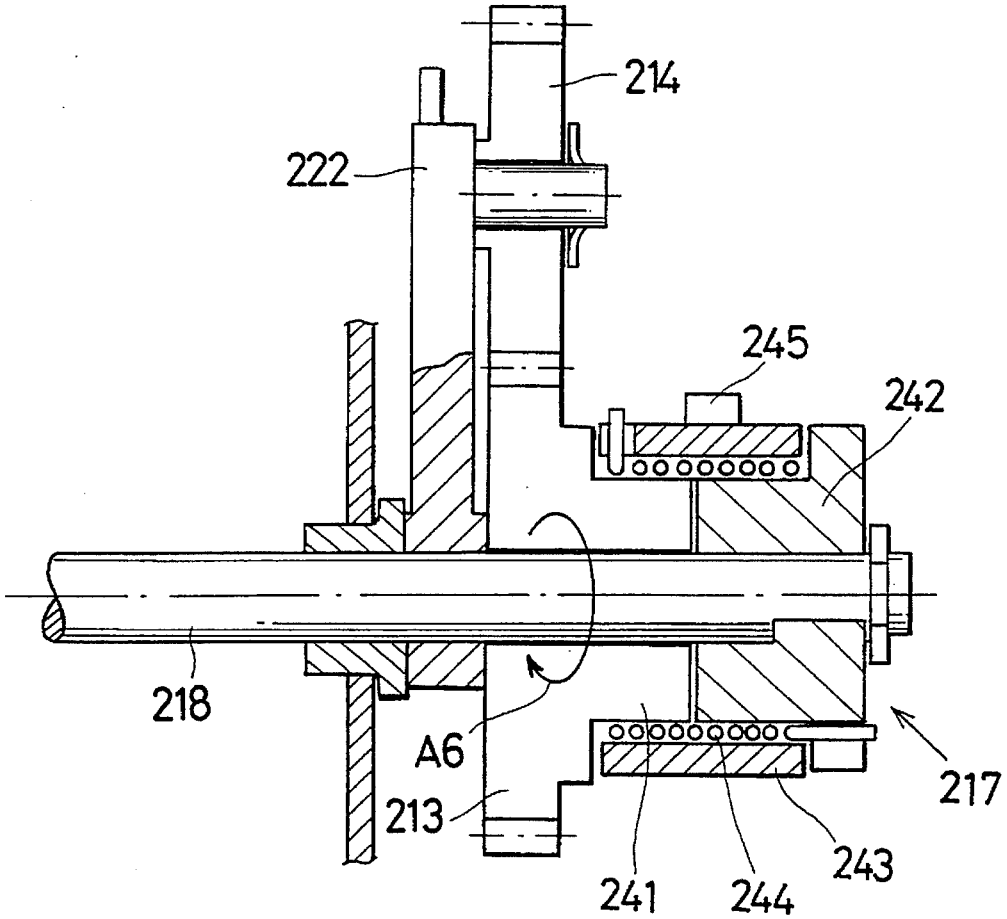
FIG. 31 is a cross sectional view of a clutch mechanism and its adjacent area.
Figure 32:
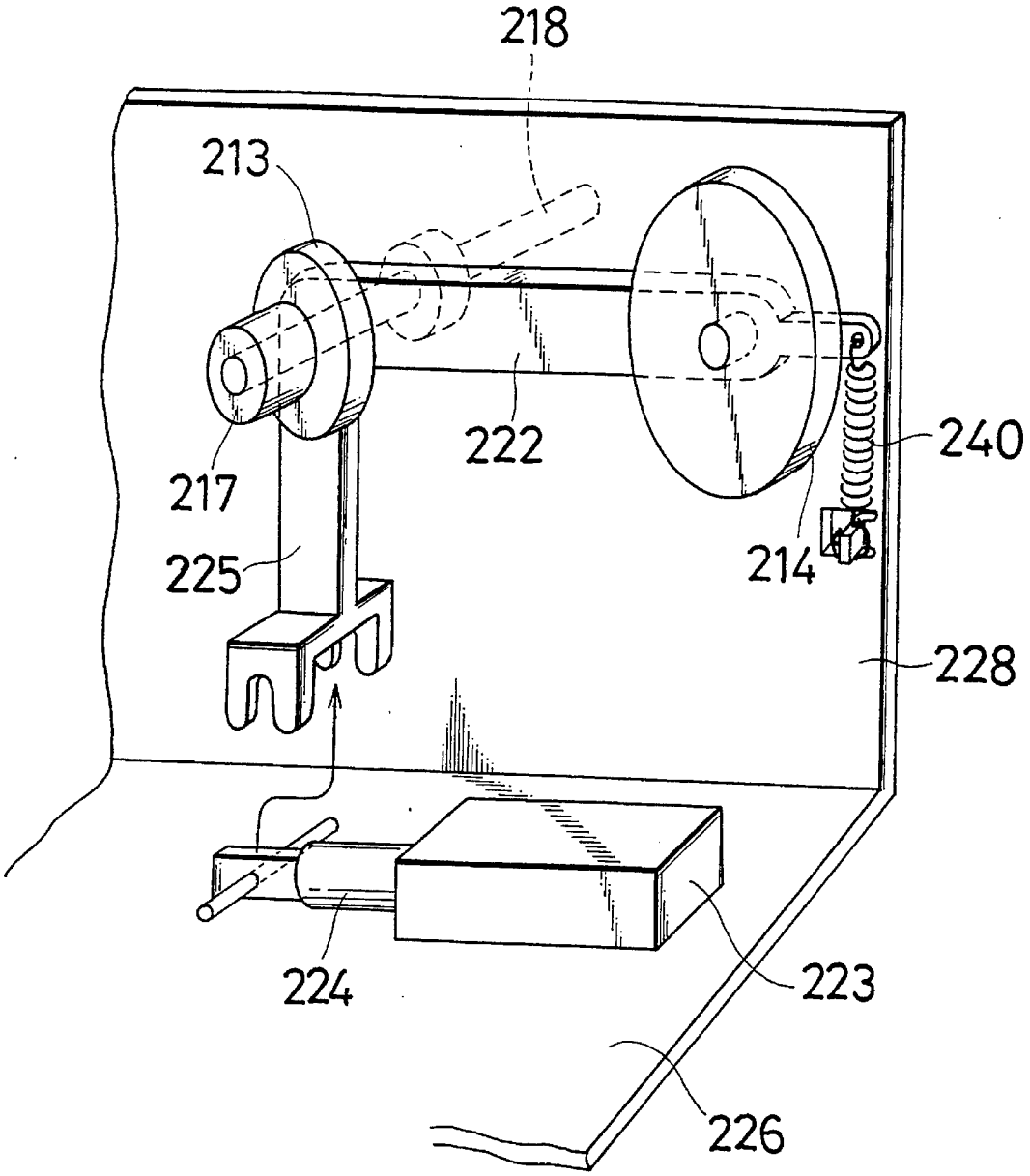
FIG. 32 is an exploded perspective view showing the clutch mechanism and its adjacent area.

FIG. 26 is a plan view of a transport device 190, comprising the paper feed roller 30, transport rollers 37, and resist rollers 38 described in connection with FIG. 1, for taking recording paper from the paper cassette 29 or the manual feed device 83 and transporting it to the transfer device 42. FIG. 27 is a front view of the transport device 190, FIG. 28 is a rear view of the transport device 190, FIG. 29A is an exploded perspective view showing the resist roller 38 and its adjacent area, FIG. 29B is an exploded perspective view showing a state where the position of a rotation limiting portion 204*a* of FIG. 29A is changed, FIG. 30 is an enlarged cross sectional view of the transport device 190, FIG. 31 is a cross sectional view of a clutch mechanism 217 and its adjacent area, and FIG. 32 is an exploded perspective view showing a drive lever 222 and its adjacent area. The transport device 190 includes a pair of guide members, i.e. an upper guide member 192 and a lower guide member 193, which are joined together, in relatively movable fashion, near the downstream end of the transport device 190.

The upper guide member 192 comprises: a rectangular guide plate 194, extending longitudinally along the width direction of the lower housing 22, for smoothly guiding the recording paper being transported and a pair of plate springs 195 spaced apart along the width direction, both being located nearly centrally on the guide plate 194 along the transporting direction A1. Each of the plate springs 195 is formed sloping upward in the direction opposite to the transporting direction A1 and is fixed at its base to the upper surface of the upper guide member 192 with a fixing piece 196. When the upper housing 23 is closed, the plate springs 195 contact the underside of the housing section 160 of the process cartridge 73 from below, so that the upper housing 23 is urged upward by the spring force of the plate springs 195 applied via the process cartridge. The upper guide member 192 is cut, for example, at four places, to form a total of four upright support pieces 197. Two driven rollers 37*a*, the upper rollers of the pairs of transport rollers 37, are mounted on a shaft 198 that is rotatably inserted through the support pieces 197.

Driving rollers 37*b*, the lower rollers of the pairs of transport rollers 37, are mounted on the lower guide member 193, as will be described later. The widthwise ends of the downstream end of the upper guide member 192 are mounted on pins 200 that are inserted rotatably in the lower guide member 193, thus mounting the upper guide member 192 in movable fashion relatively to the lower guide member 193. A side plate 204, described later, in which one of the pins 200 is rotatably held, is provided with a rotation limiting portion 204*a* that engages a corner 192*b* formed on the periphery of the upper guide member 192, to limit the range of angular displacement of the upper guide member 192 relative to the lower guide member 193. That is, when the upper guide member 192 is turned upward around the pins 200 beyond the point where the upper guide member 192 is substantially perpendicular to the horizontal plane, the upper guide member 192 further moves by its own weight in the counterclockwise direction as viewed facing FIG. 29A, until the corner 192*b* of the upper guide member 192 hits the rotation limiting portion 204*a* of the side plate 204, thus limiting further angular displacement of the upper guide member 192. In this condition, the upper guide member 192 rests on the rotation limiting portion 204*a* with its own weight, and can be left open in that condition without manual assistance. Furthermore, as shown in FIG. 29B, the rotation limiting portion 204*a* may be formed at such a position that the opening angle of the upper guide member 192 is less than 90 degrees. In this condition, the upper guide member 192 is likely to close by its own weight relative to the lower guide member 193 unless an operator supports the upper guide member 192.

Upper driven rollers 201 constituting the upper pair of resist rollers 38 are mounted rotatably on a shaft 202 whose ends are fixed to respective shaft supports 199 provided at the widthwise end portions of the upper guide member 192.

The lower guide member 193 comprises a guide plate 203, having a shape substantially corresponding to that of the guide plate 194, for smoothly guiding the recording paper, and a pair of side plates 204, 205 formed by downwardly bending the widthwise end portions of the guide plate 203. Outwardly of the side plate 204 are mounted: a gear 209 to which power is transmitted from the gear 111 driven by the motor 104 shown in FIG. 11 and which is mounted in disengageable manner on a shaft 215 holding thereon the driving rollers 208 disposed opposite the driven rollers 201 of the resist rollers 38. Gears 209 engages with a gear 211 that engages a gear 210 that transmits power to a gear 206 via a gear 207 fixed on the same shaft on which the gear 206 is mounted. A gear 212 engages with the gear 206 and is mounted on the same shaft that holds thereon the driving rollers 37*b* disposed opposite the driven rollers 37*a* of the transport rollers 37. A gear 213 engages with the gear 206 and transmits power to the paper feed roller 30. A gear 214 engages with the gear 213 and has a structure enabling gear 214, engaged with the gear 213, to move in vertical directions at a position opposite from the gears 206,207, the structure being described in detail hereinafter.

The driven rollers 201 and the driving roller 208, which together constitute the resist rollers 38, are mounted on the shafts 202 and 215, respectively. The shaft 215 is rotatably supported by the side plates 204, 205, and extends outwardly of the side plate 204 for connection with clutch mechanism 216. The clutch mechanism 216 has a known construction, and is used to transmit or cut off the rotation of the gear 209 to the shaft 215 in response to an input of a control signal, etc. Thereby the resist rollers 38 can intermittently rotate at a predetermined timing.

Another clutch mechanism 217 is provided for the paper feed roller 30. The paper feed roller 30 is mounted on a shaft 218 one end of which is supported rotatably on the side plate 205. The other end of the shaft 218 is rotatably supported on the side plate 204 and extends outwardly through the side plate 204 for connection with the clutch mechanism 217. The operation of the clutch mechanism 217 is controlled by using a driving mechanism 221 comprising an electromagnetic unit 219 and an armature 220, as will be described later. The structure that allows the vertical movement of the gear 214 is accomplished by the use of an L-shaped driving lever 222 a corner portion of which is rotatably mounted in the vicinity of one end of the shaft 218. The gear 214 is rotatably coupled to a portion near one end of the driving lever 222, and the other end of the driving lever 222 is attached to a driving piece 225 (see FIG. 32) that is coupled with a pin to a reciprocating rod 224 of an electromagnetic plunger 223.

When the electromagnetic plunger 223 is operated to pull the rod 224, the driving lever 222 is turned about the shaft 218 in the counterclockwise direction as viewed facing FIG. 27, thus causing the gear 214 to move upward. This causes the rotation to be transmitted to the paper feed rollers on the manual feed device 83, as will be described later. When the electromagnetic plunger 223 is deenergized, the driving lever 222 is turned in the clockwise direction as viewed facing FIG. 27, causing the gear 214 to move down and thus cutting off the transmission of the rotating force to the manual feed device 83.

As shown in FIG. 27, the electromagnetic unit 219 and the electromagnetic plunger 223 are mounted on a mounting base 226, not on the guide members 192 or 193. The mounting base 226 includes a mounting plate 227 placed in substantially a horizontal position, and a side wall 228 formed upright at the farther end of the mounting plate 227, i.e., in the upper side of FIG. 30. The electromagnetic unit 219, and an L-shaped support piece 229 for movably supporting the armature 220 at both widthwise ends, are attached to the mounting plate 227.

The armature 220 comprises a wide plate-like movable part 230 that is magnetically attracted to the electromagnetic unit 219, a guide part 232 extending first in the opposite direction from the movable part 230 with respect to the support piece 229 and then in a downward direction to abut against a pair of guide pieces 231 that extend upward in FIG. 27 from the support piece 229, thus limiting the amount of angular displacement of the armature 220, and a spring retaining part 234 extending further rightward in FIG. 27 from the upper end of the guide part 232 and connected by a tension spring 233 to the end of a spring hook part 231 formed by extending the guide piece 231 further rightward in FIG. 27.

As shown in FIG. 30, on the opposite end to the spring retaining part 234 of the movable part 230 of the armature 220, there is formed an engaging part 235 that extends below the clutch mechanism 217 and is bent upward at its end. The engaging part 235 is made to engage with or disengage from the clutch mechanism 217.

The construction of the clutch mechanism 217 will now be described. The gear 213 has a cylindrical structure, and is not fixed on the shaft 218 so that the rotation of the gear 213 is not transmitted to the shaft 218. The gear 213 contains a cylindrical part 241, through which the nearer end portion of the shaft 218, i.e. the rightmost end portion, as viewed facing FIG. 31, is passed in noncontacting fashion. The end portion of the shaft 218 extends further outward and is fitted concentrically into a column-like rotating part 242. The portion of the rotating part 242 that faces the cylindrical part 241 has approximately the same outer diameter as that of the cylindrical part 241, and the facing ends of the rotating part 242 and the cylindrical part 241 are positioned in close proximity to each other. The portions of the cylindrical part 241 and rotating part 242 nearer to their facing ends are surrounded by an outer cylindrical member 243 on the inside of which is mounted a coil 244 that wraps around the cylindrical part 241 and the rotating part 242, one end of the coil 244 being attached to the outer cylindrical member 243 and the other end attached to the rotating part 242.

On the other hand, an engaging pawl 245 is provided on the outer circumferential surface of the outer cylindrical member 243. When the electromagnetic unit 219 is in an unenergized state, and therefore, no magnetic field is produced, the armature 220 is urged upward by the spring force of the tension spring 233. In this condition, the engaging part 235 is made to engage the engaging pawl 245, thus preventing the outer cylindrical member 243 from rotating in the direction of arrow A6 (see FIG. 31). When the electromagnetic unit 219 is energized and a magnetic field is produced, the armature 220 is pulled, disengaging the engaging part 235 from the engaging pawl 245 and thus setting the outer cylindrical member 243 in a freely rotatably state (the condition shown in FIG. 27).

That is, when the engaging part 235 is not engaged with the engaging pawl 245, the rotation of the gear 213, and hence, the rotation of the cylindrical part 241, causes the coil 244 to compress, and the compressed coil 244 fixes the cylindrical part 241 and the rotating part 242 relatively to each other, thereby allowing the rotation to be transmitted to the shaft 218 and thus driving the paper feed roller 30 for rotation. On the other hand, when the engaging part 235 is engaged with the engaging pawl 245, the rotation of the cylindrical part 241 does act to apply force to compress the coil 244, but since the outer cylindrical member 243 is prevented from rotating in that direction, the coil 244 is supplied with a force to unwind it, so that the coil 244 does not work to couple the cylindrical part 241 to the rotating part 242, thus cutting off the transmission of rotation to the shaft 218.

(7) Description of the transfer device 42

Figure 33:
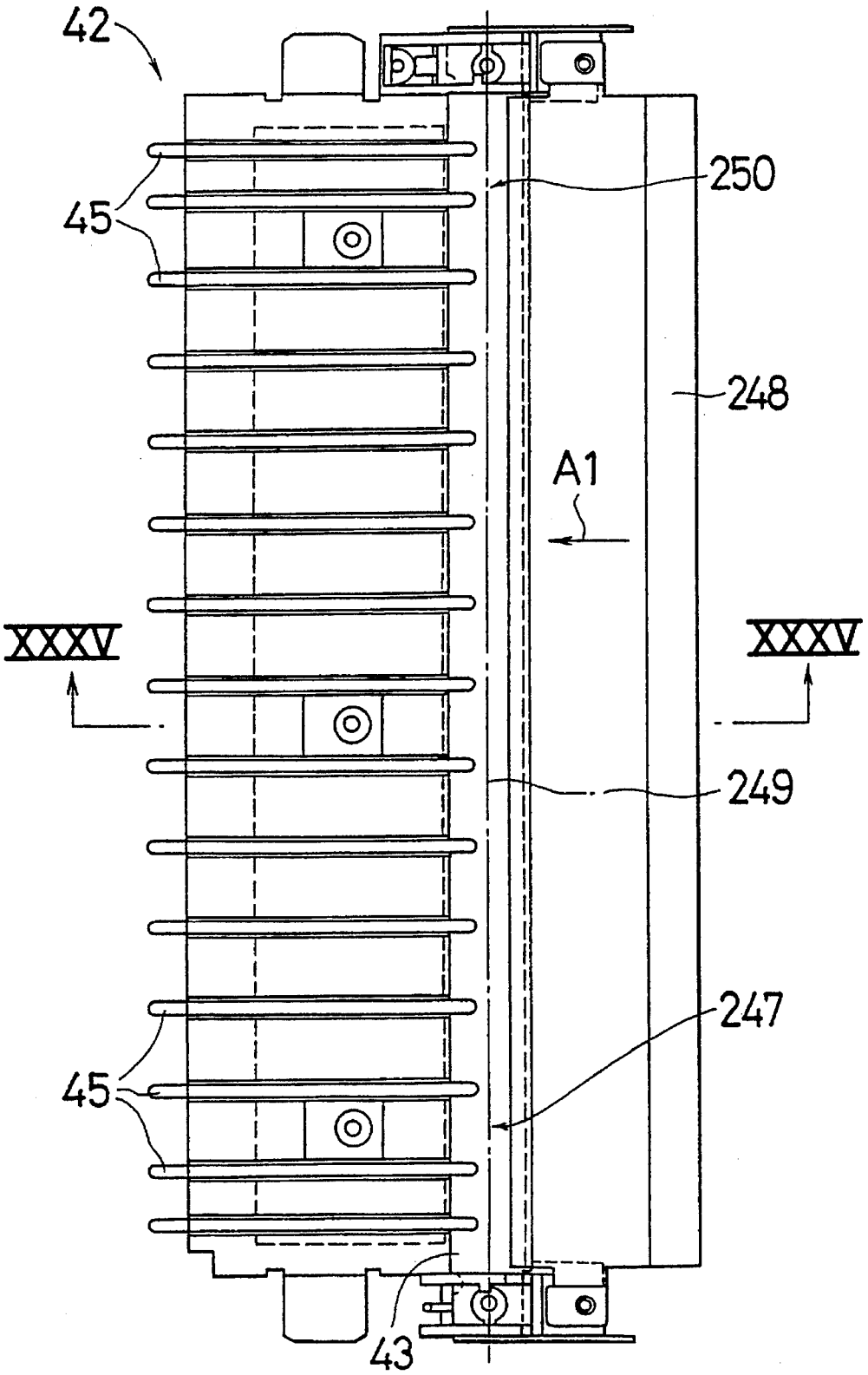
FIG. 33 is a plan view of a transfer device.
Figure 34:
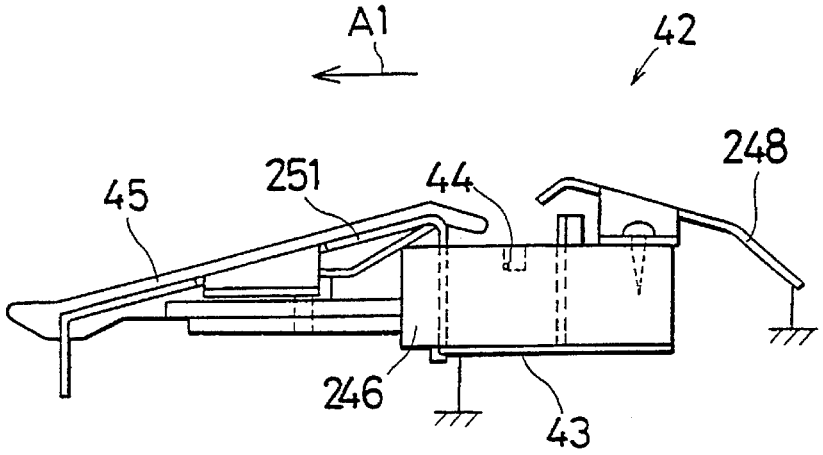
FIG. 34 is a front view, partly in cross section, of the transfer device.
Figure 35:
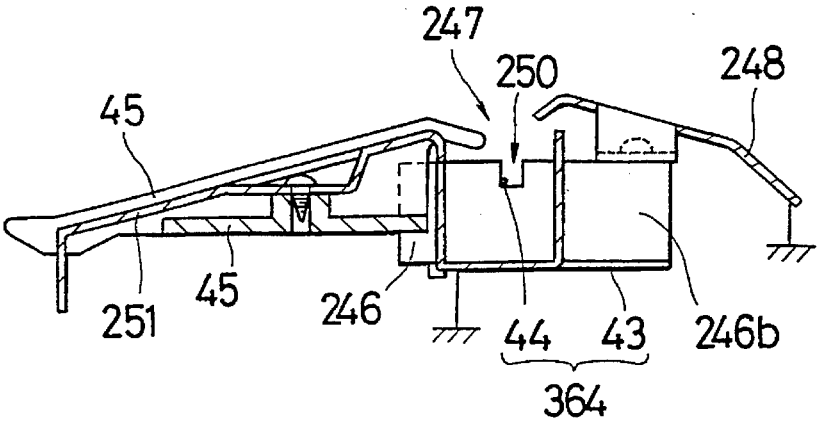
FIG. 35 is a cross sectional view taken along line XXXV—XXXV in FIG. 33.

FIG. 33 is a plan view of the transfer device 42, FIG. 34 is a front view, partly in cross section, of the transfer device 42, and FIG. 35 is a cross sectional view of the transfer device 42. The transfer device 42 of this embodiment is characterized in that a guide member for guiding recording paper fed from the transport device 190 to a transfer area between the transfer device 42 and the photoconductor drum 77, a charge unit for transfer, and a guide member for guiding the recording paper after transfer to the fixing device 46 are integrally constructed.

The transfer device 42 is provided, at its upstream end, with a first guide member 248 for guiding recording paper fed from the transport device 190 to a transfer area 247 between the transfer device 42 and the photoconductor drum 77. The first guide member 248 consists of a bent metal plate which is disposed sloping downward in the direction opposite to the transporting direction A1 and connected to a ground voltage. Joining members 246 formed from plastic material are secured to both longitudinal ends (the nearer and farther ends when viewed facing FIG. 34) of the first guide member 248. Using the joining members 246, the shielded case 43, hereinafter described, is joined to the guide member 248 at both longitudinal ends of the transfer device 42. A groove 250 is formed in each joining member 246 at a position adjacent to the transfer area. A charge wire 44 is stretched from one groove 250 to the other. The shielded case 43, a box-like metal case connected to a ground voltage, is installed in such a manner as to enclose the grooves 250 from below. The charge wire 44 and the shielded case 43 together constitute a transfer charger 364.

The downstream side of the shielded case 43 extends slightly downward to form a support part 251. The support part 251 is provided with a plurality of elongated holes extending along the transporting direction A1. A plurality of rod-like guide ribs protrude through the elongated holes from below the support part 251, so that the protruded portions each form a guide piece 45, thus forming a paper guide face along the width direction. The upper end surface of each guide rib is positioned higher than the surface of the support part 251 so as to provide a predetermined space between the support part 251 and the recording paper.

That is, the construction is such that, while the recording paper fed from the transport device 190 is being guided along the guide member 248 toward the transfer area 247, the voltage of the recording paper due to static electricity, etc., is reduced to the ground voltage. Furthermore, after a toner image on the photoconductor drum 77 has been transferred to the recording paper at the transfer area 247, the recording paper is transported past the guide ribs toward the fixing device 46. While this is happening, the charge voltage given to the recording paper by the transfer device 42 is discharged through the support part 251 spaced away from the recording paper by the guide pieces 45.

The above arrangement serves to simplify the construction since it is not necessary to provide the member for guiding the recording paper from the transport device 190 toward the fixing device 46 separately from the member used for transfer. Furthermore, with the guide member 248 and the support part 251, the potential of the recording paper before and after the transfer process can be reduced to the ground voltage, which facilitates separation from the photoconductor drum 77 and transportation of the recording paper during and after the transfer process.

(8) Description of the fixing device

Figure 36:
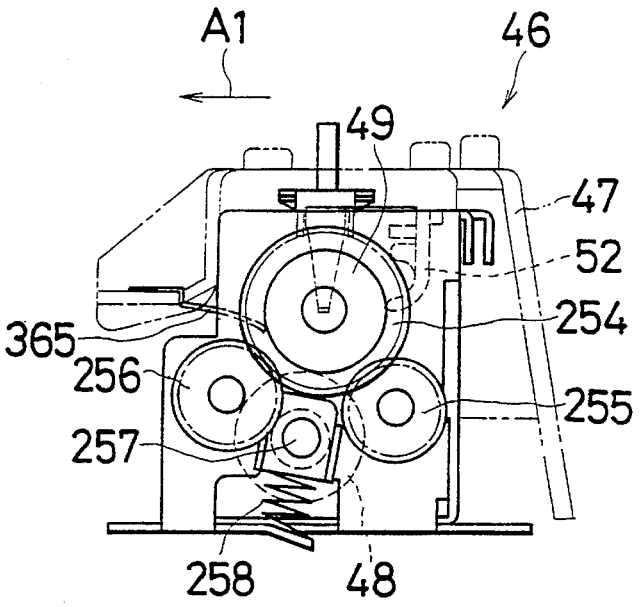
FIG. 36 is a front view of a fixing device.
Figure 37:
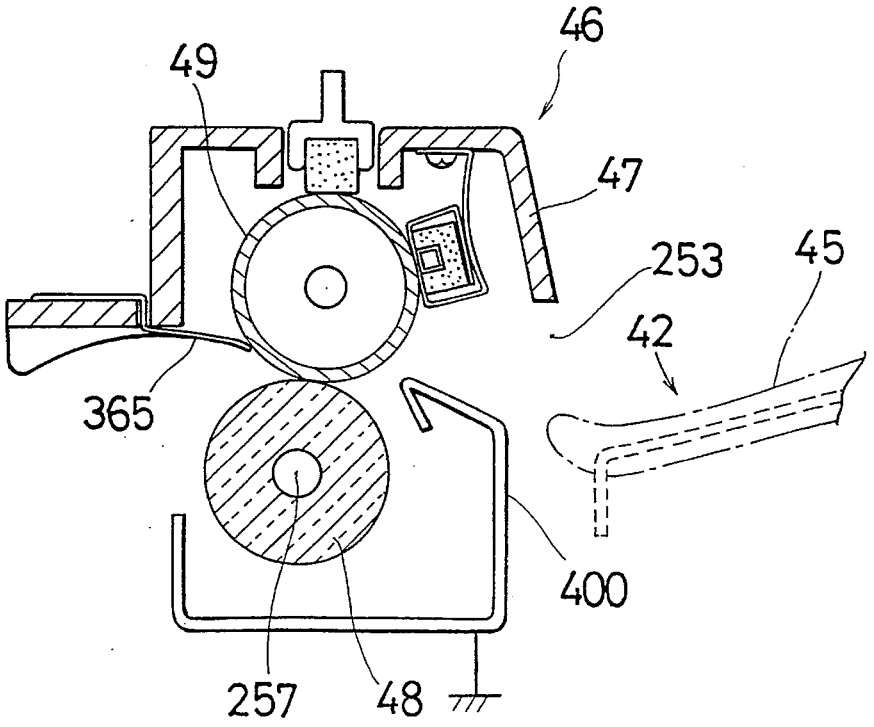
FIG. 37 is a cross sectional view of the fixing device.

FIG. 36 is a front view of the fixing device 46, and FIG. 37 is a cross sectional view of the fixing device 46. The housing 47 of the fixing device 46 has an opening 253 formed at its upstream side. A recording paper from the transfer device 42 is passed through the opening 253 and guided toward the position between the pressure roller 48 and the heating roller 49. The pressure roller 48 is mounted on a shaft 257 that is attached to one end of a spring 258 whose other end is secured to a lower end portion of the housing 47, so that the pressure roller 48 is pressed against the heating roller 49. The heating roller 49 is provided with a gear 254 mounted concentrically therewith. Power is transmitted to the gear 254 via a gear 255 that engages with the gear 116 shown in FIG. 11. The pressure roller 48 is driven by the rotation of the heating roller 49. In the downstream side of the fixing device 46, there is mounted a gear 256 that engages with the gear 254 to transmit power to the rear unit 55 hereinafter described. Disposed downstream of the heating roller 49 is a separation pawl 365 for separating the recording paper adhering to the heating roller 49 with molten toner, etc., during the fixing process. The separation pawl 365 is installed with its end contacting the heating roller 49.

The separation pawl 365 is formed, for example, from a polyamide film. One end of the separation pawl 365 is fixed to the downstream end of the housing 47 of the fixing device 46, and the other end extends in the opposite direction to contact the surface of the heating roller 49, thereby guiding the leading edge of recording paper. A paper guide 400 for guiding the underside of recording paper being fed from the transfer device 42 is provided in the opening 253 of the fixing device 46. The paper guide 400 is formed from a metal plate and is connected to a ground voltage.

(9) Description of the rear unit 55

Figure 38:
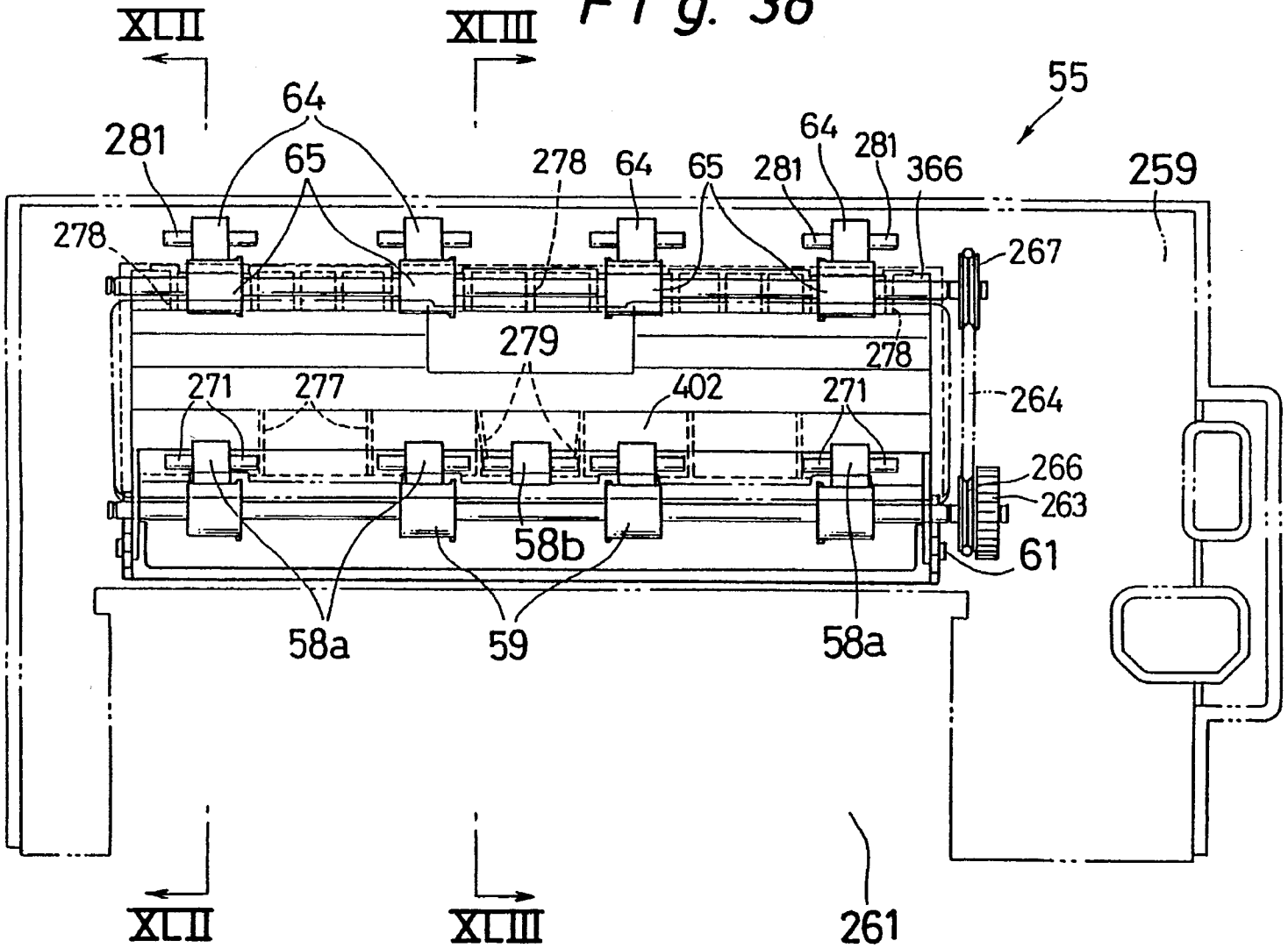
FIG. 38 is a front view of a rear unit.
Figure 39:
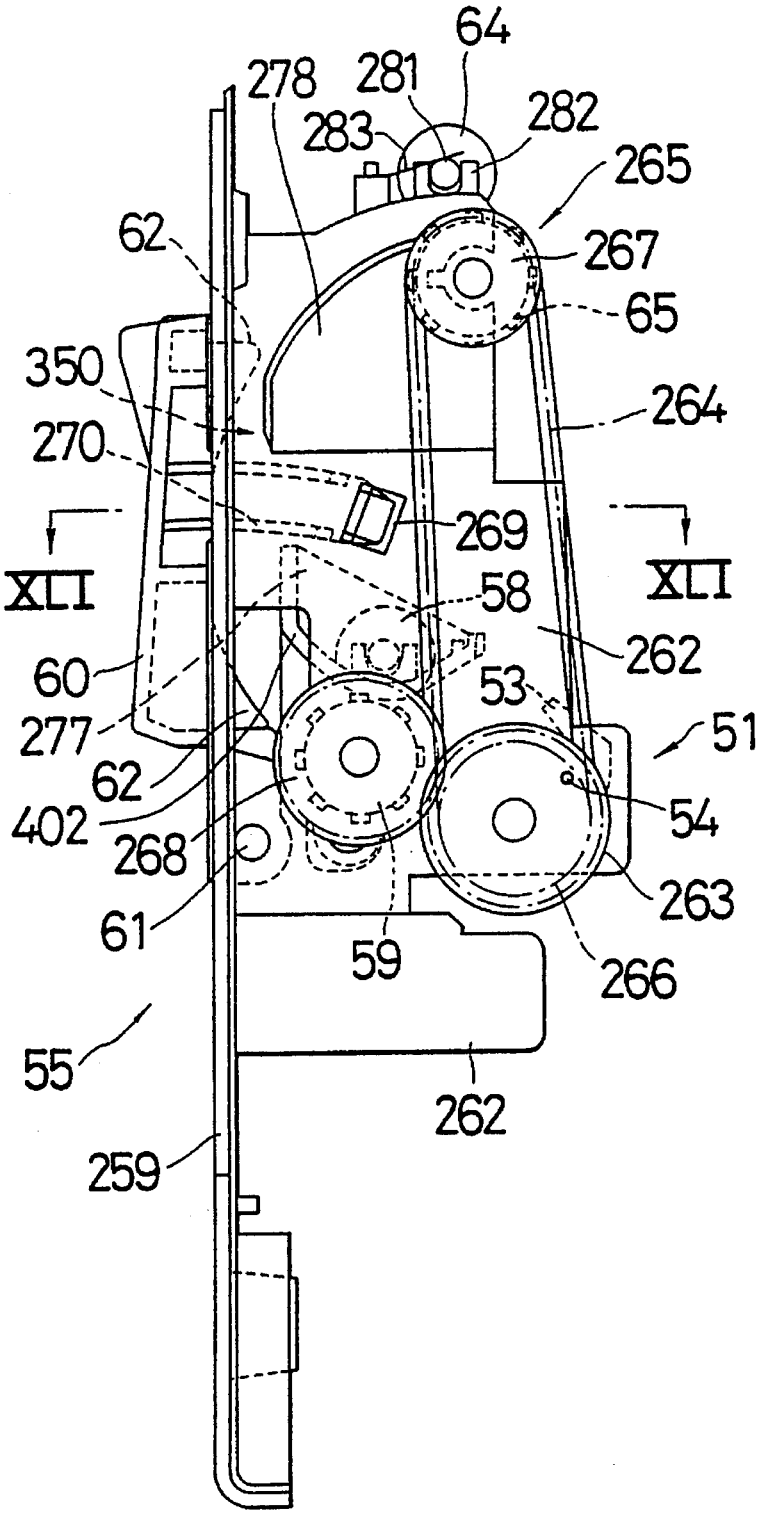
FIG. 39 is a right side view of the rear unit.
Figure 40:
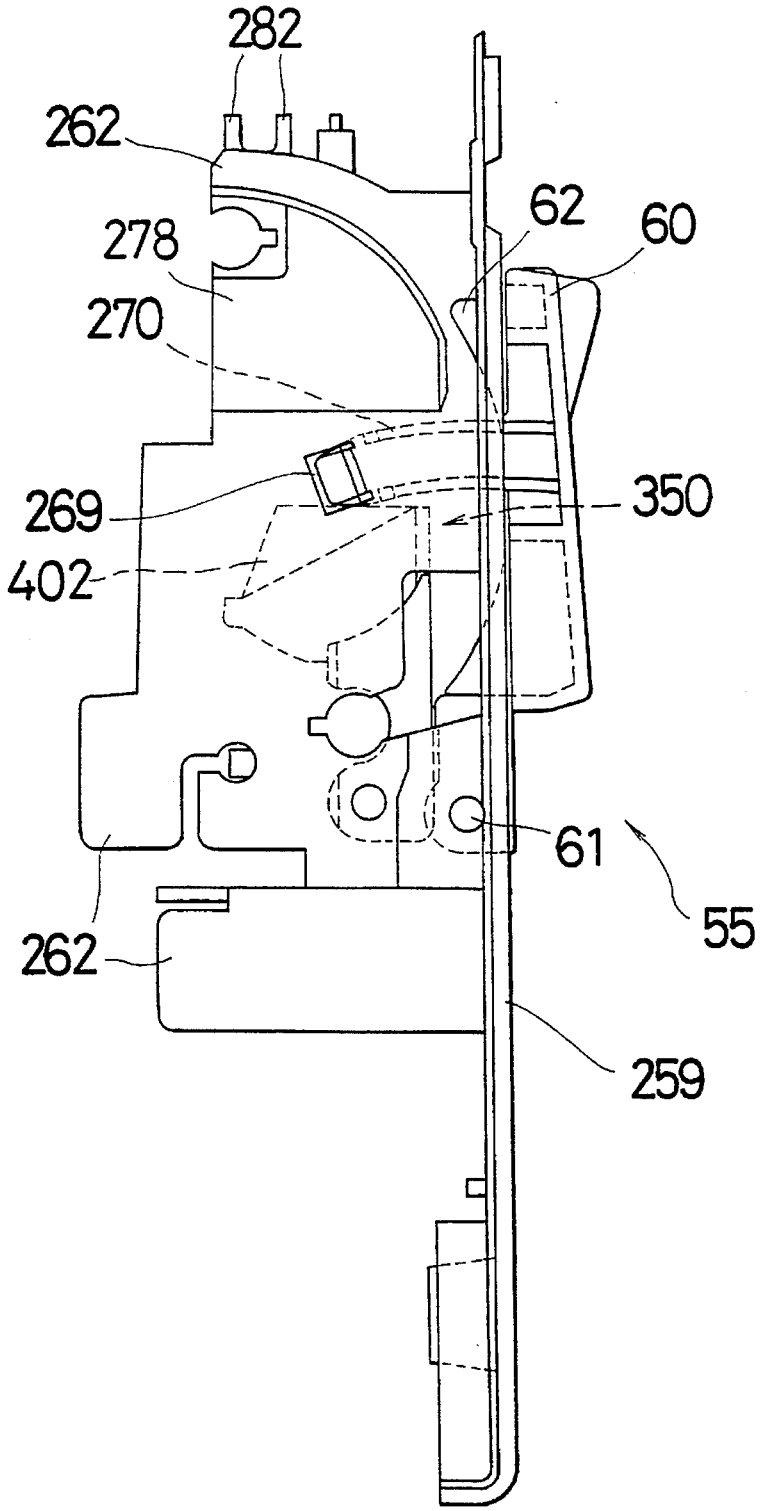
FIG. 40 is a left side view of the rear unit.
Figure 41:
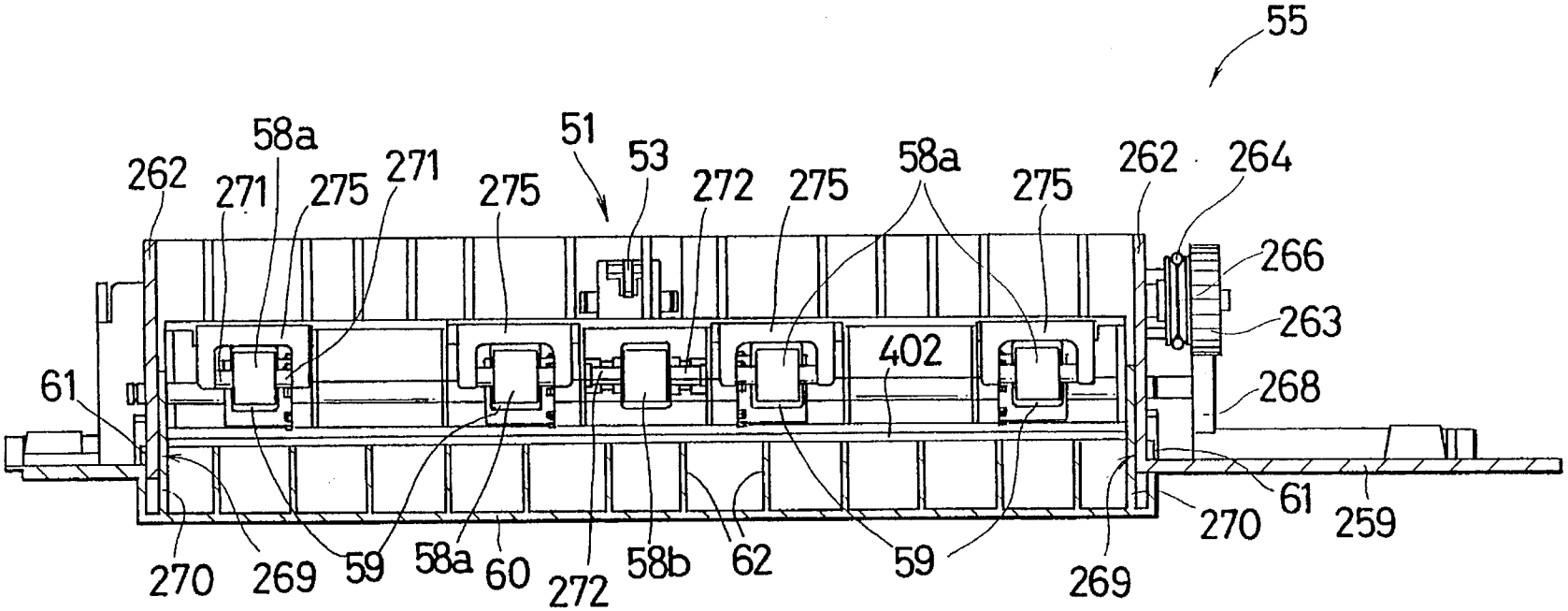
FIG. 41 is a cross sectional view taken along line XLI—XLI in FIG. 39.

FIG. 38 is a front view of the rear unit 55 viewed from the downstream side of the transporting direction A1, FIG. 39 is a right side view of the rear unit 55, FIG. 40 is a left side view of the rear unit 55, and FIG. 41 is a cross sectional view taken along line XLI—XLI in FIG. 39. The rear unit 55 has an essentially rectangular frame 259 mounted in upright position perpendicular to the transporting direction A1. The previously mentioned opening 101 is formed in the frame 259. The previously mentioned rear cover 60 is provided to cover the opening 101. The rear cover 60 is mounted swingably about the shafts 61 on a pair of mounting pieces 262 that are formed at both widthwise ends of the frame 259 in such a manner as to extend in the direction opposite to the transporting direction A1.

A gear 263, which engages with the aforementioned gear 256, is mounted on one of the mounting pieces 262 at a position upstream of the shaft 61. A rubber belt 264 is passed around a pulley 266 fixed on the shaft of the gear 263, to transmit power to a pulley 267 fixed on the shaft of the paper discharge rollers 65. Disposed adjacent to the pulley 266 is the detecting means 51. A gear 268, which engages with the gear 263, is fixed on the shaft of the paper discharge rollers 59 which are driven for rotation.

The inverting member 62 formed on the rear cover 60 is provided with a plurality of plate-like members arranged across the width direction. Engaging holes 269 are formed in the rear unit 55. The engaging holes 269 each have an open end facing downstream in the-transporting direction A1. Formed near the widthwise ends of the rear side of the rear cover 60 are engaging arms 270 which curve downward as they extend in the direction opposite the transporting direction A1. The engaging arms 270 are detachably engaged in the engaging holes 269.

Figure 42:
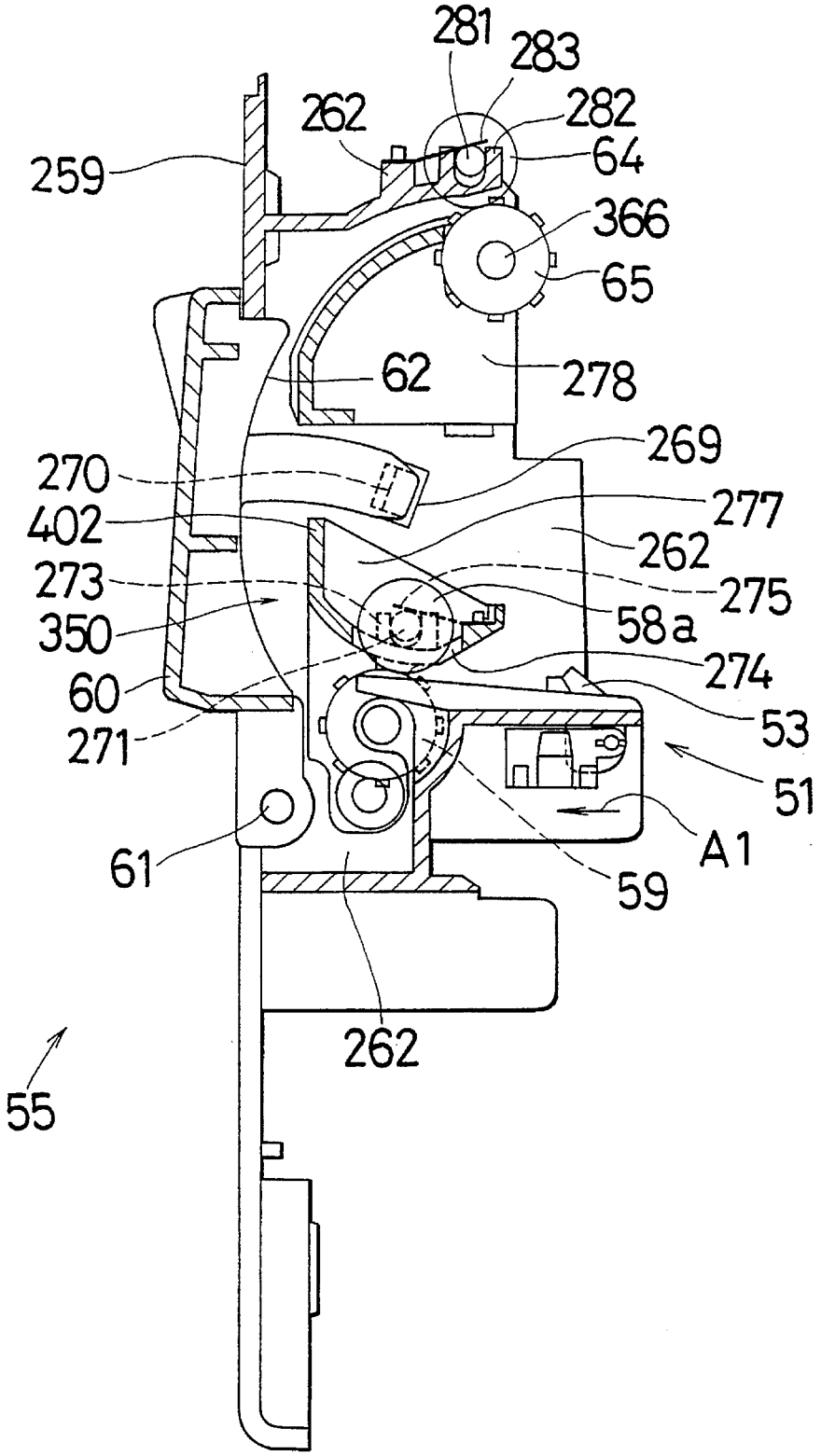
FIG. 42 is a cross sectional view taken along line XLII—XLII in FIG. 38.
Figure 43:
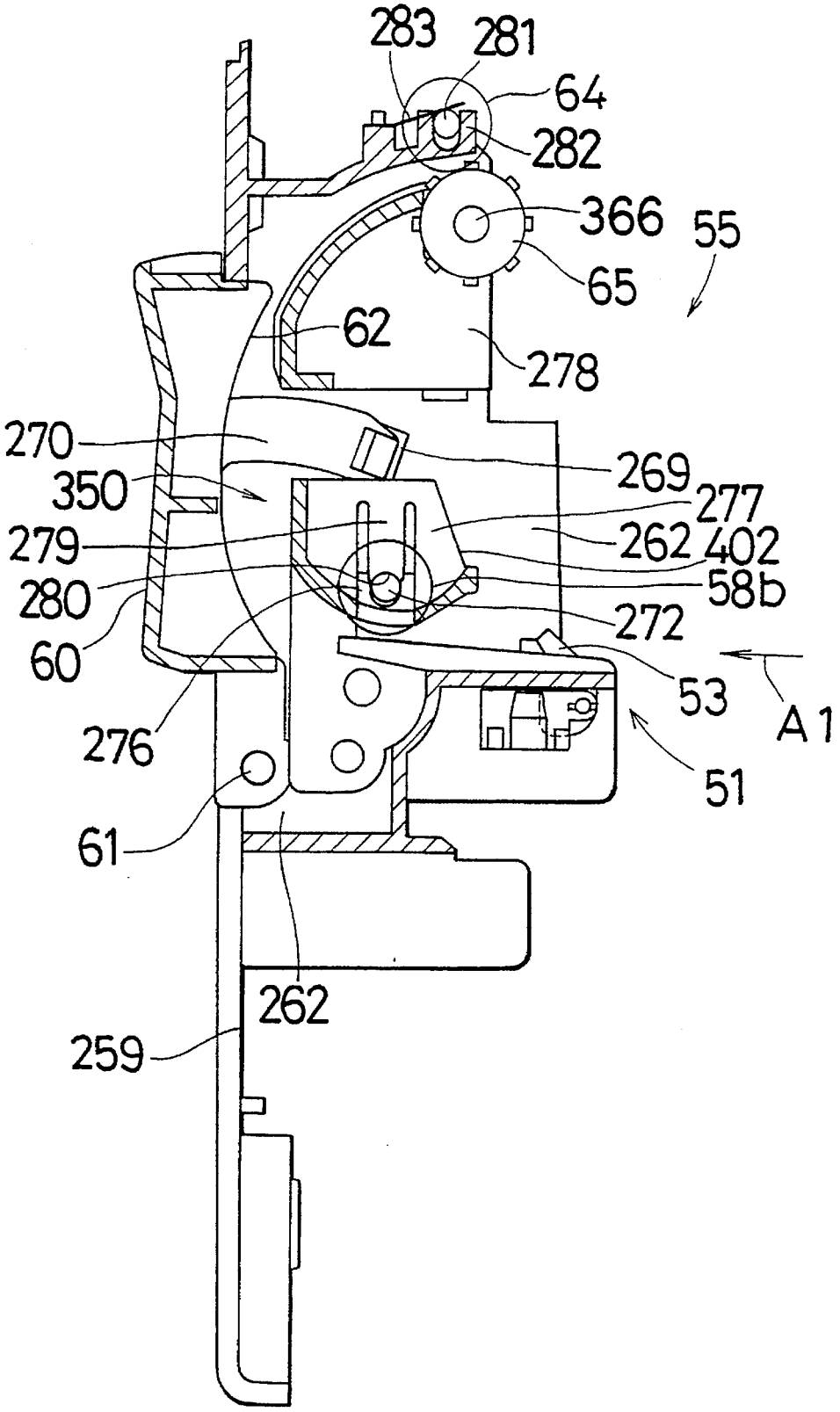
FIG. 43 is a cross sectional view taken along line XLIII—XLIII in FIG. 38.
Figure 44:
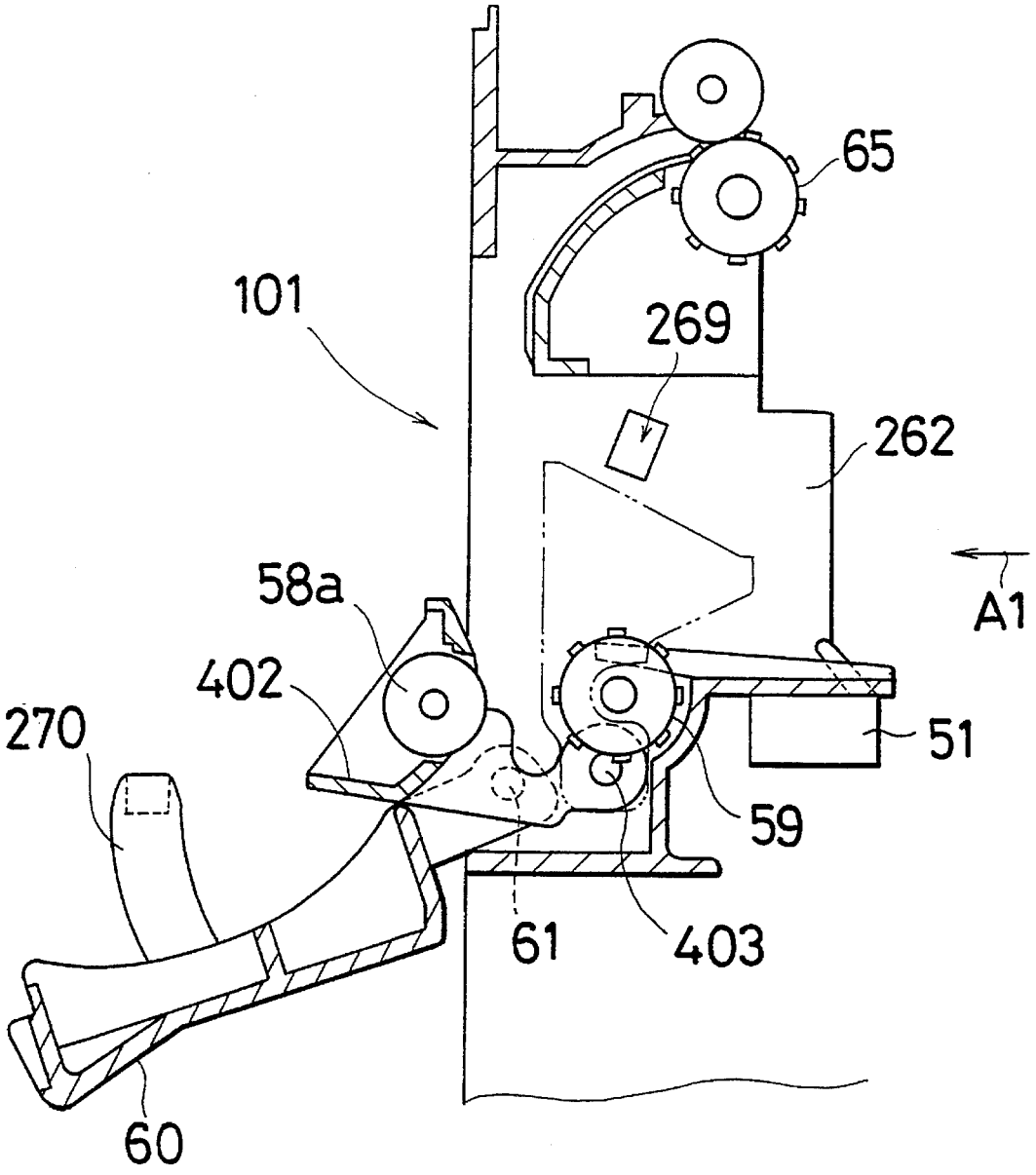
FIG. 44 is a side elevational view showing the rear unit in an operating condition.

FIG. 42 is a cross sectional view taken along line XLII—XLII in FIG. 38; FIG. 43 is a cross sectional view taken along line XLIII—XLIII ; and FIG. 44 is a side elevational view showing the rear unit 55 in an operating condition. In this embodiment, the rear unit 55 is provided with, for example, four paper discharge rollers 59 fixed on the same shaft at nearly equally spaced intervals, and first paper discharge rollers **58*a* are mounted facing the respective paper discharge rollers 59. Recording paper is caught between the first paper discharge rollers 58*a* and the facing paper discharge rollers 59** and is discharged outside the printer machine.

In this embodiment, a second paper discharge roller **58*b* that is not paired with a paper discharge roller 59 is installed in the widthwise center of the rear unit 55. More specifically, each of the first paper discharge rollers 58*a* has a respective shaft 271 which extends outwardly from both axial ends of the roller 58*a* and with which the roller 58*a* is supported at both axial ends thereof in vertically movable fashion in a respective essentially U-shaped support member 273 formed in a paper discharge roller unit 402. Each roller 58*a* protrudes downward through an opening 274 formed in the paper discharge roller unit 402 at a position opposite the facing paper discharge roller 59, and is made to abut against the paper discharge roller 59. Adjacent to the first paper discharge rollers 58*a* are a plurality of U-shaped pressure pieces 275 whose base ends are fixed to the paper discharge roller unit 402 and whose legs are pressed under spring force against the respective shafts 271 extending from both axial ends of the first paper discharge rollers 58*a***.

The second paper discharge roller **58*b* also has a shaft 272 extending in opposite directions from its longitudinal ends. The shaft 272 is supported from below by support members 276 formed in the paper discharge roller unit 402 in essentially the same U-shaped as the support members 273. Each of the paper discharge rollers 58*a*, 58*b* is separated by a partition wall 277 from one another along the width direction. The partition walls 277 on both sides of the second paper discharge roller 58*b* are provided with U-shaped cutouts, as shown in FIG. 43, each forming a pressure piece 279** extending down the wall.

Each pressure piece 279 is formed in such a shape as to come closer to the second paper discharge roller **58*b* as it extends from its fixed base to its free end, i.e., from the upper side toward the lower side of FIG. 38. An engaging recess 280 cut in a curved shape to match the outline of the shaft 272 is formed in the free end of each pressure piece 279 so that the ends of the shaft 272 are held in engagement with the recesses of the support members 276 when the second paper discharge roller 58*b* is mounted into the support members 276** from above.

When installing the second paper discharge roller **58*b* mounted on the shaft 272 into the rear unit 55, the ends of the shaft 272 are inserted from above into the support members 276. When the ends of the shaft 272 have reached the bottom ends of the respective support members 276, the shaft 272 becomes engaged with the engaging recesses 280 formed in the respective pressure pieces 279. The second paper discharge roller 58*b* thus installed is prevented by the support members 276 from moving in horizontal directions except for the margins allowed for the extraction of the shaft 272 in an upward direction. The roller 58*b* is thus allowed to rotate about its axis with the shaft 272 supported from below. Furthermore, the shaft 272 at both axial ends of the second paper discharge roller 58*b* is supported from above by the pressure pieces 279 with a force stronger than the spring force applied to each of the shafts 271**.

Suppose, for example, that a thick recording paper is fed between the paper discharge rollers 58 and 59. In this case, the first paper discharge rollers **58*a* are displaced upward against the spring force of the pressure pieces 275 so that the recording paper is pressed between the rollers 58*a* and 59. In the meantime, the second paper discharge roller 58*b* is pressed upward by the thick recording paper, which causes the pressure pieces 279 to deform in the paper thickness direction, thus allowing slight upward displacement of the second paper discharge roller 58*b*. As described previously, the second paper discharge roller 58*b* only presses the widthwise center portion of the recording paper from above while the recording paper is being transported by being pressed between the paper discharge rollers 58 and 59**.

The function of the second paper discharge roller **58*b* is to press the recording paper from above, as described above, thereby causing the recording paper to warp upward at its widthwise ends outward of the position thereof pressed by the second paper discharger roller 58*b*, which is especially the case with a stiff recording paper such as a post card that is relatively thick and narrow. This has the effect of increasing the pressing force applied by the paper discharge rollers, and hence facilitates the paper discharge operation of the paper discharge rollers 58 and 59**.

In the rear unit 55 of this embodiment, the rear cover 60 is provided on the downstream side of the paper discharge rollers 58 and 59. When the rear cover 60 is turned around the shafts 61 and set in an open position, the recording paper passed between the paper discharge rollers 58 and 59 is discharged outside the printer machine through the opening 101. On the other hand, when the rear cover 60 is closed to close the opening 101, the recording paper passed between the paper discharge rollers 58 and 59 is inverted by the inverting member 62 and directed toward the paper discharge rollers 64, 65.

The plurality of paper discharge rollers 64 are fixed on respective shafts 281. The shafts 281 are mounted rotatably in U-shaped support members 282 formed in upper portions of the mounting pieces 262 at positions adjacent to the paper discharge rollers 65, and are each pressed from above by the legs of a respective essentially U-shaped elastic pressure piece 283. That is, when a recording paper enters between the paper discharger rollers 64 and 65, the paper discharge rollers 64 are displaced upward against the spring force of the pressure pieces 283, thereby allowing the recording paper to travel between the paper discharge rollers 64 and 65 while being pressed between them by the spring force of the pressure pieces 283.

With the rear cover 60 opened, the paper discharge roller unit 402 can be turned toward the downstream side around the short shafts 403 formed on the side walls of the mounting pieces 262 facing the opening 101, thus permitting access through the opening 101 to the exit area of the fixing device. Therefore, when a paper jam occurs in or around the fixing device, the jammed paper can be easily removed by accessing it through the opening 101.

(10) Description of the manual feed device 83

Figure 45:
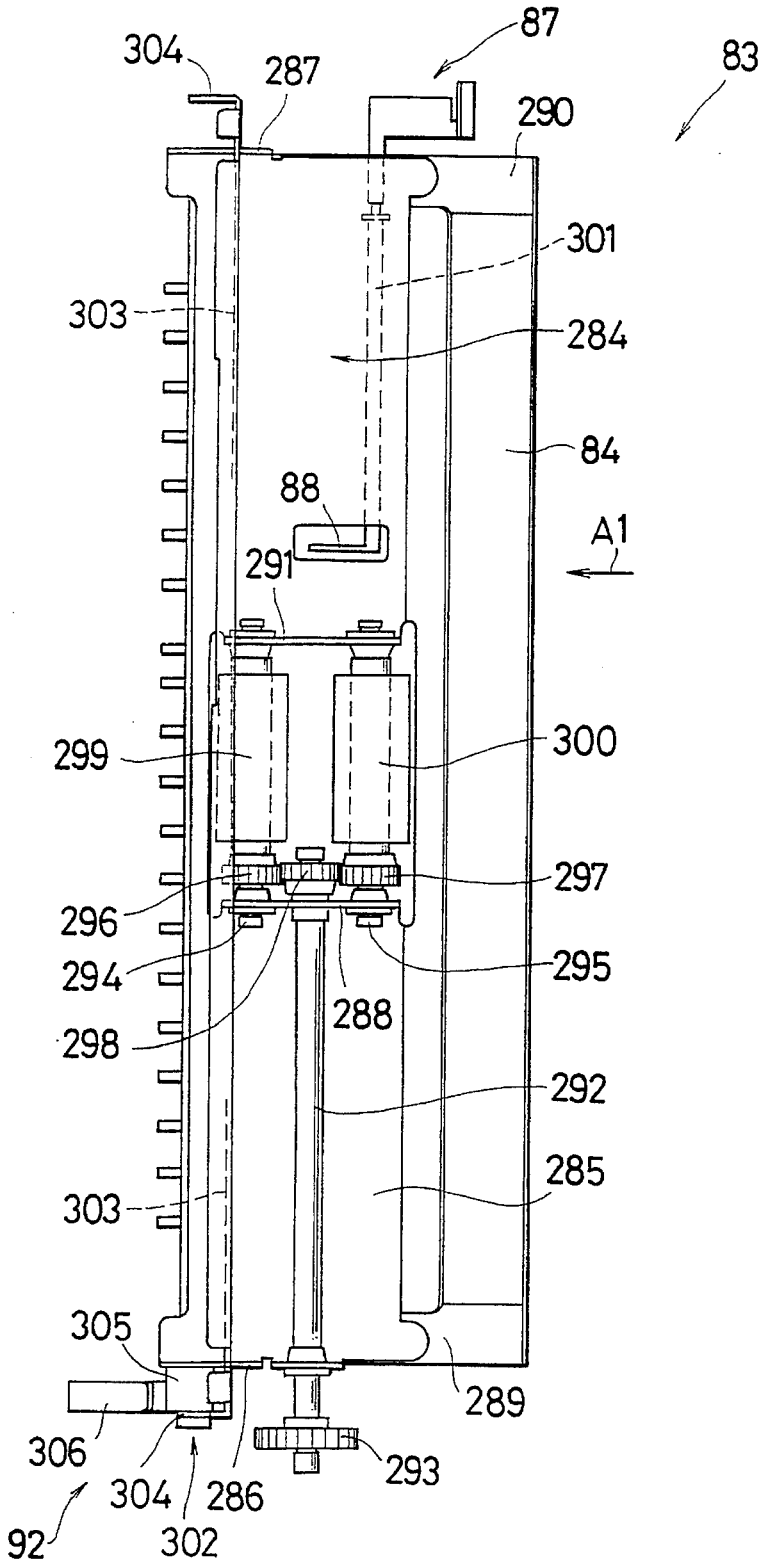
FIG. 45 is a plan view of a manual feed device.
Figure 46:
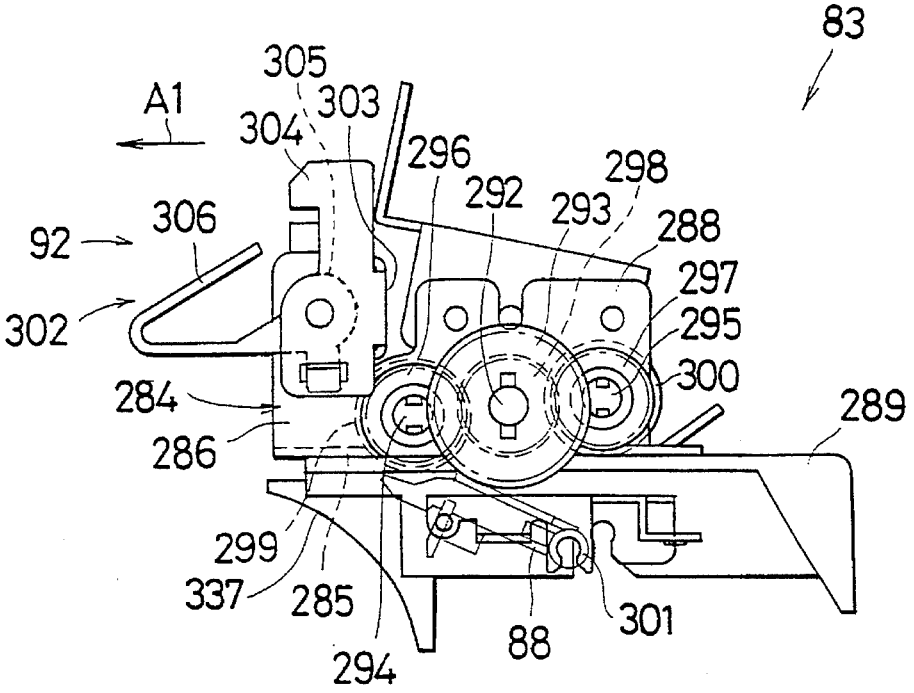
FIG. 46 is a front view of the manual feed device.
Figure 47:
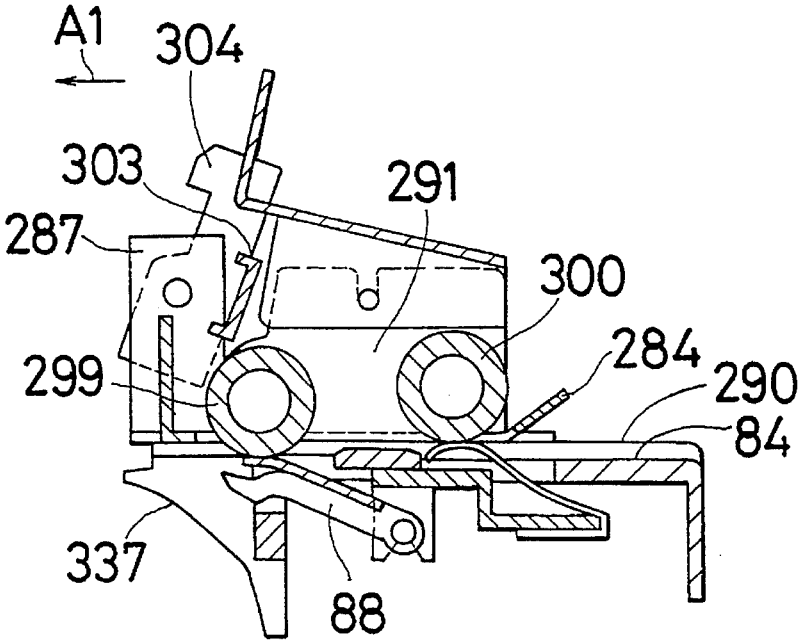
FIG. 47 is a cross sectional view of the manual feed device.
Figure 48:
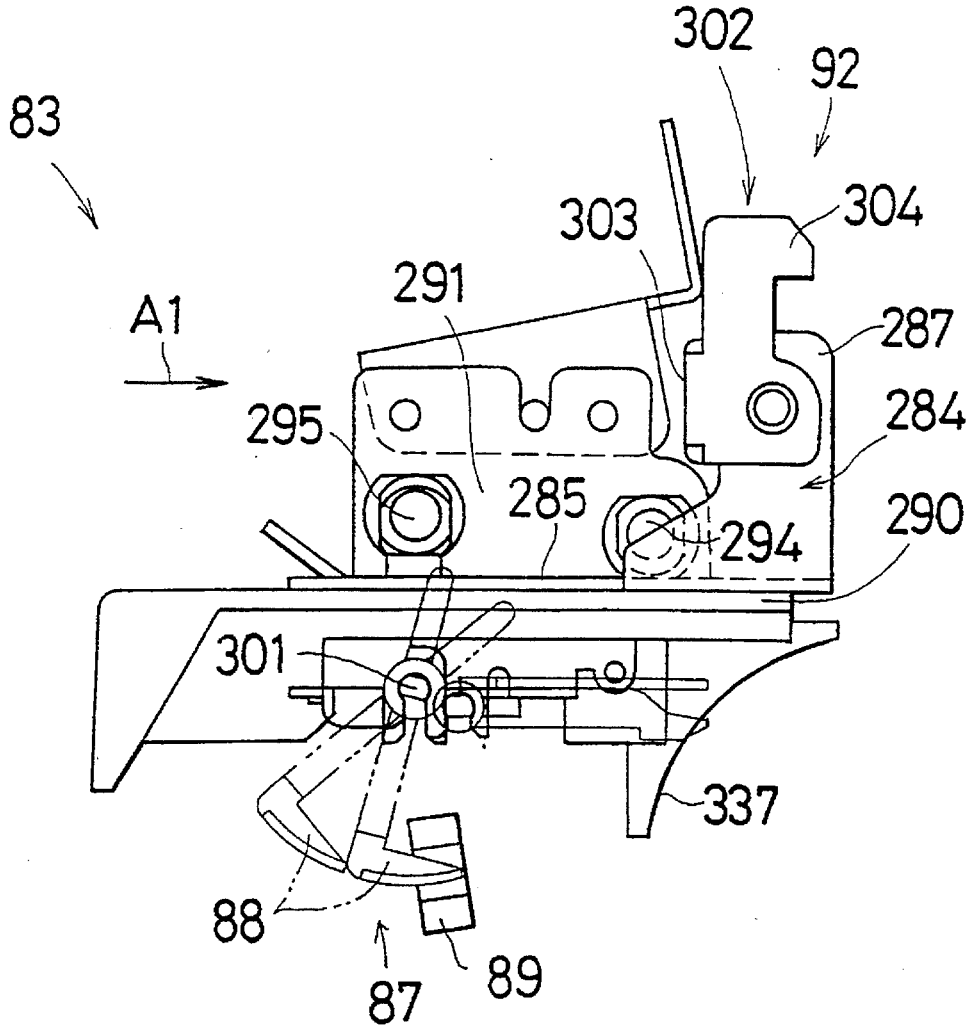
FIG. 48 is a rear view of the manual feed device.

FIG. 45 is a plan view of the manual feed device 83, FIG. 46 is a front view of the manual feed device 83, FIG. 47 is a cross sectional view of the manual feed device 83, and FIG. 48 is a rear view of the manual feed device 83. The manual feed device 83 is used to feed recording paper manually into the machine, and includes a loading tray 84 on which recording paper is placed for manual feeding, and rising plates 286 and 287 formed vertically on an upper guide 284 which is fixed across the widthwise ends of the loading tray 84.

At both widthwise ends of the loading tray 84 are formed rails 289, 290 on which the essentially U-shaped upper guide 284 is fixed. The upper guide 284 consists of a flat plate 285 parallel to the surface of the loading tray 84 and spaced apart therefrom by the height of the rails 289, 290, and the rising plates 286 and 287 extending vertically upward from the widthwise ends of the flat plate 285. Near the widthwise center of the flat plate 285 of the upper guide 284, a pair of mounting plates 288 and 291, spaced apart by a prescribed distance in the width direction, are formed integrally with the upper guide 284. On mounting plate 288 is mounted a shaft 292 which runs in parallel to the width direction and extends through the rising plate 286. A gear 293 that engages with the gear 214 described in connection with FIG. 27 is mounted on one end of the shaft 292. A gear 298 is mounted on the other end of the shaft 292 which protrudes through the mounting plate 288. Between the mounting plates 288 and 291 are rotatably mounted a pair of shafts 294 and 295 on opposite of the shaft 292. Gears 296 and 297 are fixed on the respective shafts 294 and 295 on the side of the mounting plate 288, and power is transmitted as these gears 296 and 297 engage with the gear 298 fixed on the shaft 292 connected to the gear 293. Paper feed rollers 299 and 300, formed from rubber, for example, are fixed on the shafts 294 and 295, respectively.

The detecting means 87 installed in the manual feed device 83 of this embodiment is constructed such that the driving lever 88 is mounted rotatably about a shaft 301 below the loading tray 84 with its end portion allowed to protrude through an elongated hole formed in the loading tray 84. That is, when the end portion of the driving lever 88 is pushed by a recording paper, the driving lever 88 is turned about the shaft 301, and this movement of the lever 88 is detected by the photosensor 89.

Near the downstream end of the upper guide 284 is rotatably installed a lock member 302 that constitutes a lock mechanism 92. The lock member 302 comprises a connecting part 303 constructed from a rectangular plate having a length greater than the spacing between the rising plates 286 and 287, and a pair of lock pawls 304 installed at both widthwise ends of the connecting part 303, each lock pawl 304 having an end protruding toward the downstream side. The base of each lock pawl 304 is rotatably coupled to the respective rising plate, 286 or 287, with a pin. A cylindrical part 305 is integrally formed on the portion of the connecting part 303 that extends outwardly of the rising plate 286, and a spring member 306 is integrally fixed to the cylindrical part 305. As shown in FIGS. 45 and 46, the spring member 306 is formed first extending toward the downstream side along the horizontal direction in FIG. 46 and then bent curving upward. Near the downstream side of the loading tray 84, there is formed a quarter-circular recessed guide face 337 facing toward the downstream side. The guide face 337 forms a part of the inverting path 36 described in connection with FIG. 1.

(11) Description of the lock mechanism 92

Figure 49:
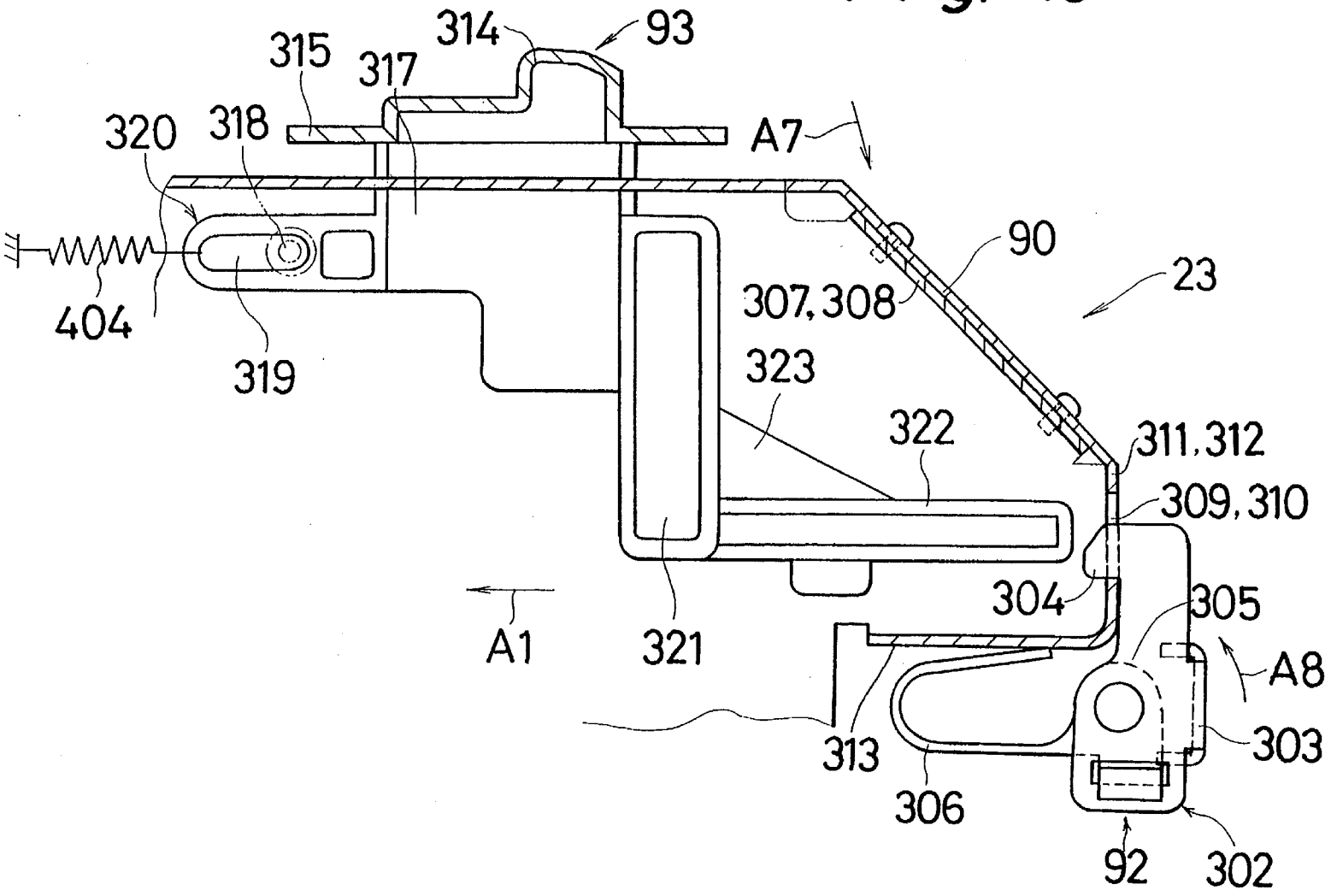
FIG. 49 is an enlarged front sectional view taken along line XLIX—XLIX in FIG. 50, showing an end portion of the upper housing.
Figure 50:
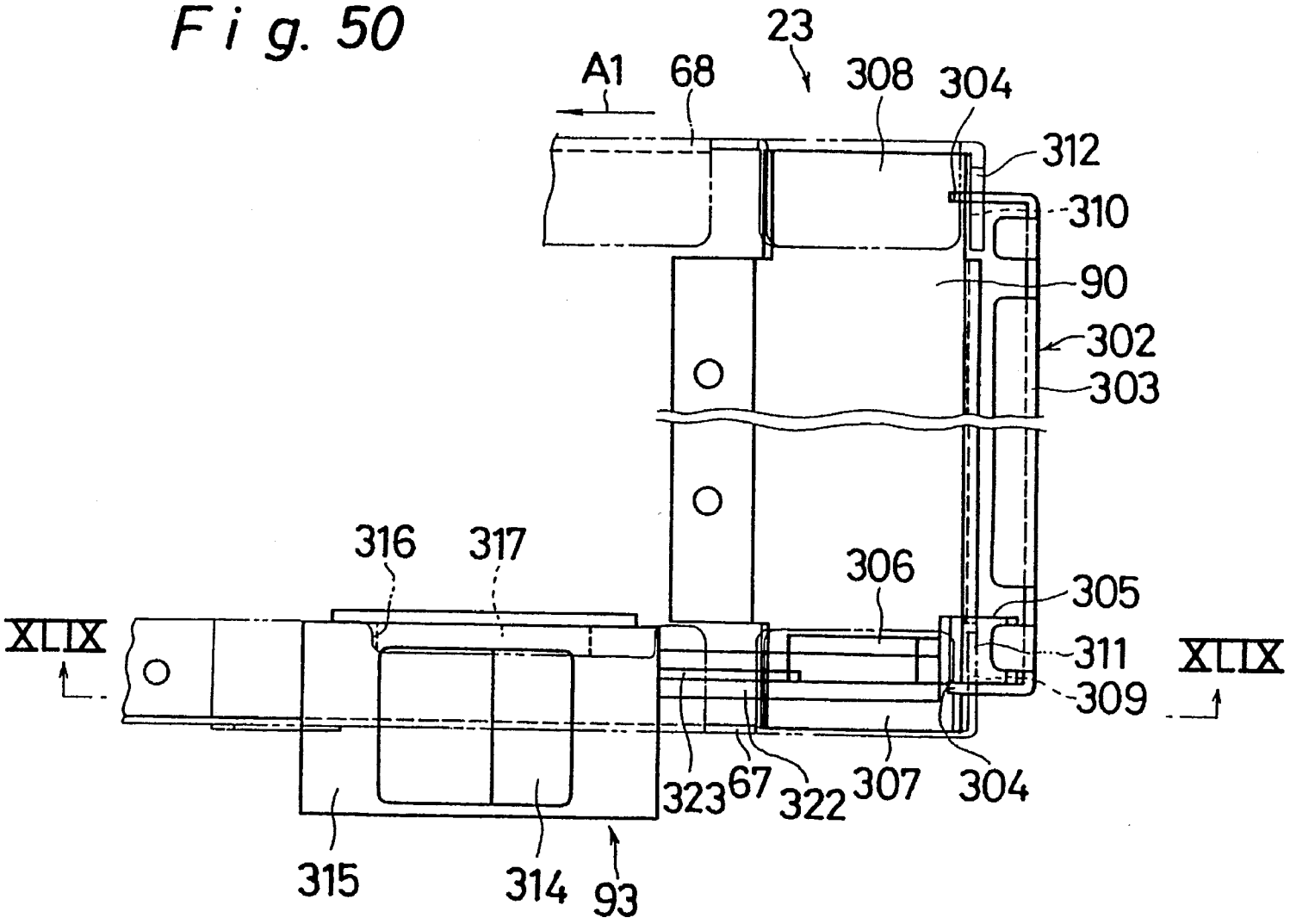
FIG. 50 is a plan view of the portion shown in FIG. 49.
Figure 51:
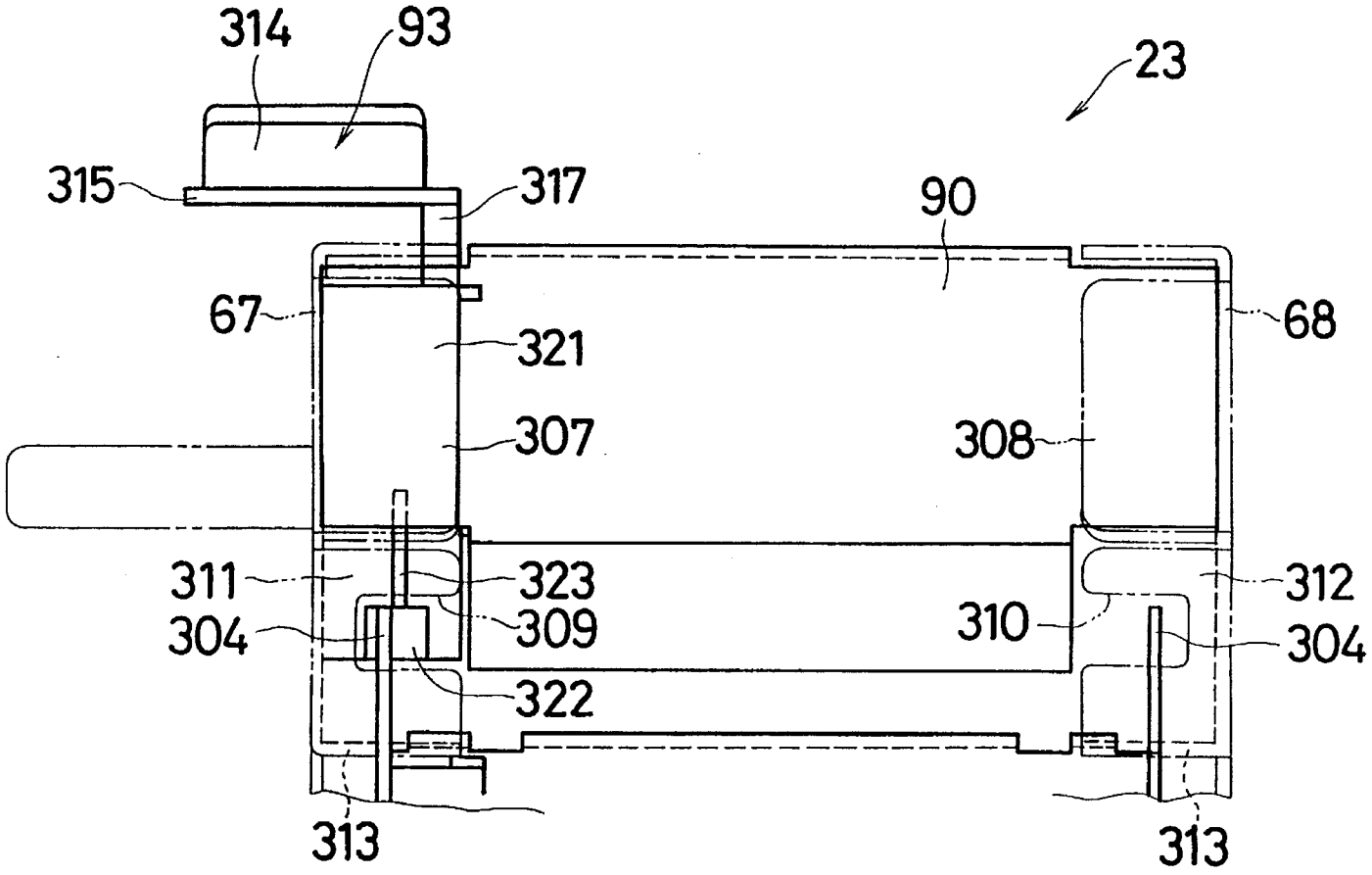
FIG. 51 is a right side view of the portion shown in FIG. 49.
Figure 52:
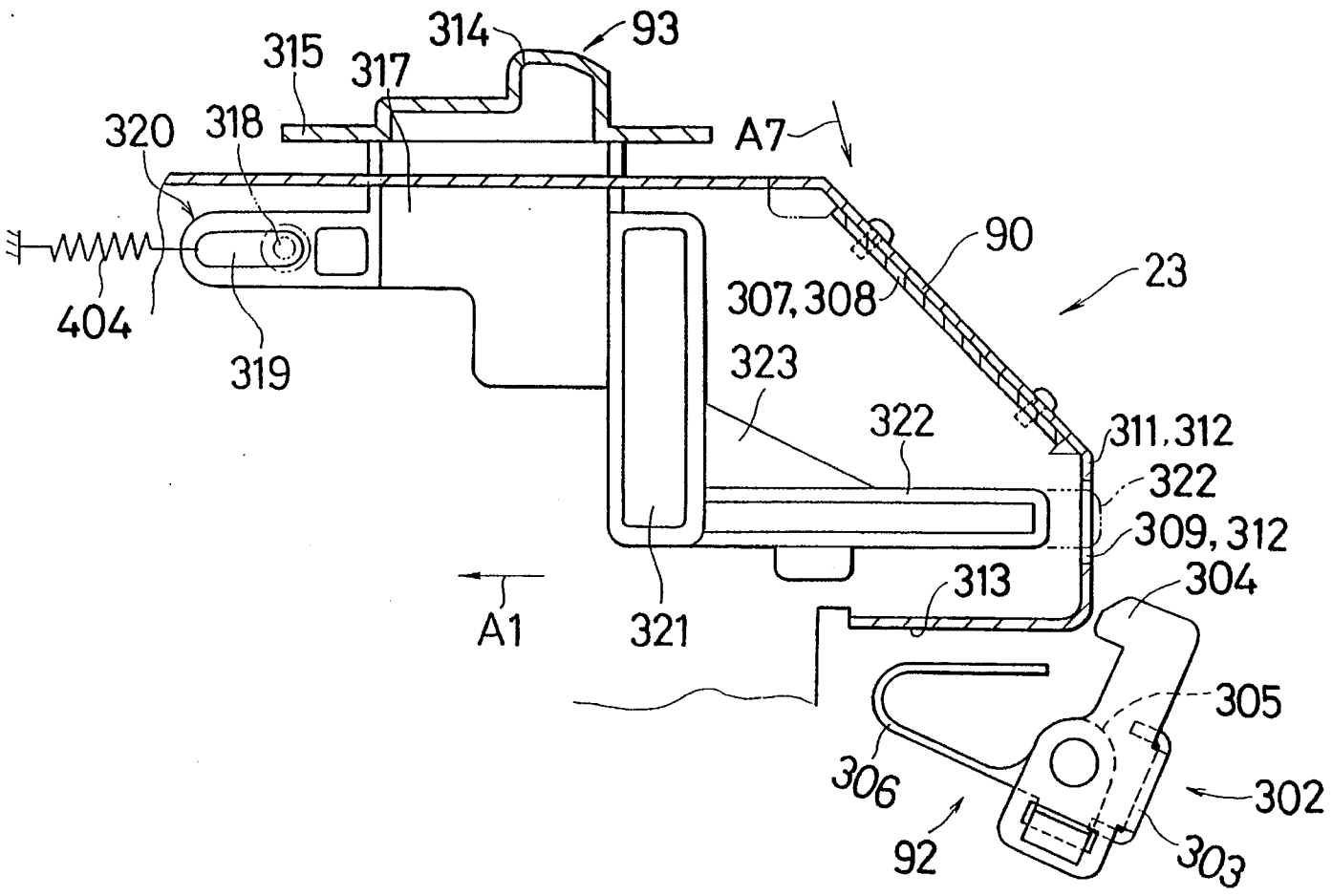
FIG. 52 is a front view illustrating the operation of a lock mechanism.

FIG. 49 is an enlarged sectional front view in elevation showing a portion of the upper housing 23 in the vicinity of the upstream end thereof, FIG. 50 is a plan view of the portion shown in FIG. 49, FIG. 51 is a right side view of the portion shown in FIG. 49, and FIG. 52 is a front view, with a portion taken apart, illustrating the operation of the lock mechanism 92. The upper portions of the side frames 67 and 68 of the upper housing 23, at the upstream ends thereof, are bent in facing directions to form mounting pieces 307 and 308. A front end frame 90 is attached to the mounting pieces 307 and 308. The lower portions of the side frames 67 and 68, at the upstream ends, thereof are bent in facing directions to form engaging parts 311 and 312 which are respectively provided with cutouts 309 and 310. The lower parts of the engaging parts 311 and 312 are curved inwardly (rearwardly of the plane of FIG. 52) to form flat pressure plates 313.

As described previously, the lock mechanism 92 is mounted on the manual feed device 83. When the upper housing 23 is turned in the direction of arrow A7 of FIGS. 49 and 52, about the shaft 24 shown in FIG. 1, the pressure plates 313 on the upper housing 23 press the spring members 306 from above. This causes the lock member 302 to turn in the direction of arrow A8 around the axis of the cylindrical part 305 under the spring force of the spring members 306, so that the lock pawls 304 are fitted into the cutouts 309,310 of the engaging parts 311, 312, to hold them in engagement. This engagement is accomplished by pressing the upper housing 23 from above to cause the spring members 306 to bend further, thereby increasing the spring force of the spring members 306 and thus engaging the lock pawls 304 on the lock member 302 into the cutouts 309, 310.

The lock release member 93 is provided to unlock the locked lock member 302 from the engaging parts 311, 312.

The lock release member 93 is of integral construction and includes an upwardly curving grip part 314 protruding above the upper housing 236, a rectangular shaped plate part 315 larger than the grip part 314, and a connecting part 317 extending downwardly from the inner side of the plate part 315, i.e., from the right side thereof as viewed facing FIG. 51, and having a shorter length along the transporting direction A1 than the length of an elongated hole 316 formed along the transporting direction A1 in the upper end of the upper housing 23. A guide part 320 extends downstream from the connecting part 317 and has an elongated hole 319 in which a pin 318 formed on the side frame 67 is slidably engaged, thus limiting the movement of the lock release member 93 in horizontal directions as viewed facing FIG. 49. A connecting member 321 is formed on the upstream side of the connecting part 317 and is elongated vertically as viewed facing FIG. 49. A pressure member 322 extends from the lower end of the connecting member 321 toward the direction opposite to the transporting direction A1, the endmost portion of the pressure member 322 being made to press the lock pawl 304 to release the engaged condition with the cutouts 309,310 or being held in non-contacting relationship with the lock pawl 304. A rib 323 is formed extending between the connecting member 321 and the pressure member 322.

The grip part 314 of the lock release member 93 is exposed above the upper case of the LED printer 21. When the grip part 314 is moved in the direction opposite to the direction A1, the endmost portion of the pressure member 322 is made to press the lock pawl 304 and turn it in the direction opposite to the direction A8. On the other hand, when the grip part is released, the grip part moves in the direction A1 to return to its original position by the spring force of a return spring 404.

(12) Description of carrier seal construction

Figure 53:
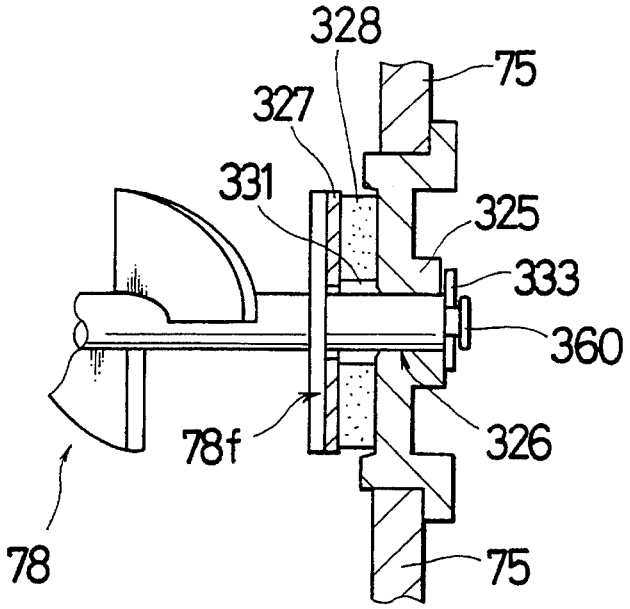
FIG. 53 is a cross sectional view explaining a carrier leak prevention construction associated with a shaft of an agitator.

FIG. 53 is a cross sectional view of the shaft 360, and its adjacent area, of the agitator 78 mounted in the process cartridge 73 shown in FIGS. 21 and 22. This embodiment presents a construction for preventing leakage of the carrier contained in the vicinity of the agitator 78 in the process cartridge 73. The housing 75 of the process cartridge 73 has a slide bearing 325 that supports the shaft 360 at a position where the shaft 360 passes through the housing wall. The slide bearing 325 has a small bore portion 326 through which the shaft 360 is passed. On an inside surface encircling the bore portion 326, a cylindrical sponge ring 328 and an annular magnetic piece 327 are bonded concentrically in this order in the inward direction of the housing 75.

A flange part 78*f* is integrally formed with the agitator 78 at a position facing the magnetic piece 327 so that the thrust faces of the magnetic piece 327 and flange part 78*f* are caused to slide relative to each other. The sponge ring 328 has a slightly larger thickness than its mounting space so that it is assembled into position in a condition compressed in the thrust direction. The resilience of the sponge acts to press the magnetic piece 327 against the flange part 78*f* with an appropriate force. If the developer in the housing 75 is to pass through the bearing part, it must pass through microscopic gaps caused by fine irregularities on the surfaces of the flange part 78*f* and magnetic piece 327. In this embodiment, carrier is attracted by the magnetic force of the magnetic piece 327, thereby forming a so-called magnetic brush and thus preventing leakage of the carrier contained in the process cartridge 73.

(13) Description of the waste toner box 99

Figure 54:
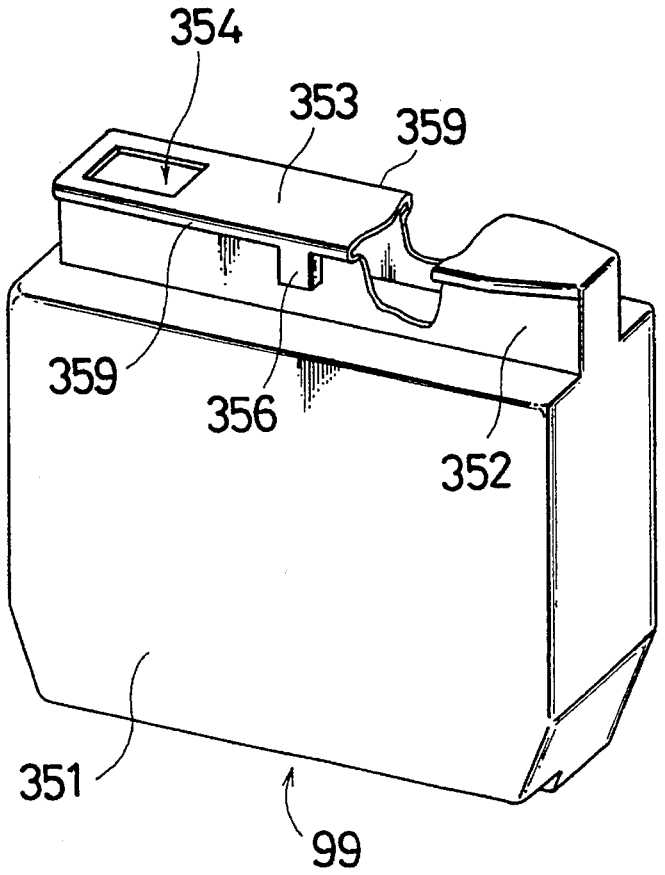
FIG. 54 is a perspective view of a waste toner box.
Figure 55:
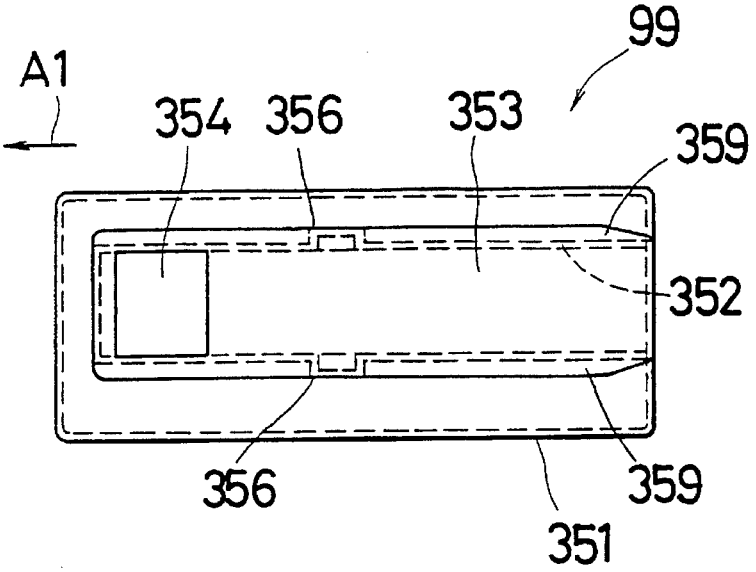
FIG. 55 is a plan view of the waste toner box.
Figure 56:
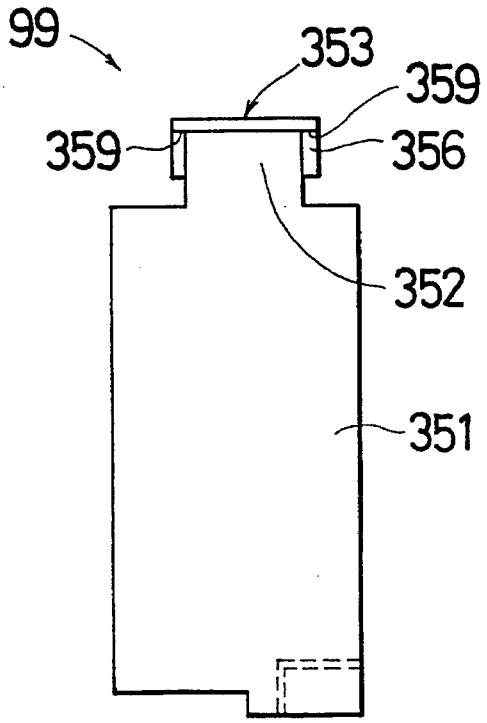
FIG. 56 is a right side view of the waste toner box.

FIG. 54 is a perspective view of the waste toner box 99, FIG. 55 is a plan view of the waste toner box 99, and FIG. 56 is a right side view of the waste toner box 99. The waste toner box 99 is formed from plastic material, and has an integral construction comprising a box-like body 351, a neck 352 protruding upwardly from the upper end of the box-like body 351 and having a width smaller than the width of the box-like body 351 as measured in the vertical direction in FIG. 55, and a cover 353 that covers an open end of the neck 352. The cover 353 includes an opening 354 formed therein, projecting portions 359, formed where the cover 353 joins the neck 352, and projecting outwardly of the neck 352 in width directions; and engaging portions 356 formed essentially centrally along the longitudinal direction of the cover 353 and extending downward from both widthwise ends thereof.

The total distance from the upper end of the cover 353 to the lower end of the engaging portions 356 is chosen approximately equal to the distance from the lower end of the connecting portion 144 of FIG. 14, which connects the projections 146*a*, 146*b* and 147*a*, 147*b* shown in FIGS. 14 and 15, to the upper end of the projections 146*a*, 146*b*, 147*a*, 147*b*. The width of the cover 353, including the projecting portions 359 and measured in the vertical direction in FIG. 55, is chosen approximately equal to the distance between the facing projections 146*b* and 147*b* in FIG. 14.

(14) Description of the sub-agitator 162

Figure 57:
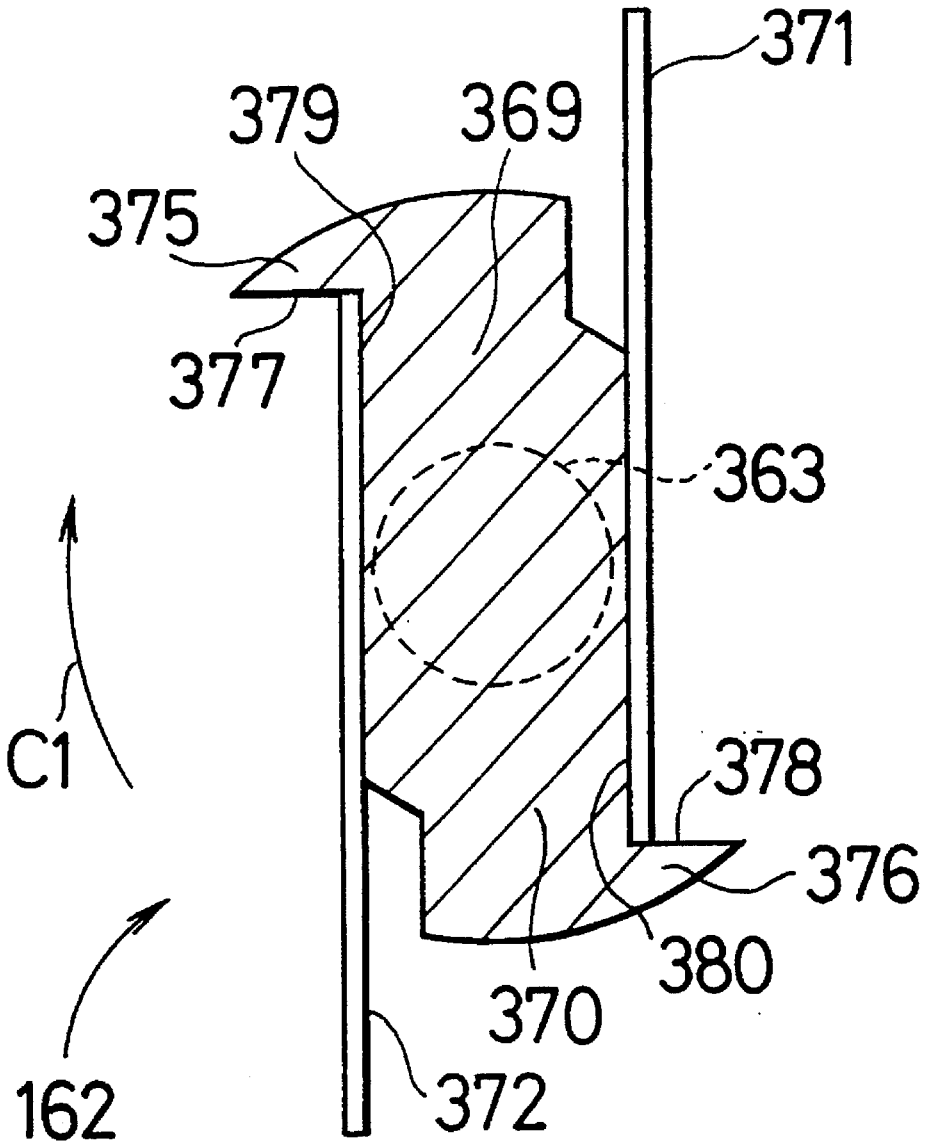
FIG. 57 is a cross sectional view of the sub-agitator.

FIG. 57 is a cross sectional view of the sub-agitator 162. The sub-agitator 162 has an integral construction comprising a shaft 363 mounted along the width of the housing 75 of the process cartridge 73, and legs 369 and 370 extending in radially opposite directions from the shaft 363. Mounting faces 379 and 380 are formed on the respective side faces of the legs 369 and 370, and mylar films 371 and 372 are bonded to the mounting faces 379 and 380, respectively. The legs 369 and 370 include mounting portions 375 and 376 integrally formed with their respective ends and extending upstream of rotating direction C1 of the sub-agitator 162, the radially outermost portions of the mounting portions 375 and 376 being formed in an arc shape that matches the shape of the inner circumference of the housing 75 near the sub-agitator 162.

The faces of the mounting portions 375 and 376 on the upstream side of the rotating direction C1 serve as flat positioning faces 377 and 378, respectively, each face being in a plane perpendicular to the directions of extension of the legs 369 and 370.

When mounting the rectangular mylar films 371,372 on the mounting faces 379, 380, the ends of the mylar films 371, 372 are positioned against the positioning faces 377, 378, and the respective end portions are bonded to the mounting faces 379, 380, with an adhesive, for example. Thus, the mylar films 371, 372 can be easily positioned for mounting.

(15) Description of the electrical configuration

Figure 58:
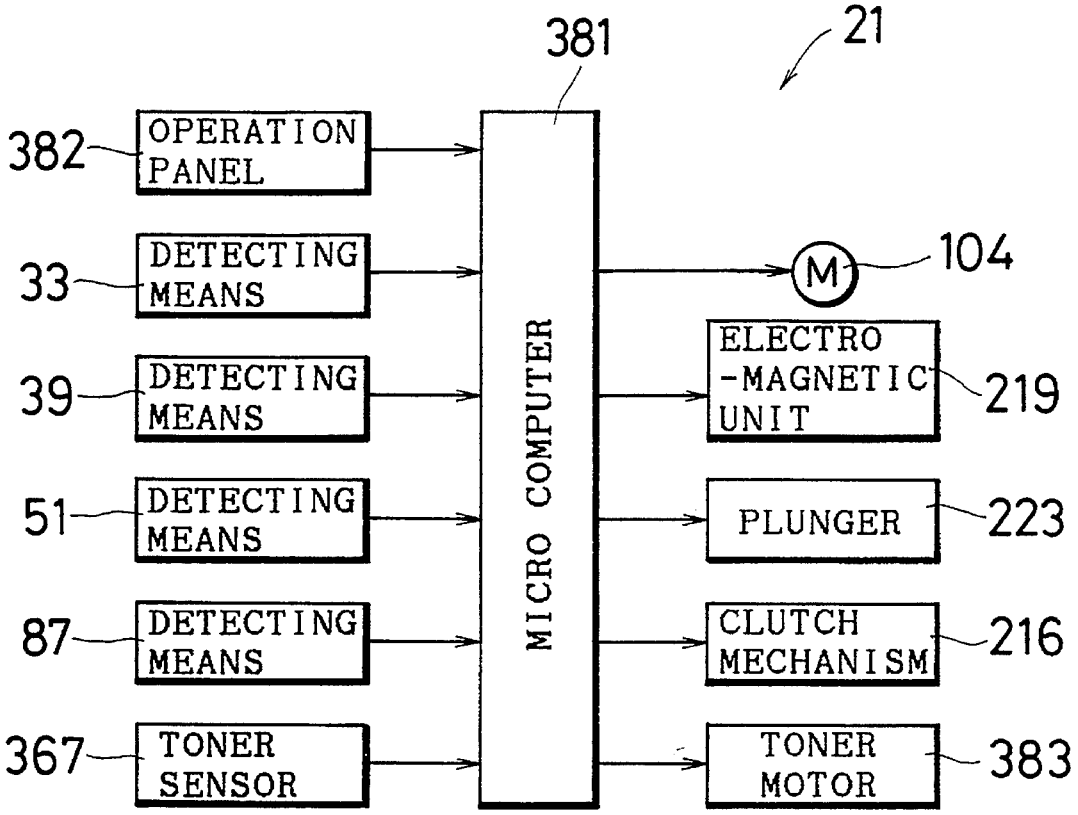
FIG. 58 is a block diagram of the LED printer.

FIG. 58 is a block diagram showing the electrical configuration of the LED printer 21. The LED printer 21 is provided with a microcomputer 381 for controlling various operations of the printer. Connected to the microcomputer 381 are an operation panel 382 for controlling electrophotographic processing operations, the detecting means 33, 39, 51, and 87, and the toner sensor 367 for detecting the toner density in the process cartridge 73. Output terminals of the microcomputer 381 are connected to the motor 104, electromagnetic unit 219, electromagnetic plunger 223, toner motor 383, and clutch mechanism 216.

The operation of the present embodiment will now be described below.

(1) Opening and closing of the upper housing 23

Figure 59A:
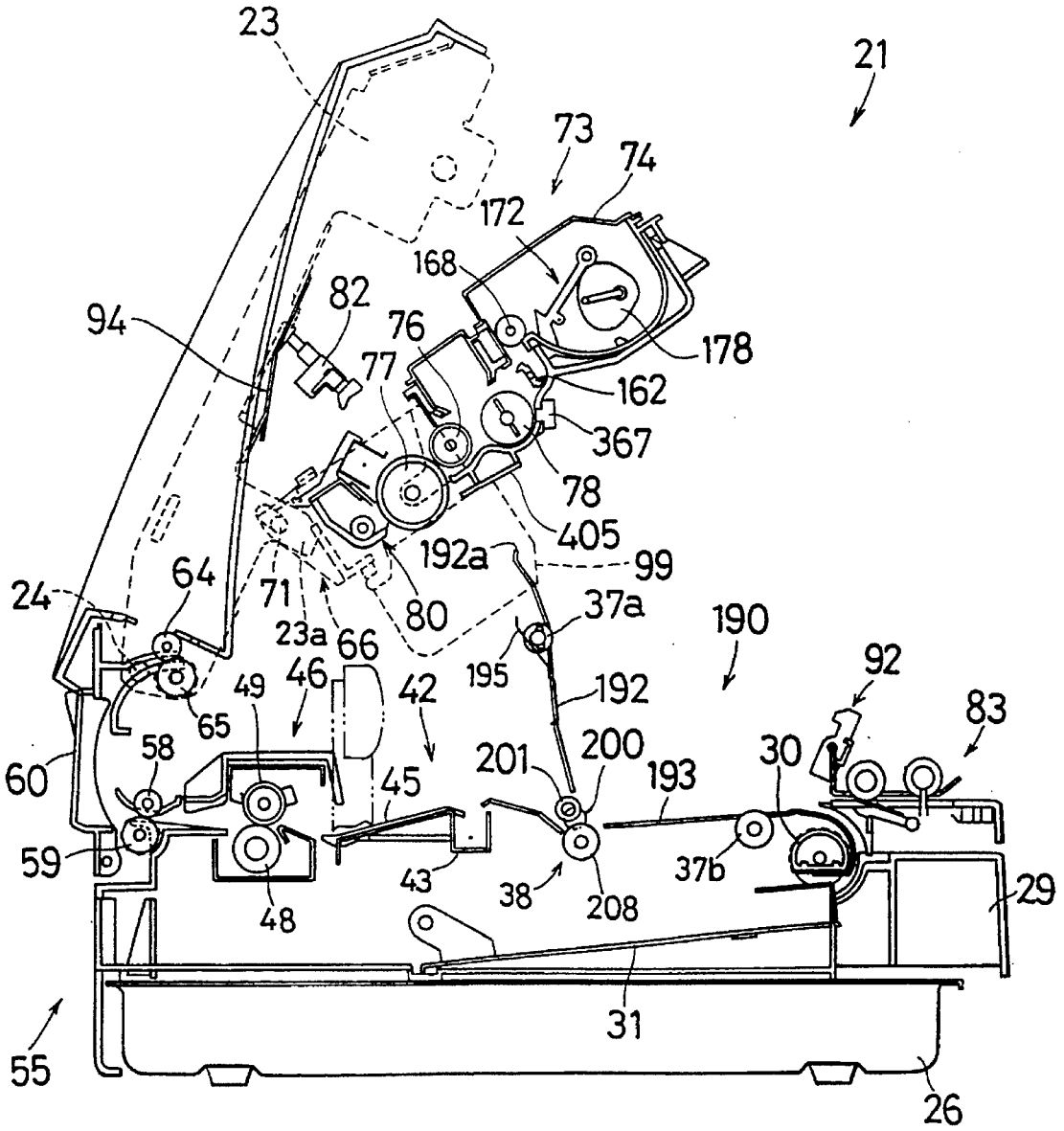
FIG. 59A is a front view of the LED printer with an upper guide member opened.
Figure 60:
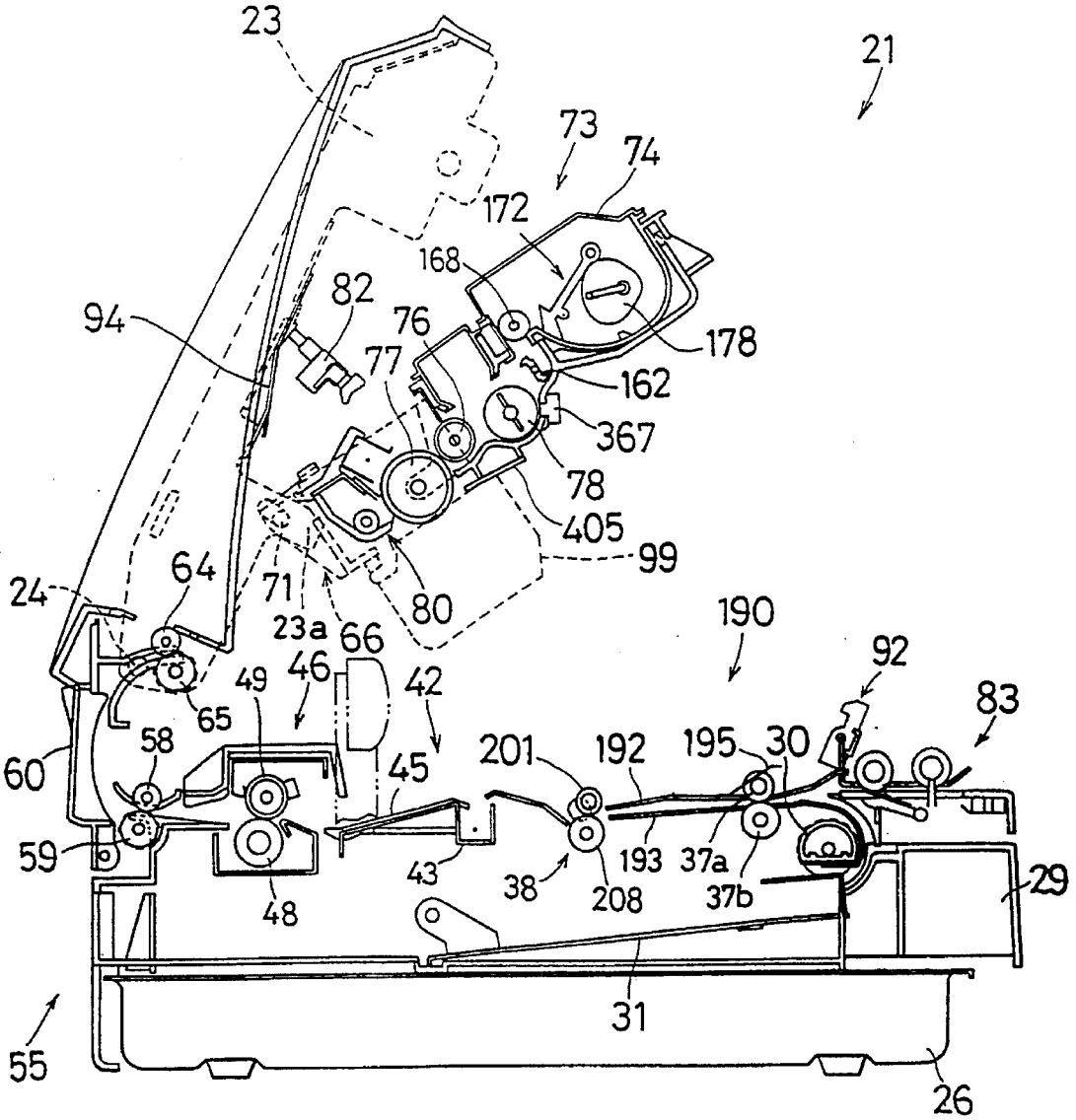
FIG. 60 is a front view of the LED printer with the upper guide member closed.

FIGS. 59A and 60 show the upper housing 23 mounted on the lower housing 22 in swingable fashion about the support shaft 24. The upper housing 23, when closed on the lower housing 22, is locked in position using the lock mechanism 92. In the upper housing 23, the support member 66 with the waste toner box 99 mounted thereon is installed swingably at the support shafts 71, 72, and the process cartridge 73 with the toner box 74 mounted thereon is mounted on the support member 66. When the upper housing 23 is set in its open position, the support member 66 is held in its maximum angularly displaceable position in the clockwise direction in FIG. 1 and thus rests at an angle relative to the upper housing 23. The LED array 82 is mounted to the upper housing 23 by means of the mounting member 94 and is therefore separated from the process cartridge 73.

When closing the upper housing 23, the upper housing 23 resting in its open position is pressed downward and turned about the support shaft 24 in the clockwise direction in FIG. 1. As the upper housing 23 is turned, the guide piece 137 on the support member 66 hits the guide face 335 of the guide member 334 (FIGS. 12). The guide face 335 is formed in an essentially arced shape protruding in the direction opposite to the transporting direction A1. The guide piece 137 is guided along the arc of the guide face 335. When the upper housing 23 has been turned through a prescribed angle toward its closed position, the support member 66, and hence the process cartridge 73, is maintained in an essentially horizontal position with the guide piece 137 engaging the guide face 335.

In this situation, when the upper housing 23 is further turned, the shaft 336 of the photoconductor drum 77, which protrudes in widthwise direction from both sides of the process cartridge 73 mounted on the support member 66, hits the sloping portion 121 of the lock piece 120 provided in the lower housing 22, as shown in FIG. 12. The shaft 336 presses the sloping portion 121 to turn the lock piece 120 in the counterclockwise direction B1 in FIG. 11. As a result, the shaft 336 is engaged in the clearance recess 122 of the lock piece 120 and the positioning groove 119 formed in the lower housing 22.

The lock piece 128 provided on the rear side of the lower housing 22 operates in the same manner as above. When the upper housing 23 is pressed further downward, the support member 66 is caused to move upward along the elongated holes 69, 70 and rests in position with the support shafts 71, 72 contacting the respective upper ends of the elongated holes 69, 70.

At this time, the stop pieces 124, **124*a* of the lock pieces 120, 128 are pressed downward from above by the plate springs 100*a*, 100*b* provided on the side frames 67, 68, thus preventing further angular displacement in the direction B1 shown in FIG. 11. In this situation, the upper housing 23 is maintained in locked position by the lock piece 120, with the support member 66, and hence the process cartridge 73, engaged by the positioning grooves 119, 120 of the lower housing 22. In this condition, the process cartridge 73 presses the plate springs 195 of the transport device 190** from above, and is therefore urged upward by the spring force of the plate springs.

When the upper housing 23 is closed, the lock mechanism 92 activates as described with reference to FIGS. 49 and 52. That is, as the upper housing 23 is turned toward its closed position, the pressure plates 313 on the upper housing 23 press the spring members 306 of the lock mechanism 92 from above. At this time, the pair of lock pawls 304 provided near the widthwise ends of the lock mechanism 92 are positioned facing the cutouts 309, 310 formed in the engaging parts 311, 312 provided at the upstream end of the upper housing 23. The spring force of the spring members 306 causes the lock pawls 304 to turn in the direction A8 around the axis of the cylindrical part 305, thereby engaging the lock pawls 304 into the cutouts 309,310. Thus, the upper housing 23 is locked to the lower housing 22.

When the upper housing 23 is closed, the process cartridge 73 is urged upward by the spring force of the plate springs 195 provided on the transport device 190, as described above. By further pressing the upper housing 23 against the spring force, the lock mechanism 92 is activated to lock the upper housing 23 in position. As described previously, a number of gears are mounted on the side of the process cartridge 73, as shown in FIGS. 19 to 22. Among these gears, the gear 339 fixed to the photoconductor drum 77 becomes engaged with the gear 113 mounted on the lower housing 22 shown in FIG. 11, thus allowing power to be transmitted to the gears mounted on the process cartridge 73.

As described above, when the upper housing 23 is closed, the gear 339 on the process cartridge 73 is brought into contact with the gear 113. If, at this time, the gears 113 and 339 clash with a large impact, the gear teeth may break or a large sound may be caused, resulting in degradation of operating performance. In this embodiment, however, since the process cartridge 73 is urged upward by the plate springs 195, the gears 113 and 339 can be brought into engagement slowly, thus preventing the occurrence of tooth breakage or other trouble.

To open the upper housing 23, first the lock mechanism 92 is unlocked. When the lock release member 93 is moved in the direction opposite to the transporting direction A1, the endmost portion of the pressure member 322 of the lock release member 93 is made to press the lock pawl 304 on the nearer side of the lock mechanism 92, i.e., in the lower part of FIG. 49, which causes the lock member 302 to turn in the clockwise direction in FIG. 49. At this time, the upper housing 23 is held upwardly urged by the spring members 306 as well as by the plate springs 195 on the transport device 190. Therefore, when the lock pawls 304 are turned, the lock pawls 304 become disengaged from the engaging parts 311 and 312. As a result, the upper housing 23 is allowed to turn in the counterclockwise direction in FIG. 1 about the support shaft 24 by the spring force of the spring members 306 as well as of the plate springs 195 provided on the transport device described with reference to FIGS. 26 to 28.

When the upper housing 23 is turned in the counterclockwise direction in FIG. 1 about the support shaft 24, the plate springs **100*a*, 100*b* are disengaged from the stop members 124, 124*a*. This allows the lock pieces 120, 128 to turn in the direction B1 in FIG. 11, so that the positioning grooves 122, 122*a* in the lock pieces 120, 128 are now positioned facing upward, thus disengaging the shaft 336 of the photoconductor drum 77 and allowing it to move upward. Thus, the upper housing 23, and the support member 66 with the process cartridge 73 mounted thereon, are disengaged from the lower housing 22 and opened by being turning about the support shaft 24**.

At this time, the shafts 71, 72 of the support member 66 are rested against the lower ends of the elongated holes 69, 70, and in this condition, the support member 66 is held in open position, resting in the upper housing 23 at an angle in the vicinity of the portion thereof where the elongated holes 69, 70 are formed.

As described, since the process cartridge 73 is separated from the upper housing 23 when opened, the process cartridge 73 can be easily mounted on or detached from the support member 66.

Figure 59B:
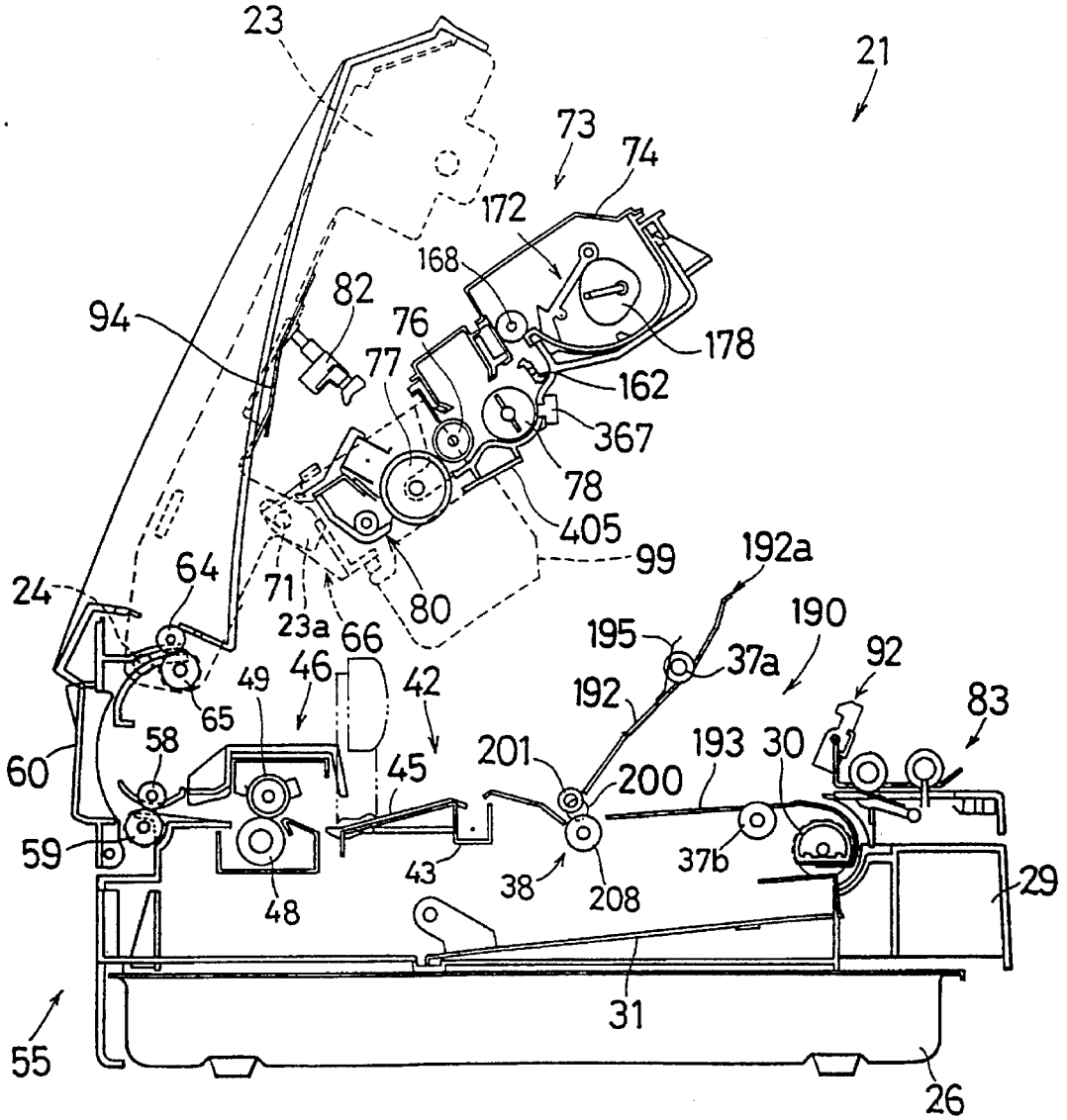
FIG. 59B is a front view of the LED printer with the upper guide member opened at an opening angle less than 90 degrees.

FIG. 59A shows the condition in which the upper guide member 192 described with reference to FIGS. 26 to 29 is turned upward and rests at a point within its range of angular displacement. In this condition, if the upper housing 23 is turned toward the lower housing 22, the receiver plate 405 provided on the underside of the process cartridge below the developing roller 76 comes closer to and then hits the end portion 192*a* of the upper guide member 192. As a result, the upper housing 23 stops at that position, thus preventing the process cartridge from being damaged by hitting against the upper guide member 192. Furthermore, as shown in FIG. 59B, the rotation limiting portion 204*a* may be formed at such a position as shown in FIG. 29B, whereby the upper guide member 192 can open upward at an opening angle less than 90 degrees relatively to the lower guide member 193 when the upper guide member 192 is supported by a user's hand. Accordingly when the user closes the upper housing 23 to the lower housing 22 in such condition, the upper guide member 192 losing the support of the user is likely to close toward the lower guide member 193 by its own weight, thereby also preventing the process cartridge from being damaged by hitting against the upper guide member 192.

On the other hand, as described previously, the waste toner box 99 shown in FIGS. 54 to 56 is mounted on the mounting member 140 provided at one widthwise end of the support member 66, i.e., at the upper end in FIG. 5. This construction serves to prevent the waste toner from falling inside the machine when the upper housing 23 is opened or closed, which may be contrasted, for example, with a construction in which the waste toner box 99 is mounted on the lower housing 22 so that the waste toner supply opening in the waste toner box 99 or the waste toner discharge opening in the cleaning device 80 becomes exposed every time the upper housing is opened or closed.

(2) Printing on recording paper

The paper cassette 29 is inserted from the upstream side and installed onto the partition plate 27, as shown in FIG. 1. The lift plate 31 inside the paper cassette 29 is urged upward by spring force, as previously described, so that the upstream side of the recording paper stack is lifted and held in close proximity to the paper feed roller 30. When no recording paper is placed on the manual feed device 83, the detecting means 87 shown in FIGS. 45 to 48 is not activated, and therefore, the electromagnetic plunger 223 shown in FIGS. 30 to 32 remains unenergized. As a result, the driving lever 222 remains urged in the clockwise direction in FIG. 32 by the spring force of the spring 240 so that power is not transmitted to the gear 293 shown in FIG. 46.

At this time, the motor 11 shown in FIG. 11 continues to run, and the electromagnetic unit 219 is intermittently energized, thus intermittently unlocking the engaging part 235 of the armature 220 from the engaging pawl 245 and transmitting the rotation of the motor 104 to the paper roller 30 intermittently. Accordingly, the recording paper is delivered from the paper cassette 29, one sheet at a time, as the rotation is transmitted to the paper feed roller 30.

The recording paper delivered from the paper cassette 29 is passed through the inverting path 36 formed by the guide member 338 of the transport device 190, the guide face 337 of the manual feed device 83, etc. The recording paper, the traveling direction of which has been inverted toward the left side of FIG. 1, then travels in the transporting direction A1 through the transport path between the upper guide member 192 and the lower guide member 193 of the transport device 190 until it reaches the transport rollers 37. With two revolutions of the paper feed roller 30, the leading edge of the recording paper reaches the transport rollers 37, after which the recording paper is fed by the rotation of the transport rollers 37. The recording paper traveling through this transport path is detected by the detecting means 39 installed on the upstream side of the resist roller 38. The recording paper delivered from the paper cassette 29 is further transported until the leading edge of the paper is caught and buckled by the resist rollers 38 which are in the quiescent condition. At this instant, that is, when a prescribed time has elapsed after the activation of the detecting means 39, allowing sufficient buckling of the paper, the motor 104 stops running and the transportation of the recording paper is therefore stopped. The recording paper is thus placed on standby, waiting for the reception of image data from the host computer, etc., and for the formation of an electrostatic latent image on the photoconductor drum from the image data. When a restart instruction is given, the clutch mechanism 216 shown in FIG. 26, provided for the resist roller 38, is activated to transmit the rotation of the motor 104 to the driving roller 208, so that the recording paper is transported by the rotation of the resist rollers 38 to the transfer area 247 between the photoconductor drum 77 and the transfer device 42.

The LED array 82 mounted to the upper housing 23, as previously described, is supplied with print data from an external computer, word processor, etc. connected to the LED printer 21, and emits light corresponding to the print data, to illuminate the photoconductor drum 77. The surface of the photoconductor drum 77 is uniformly charged by the charge unit 81, and the illumination by the light forms an electrostatic latent image on the photoconductor surface. Toner is applied to the photoconductor drum 77 by the developing roller 76 of the process cartridge 73 to convert the electrostatic latent image into a toner image. The toner image is then transferred to the recording paper by the transfer device 42. After transfer, the toner remaining on the surface of the photoconductor drum 77 is removed by the cleaning device 80.

After transfer, the recording paper is fed to the fixing device 46 where fixing of the toner image is performed by heating the recording paper pressed between the pressure roller 48 and the heating roller 49 as the paper is transported downstream. After fixing, the recording paper is caught between the pair of paper discharge rollers 58, 59 for transportation further downstream. When the rear cover 60 on the rear unit 55 is open, the recording paper is discharged outside the printer through the opening 101. On the other hand, when the rear cover 60 is closed, the recording paper is guided upward along the inverting member 62 provided in the rear unit 55, through which the traveling direction of the paper is inverted toward the upstream side of the transporting direction A1. The recording paper is then caught between the paper discharge rollers 64, 65 and finally discharged onto the stacker 63 mounted between the side frames 67 and 68 of the upper housing 23.

When all the recording paper sheets in the paper cassette 29 have been fed, the detection lever 34 provided on the transport device 190 turns downward through the through-hole formed in the lift plate 31, and the absence of recording paper is detected by sensing this motion of the detection lever 34. On the other hand, when a recording paper is loaded on the loading tray 84 of the manual feed device 83, the detection lever 88 of the detecting means 87 is turned sideways by the recording paper, and this movement of the detection lever 88 is detected by the photosensor 89. In response, the electromagnetic unit 219 of the transport device 190 is deenergized, and the electromagnetic plunger 223 is energized.

As a result, the rod 224 is pulled, and the driving lever 222 is turned in the counterclockwise direction in FIG. 27, so that the gear 214 is brought into engagement with the gear 293 in the manual feed device 83 and power is transmitted to the gears 296 and 297 to transport the recording paper on the loading tray 84 toward the transport rollers 37. The operation thereafter is the same as that described above in connection with the copying operation for the recording paper fed from the paper cassette 29.

Toner is supplied to the developing roller 76 of the process cartridge 73 from the toner box 74 housed in the housing section 160 of the process cartridge 73.

Referring back to FIG. 25 showing the toner box 74, the rotation of the toner motor 383 is transmitted to the gear 347 connected to the driving cam 178 to rotate the driving cam 178 in the direction A3 in FIG. 25. This rotation is converted to the reciprocating motion of the toner moving member 172 in the direction A4 so that toner in the toner box 74 is distributed to the toner supply roller 168. With the rotation of the toner supply roller 168, the toner falls through the toner supply port 167 of the toner box 74 toward the agitator 78.

The toner falling through the toner supply port 167 first falls onto the sub-agitator 162 that is rotating in the direction C1, and carried into the space between the sub-agitator 162 and the inner wall 75*a* of the housing 75. Since the mylar films 371, 372 bonded to the sub-agitator 162 are radially long enough to reach the inner wall 75*a* of the housing 75, the end portions of the mylar films 371, 372 are caught by the inner wall 75*a* and bent in the direction opposite to the rotating direction C1 of the sub-agitator 162, thus carrying the toner along the wall. When the mylar film, 371 or 372, comes to the position opposite the agitator 78, the end portion thereof is released from the wall and resiliently returns to its original position. This action of the mylar film causes the toner carried thereon to scatter widely toward the agitator 78, thereby distributing the supplied toner uniformly throughout the developing chamber. This helps improve the efficiency of the subsequent toner agitation significantly.

(3) Removal and installation of the process cartridge 73

When the toner in the toner box 74 is used up, or when the photoconductor drum 77 has run out of its service life, for example, the process cartridge 73 will have to be removed from the LED printer 21 and installed again in the printer. For the removal and installation of the process cartridge 73, the lock mechanism 92 is unlocked to open the upper housing 23, as described in "Opening and closing of the upper housing 23." When the upper housing 23 is opened, the support member 66, and hence the process cartridge 73 mounted on the support member 66, rests in position at a prescribed angle relative to the upper housing 23.

The process cartridge 73 is held on the support member 66 with the projections 164 on the process cartridge 73 maintained in engagement with the engaging pawls 156 and 157 shown in FIG. 15, etc. This engagement prevents the process cartridge 73 from easily coming off the support member 66. The engagement is maintained by the elasticity of the plate-like plastic engaging pieces 154 and 155 on which the engaging pawls 156 and 157 are formed. To disengage the projections 164 from the engaging pawls 156 and 157, the toner box side of the process cartridge 73 is lifted upward thereby turning the downstream side of the process cartridge 73 downward. The process cartridge 73 can thus be removed from the support member 66.

When the toner in the toner box 74 is used up, the toner box 74 is removed from the housing section 160 of the process cartridge 73, and a new toner box 74 is installed in the housing section 160. In the toner box 74, the driving cam 178 is mounted on the shaft 177 that protrudes from the rear side of the toner box 74, i.e., rearwardly of the plane of FIG. 25, and at the end of the shaft 177 is mounted the gear 347. Therefore, when the shaft 177 is fitted into the cutout 161 (see FIG. 22) formed in the housing section 160 of the process cartridge 73, the gear 347 is set in engagement with the gear 346 so that power can be transmitted.

The process cartridge 73 with the new toner box 74 installed therein is fitted onto the support member 66, with the photoconductor drum side facing the support member 66. As shown in FIG. 59A, the LED array 82, mounted to the upper housing by means of the mounting member 94, is exposed with its end facing downward. However, since the support member 66 and the process cartridge 73 mounted thereon are rested at a prescribed angle relative to the upper housing 23 when the upper housing 23 is opened, as described previously, the LED array 82 is separated from the support member 66 and the process cartridge 73, and therefore does not interfere with the work of detaching the process cartridge 73 from or mounting it on the support member 66.

When the process cartridge 73 is fitted onto the support member 66, one of the shafts 336 on the process cartridge 73, i.e., the shaft 336 located in the lower side of FIG. 19, is guided into the elongated groove 135 formed in the support member 66, while the other shaft 336, i.e., the shaft 336 located in the upper side of FIG. 19, is rested on the connecting portion 143 of the support member 66. On the other hand, the projections 164 on the process cartridge 73 pass below the curved portions 158, 159 and engage with the engaging pawls 156, 157 by pushing the engaging pieces 154, 155 upward. The process cartridge 73 is thus prevented from easily coming off the support member 66.

(4) Removal of jammed paper

In an electrophotographic apparatus, paper jam occurs, in many cases, at positions where the recording paper is caught between rollers for transportation, where the recording paper changes its traveling direction, and so on. In the LED printer 21 shown in FIG. 1, such positions include the vicinity of the paper feed roller 30 where the recording paper is removed from the paper cassette 29, the vicinity of the transport rollers 37, the vicinity of the resist rollers 38, the vicinity of the transfer device 42, the vicinity of the fixing device 46, and the rear unit 55. Suppose that a paper jam has occurred in the inverting path 36 in the vicinity of the paper feed roller 30. Then, the upper housing 23 is opened, as described previously, to expose the upper guide member 192 of the transport device 190.

As previously described, the upper guide member 192 is swingably connected to the lower guide member 193 at a position adjacent to the resist rollers 38. Therefore, when the exposed upper guide member 192 is lifted upward, the lower guide member 193 is exposed. If the recording paper is lying somewhere on the lower guide member 193 between the paper feed rollers 30 and the resist rollers 38, the condition can be clearly recognized, and therefore, the jammed paper can be easily removed. Here, it should be noted that the upper guide member 192 is rested in open position to facilitate the removal of the jammed paper.

In the event that a paper jam has occurred somewhere between the resist rollers 38 and the fixing device 46, the upper housing 23 is opened so that the transfer device 42 is exposed. If the recording paper is lying in or near the transfer device 42, the condition can be clearly recognized, and therefore, the jammed paper can be easily removed.

In the case of a paper jam occurring inside the rear unit 55, the rear cover 60 is opened so that the paper discharge roller pairs, 58/59 and 64/65, and the inverting path 350 therebetween are exposed. As a result, the recording paper jammed inside the rear unit 55 can be easily removed.

As described above, according to the LED printer 21 of this embodiment, when a paper jam has occurred inside the printer, the paper jam condition can be checked and the jammed paper can be removed, either by opening the upper housing 23, followed, in some cases, by the upper guide member 192 of the transport device 190, or by opening the rear cover 60 of the rear unit 55. Removal of jammed paper is thus greatly eased. In particular, removal of jammed paper in the transport device 190 is extremely easy.

(5) Removal and installation of the waste toner box

To fit the waste toner box 99 onto the support member 66, first the waste toner box 99 is held longitudinally along the horizontal direction in FIG. 55, i.e., along the transporting direction A1, with the opening 354 positioned on the downstream side, and then the cover 353 and the neck 352 are inserted along the underside of the connecting portion 144 and into the mounting member 140 of the support member 66. That is, the waste toner box 99 is inserted from the front side toward the rear side of the plane of FIG. 14 in such a way that the projections 359 are fitted into the gaps between the connecting portion 144 and the projections **146*b* and 147*b***.

Figure 61:
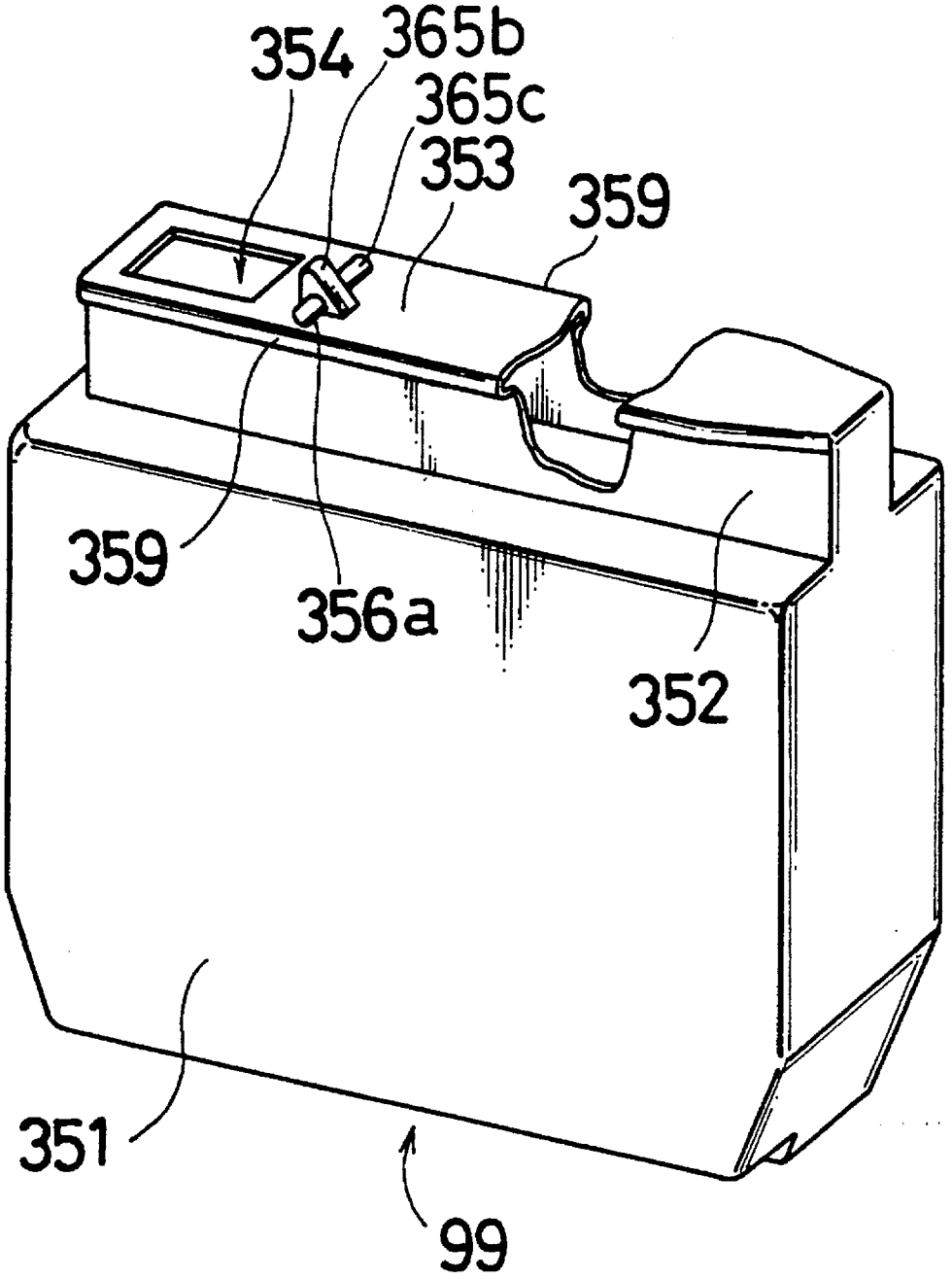
FIG. 61 is a perspective view showing another embodiment of a waste toner box.
Figure 62:
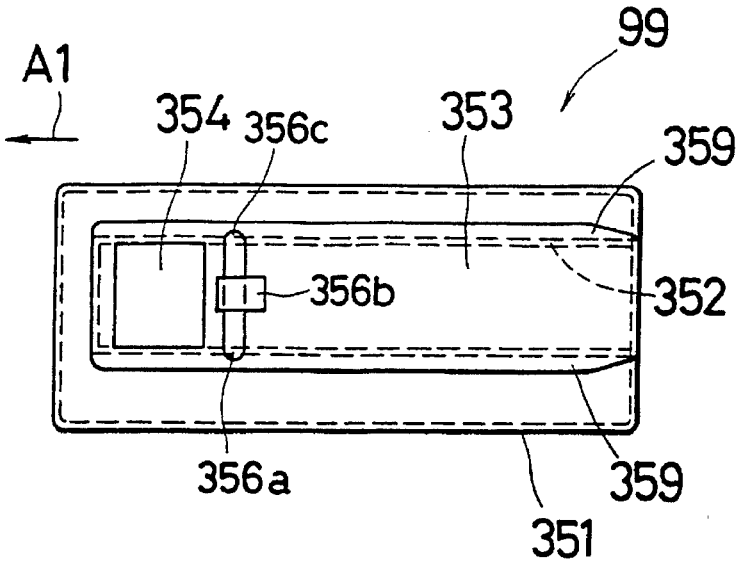
FIG. 62 is a plan view of the waste toner box of FIG. 61.
Figure 63:
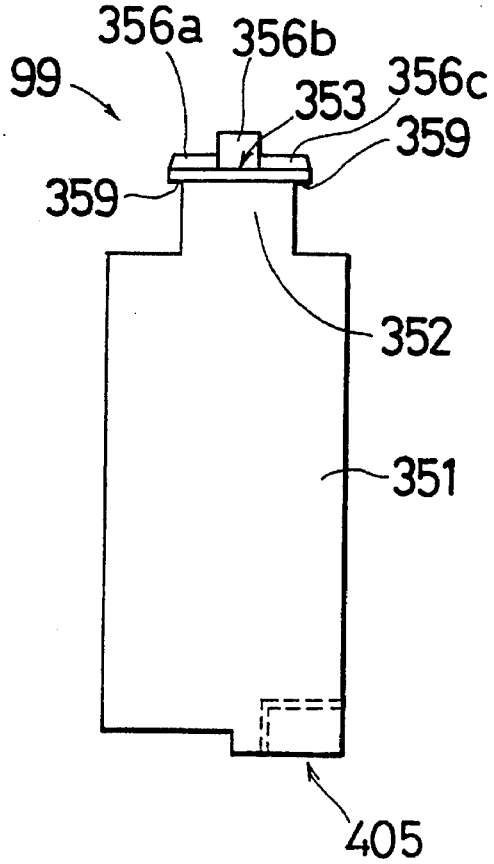
FIG. 63 is a right side view of the waste toner box of FIG. 61.

FIG. 61 is a perspective view showing another embodiment of a waste toner box 99. FIG. 62 is the plan view of the waste toner box 99 of FIG. 61. FIG. 63 is the right side view of the waste toner box 99 of FIG. 61.

The waste toner box 99 is formed from plastic material, and has an integral construction comprising a box-like body 351, a neck 352 protruding upwardly from the upper end of the box-like body 351 and having a width smaller than the width of the box-like body 351 as measured in the vertical direction in FIG. 62, and a cover 353 that covers an open end of the neck 352. The cover 353 includes: an opening 354 formed therein, projecting portions 359, formed where the cover 353 joins the neck 352, and projecting outwardly of the neck 352 in width directions, and protrusion portions **356*a* and 356*c* formed thereon and engaged with a plate spring 400 shown in FIG. 64. Between the protrusion portions 356*a* and 356*c* is formed a protrusion portion 356*b* which can push up a lever 402 of a waste toner exhaust port shutter 401 of the process cartridge 73 shown in FIG. 19 and angularly displace the waste toner exhaust port shutter 401**.

Figure 64:
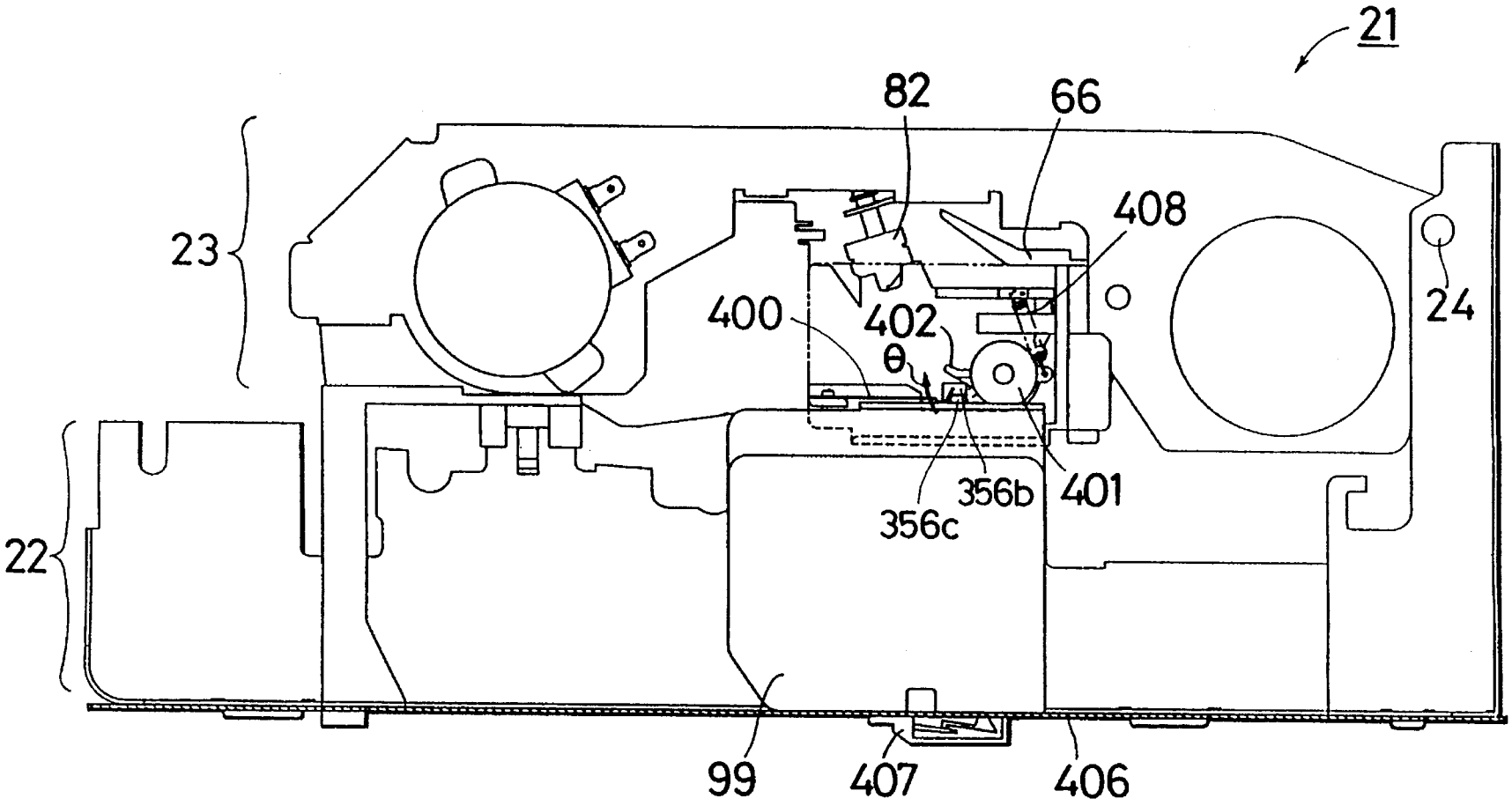
FIG. 64 is a schematic view showing a waste toner exhaust port shutter.
Figure 65:
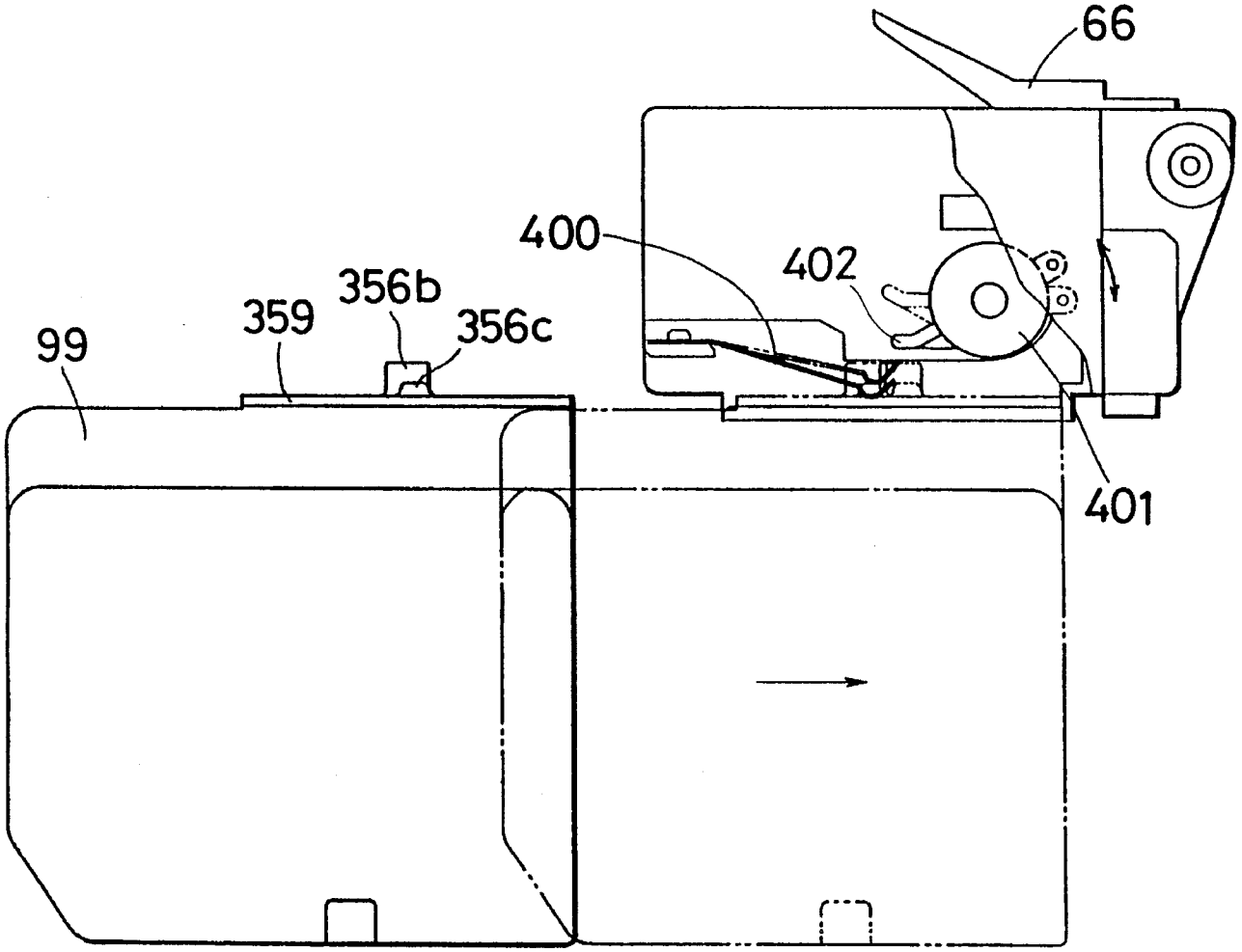
FIG. 65 is a partially-enlarged diagram showing the waste toner exhaust port shutter.

The width of the cover 353, including the projecting portions 359 and measured in the vertical direction in FIG. 62, is chosen approximately equal to the distance between the facing projections **146*b* and 147*b* in FIG. 14. The total height of the waste toner box 99 (the height from a bottom face 405 facing the cover 353 to the peak of the protrusion portion 356*b*) is chosen so that the waste toner exhaust port shutter 401 of the process cartridge 73 can be angularly displaced sufficiently in a state that the upper housing 23 closes as shown in FIG. 64. Additionally, as shown in FIG. 65, the height measured from the bottom face of the projection portions 359 of the waste toner box 99 to the peak of the protrusion portion 356*b* is chosen so that the waste toner box 99 may not interfere with the waste toner exhaust port shutter 401 when the waste toner box 99 is attached into or detached from the support member 66**.

To install the waste toner box 99 into the support member 66, the longitudinal direction of the waste toner box 99, i.e., the horizontal direction of FIG. 62 is set in parallel to the transporting direction A1. Then the opening 354 is turned toward the downstream side of the transporting direction A1, and the cover 353 and the neck 352 are inserted inside the mounting member 140 of the support member 66 under the connecting portion 144. That is, the projecting portions 359 of the waste toner box 99 are inserted into the vertical space between the connecting portion 144 in FIG. 14 and the facing projections **146*b* and 147*b*, from the front side on the plane of FIG. 14** toward the rear side thereof.

After the protrusion portions **356*a* and 356*c* move beyond the contact portion of the plate spring 400 mounted to the support member 66, the waste toner box 99 cannot move forward beyond the protrusion portions 356*a* and 356*c* owing to the force of the plate spring 400. Adjustment of the force of the plate spring 400 can also provide a proper feeling of operation when the contact portion of the plate spring 400 passes the protrusion portions 356*a* and 356*c* in attaching/detaching of the waste toner box 99. Further, since the protrusion portion 356*b* which can push up the waste toner exhaust port shutter 401 of the process cartridge 73 is separated from the waste toner exhaust port shutter 401 in an open state of the upper housing 22, the waste toner box 99 is free to be attached into or detached from the support member 66 regardless of the existence of the process cartridge 73**.

As shown in FIG. 60, in the upper housing 23, the support member 66 with the waste toner box 99 mounted thereon is installed swingably at the support shafts 71, 72, and the process cartridge 73 with the toner box 74 mounted thereon is mounted on the support member 66. When the upper housing 23 is set in its open position, contact pieces **23*a* and 23*b* formed under the elongated holes 69, 70 of the upper housing 23 support the rear face of the side plate 131 and the rear of the connecting plate 141 respectively. Therefore, the support member 66 is held in its maximum angularly displaceable position in the clockwise direction in FIG. 60 and thus rests at an angle relative to the upper housing 23**.

When closing the upper housing 23, the upper housing 23 resting in its open position is pressed downward and turned about the support shaft 24 in the clockwise direction in FIG. 60.

Figure 66:
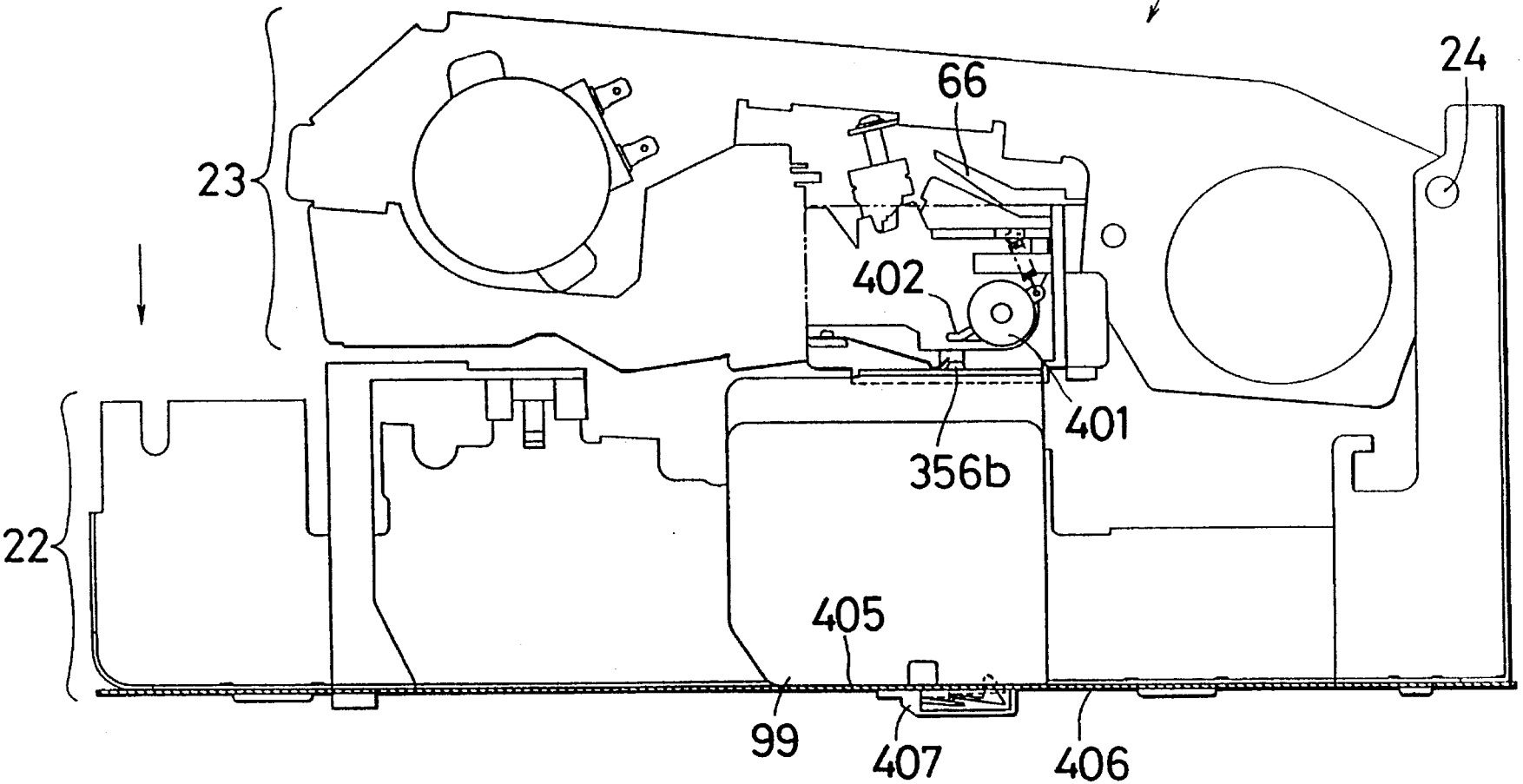
FIG. 66 is a schematic view showing a state that the upper housing of the LED printer is closing.

As the upper housing 23 is further turned to the lower housing 22, as shown in FIG. 66, first the bottom face 405 of the waste toner box 99 comes in contact with a chassis 406 of the lower housing 22 and is held in this position. Since a switch 407 for detecting the existence of the waste toner box 99 is mounted to the chassis 406, the switch 407 is turned on when the waste toner box 99 moves to have contact with the chassis 406. Thereby the existence of the waste toner box 99 can be detected.

As the upper housing 23 is still further turned downward therefrom to be completely closed, as shown in FIG. 64, the process cartridge 73 moves downward to be set in a determined position. At this time, the lever 402 of the waste toner exhaust port shutter 401 disposed at the waste toner exhaust port of the process cartridge 73 is pushed upward by the protrusion portion **356*b* of the waste toner box 99 to be angularly displaced in degree θ against an urging spring 408 interlocked with the lever 402**.

Figure 67:
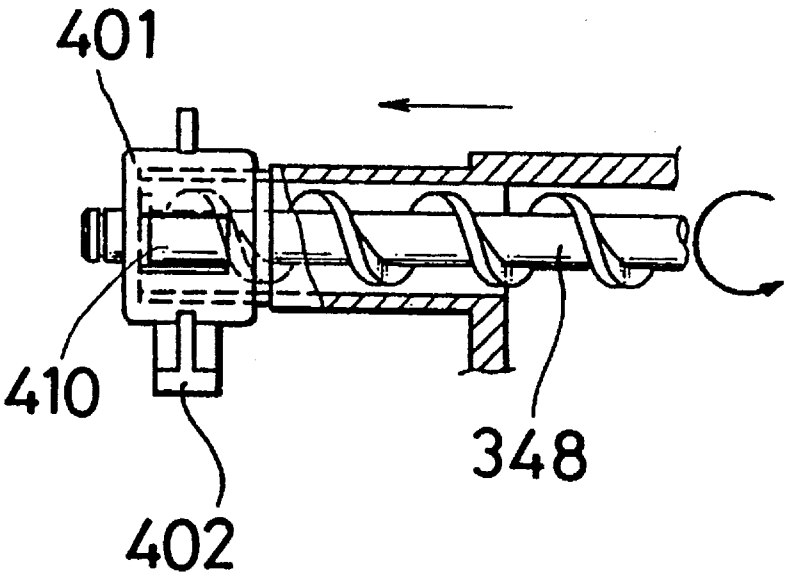
FIG. 67 (*a*) is a front view showing the waste toner exhaust port shutter and FIG. 67 (*b*) is a partial cross-sectional view as viewed from the waste toner exhaust port of FIG. 67 (*a*).
Figure 67:
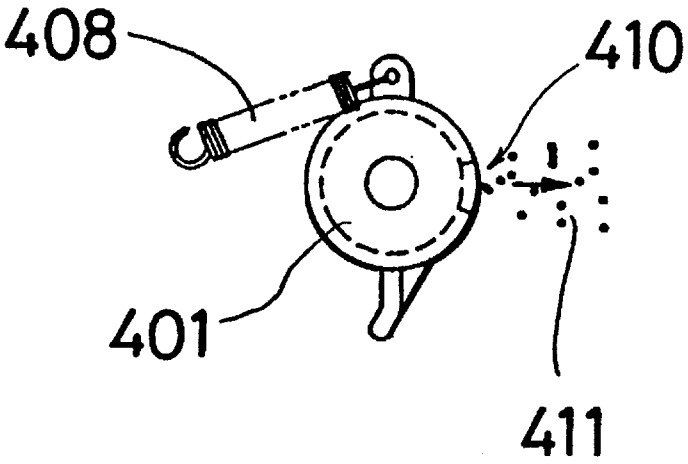
Figure 68:
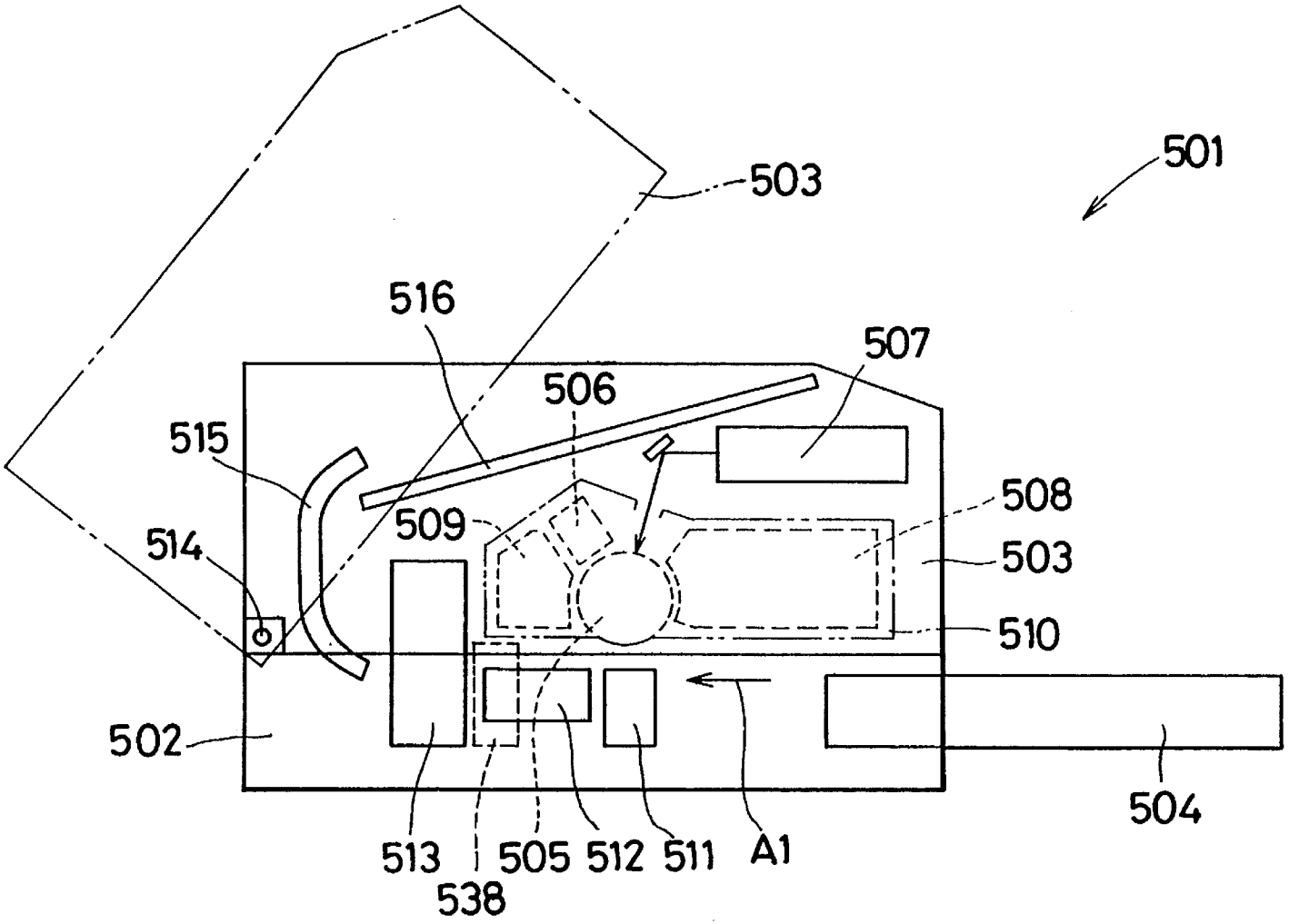
Fig. 68 Prior Art
FIG. 68 is a schematic view illustrating construction of an electrophotographic apparatus typical of the prior art.
Figure 69:
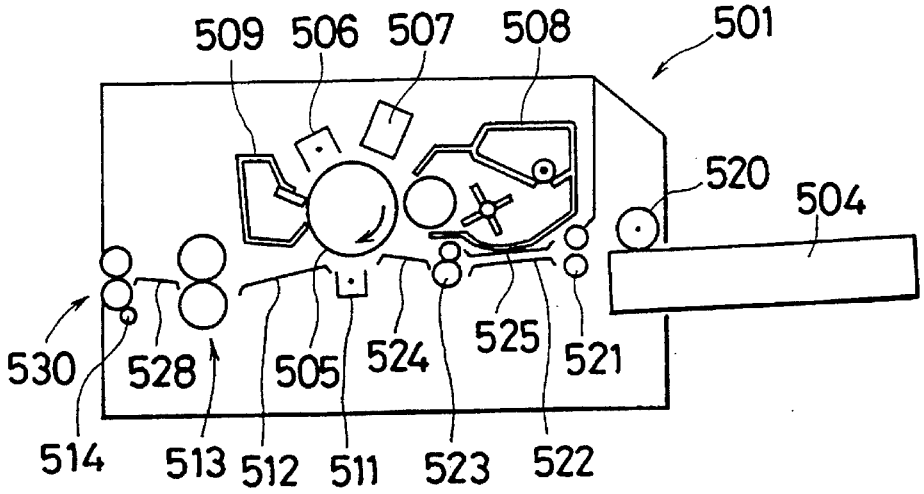
Fig. 69 Prior Art
FIG. 69 is a schematic view illustrating construction of the electrophotographic apparatus shown in FIG. 68.
Figure 70:
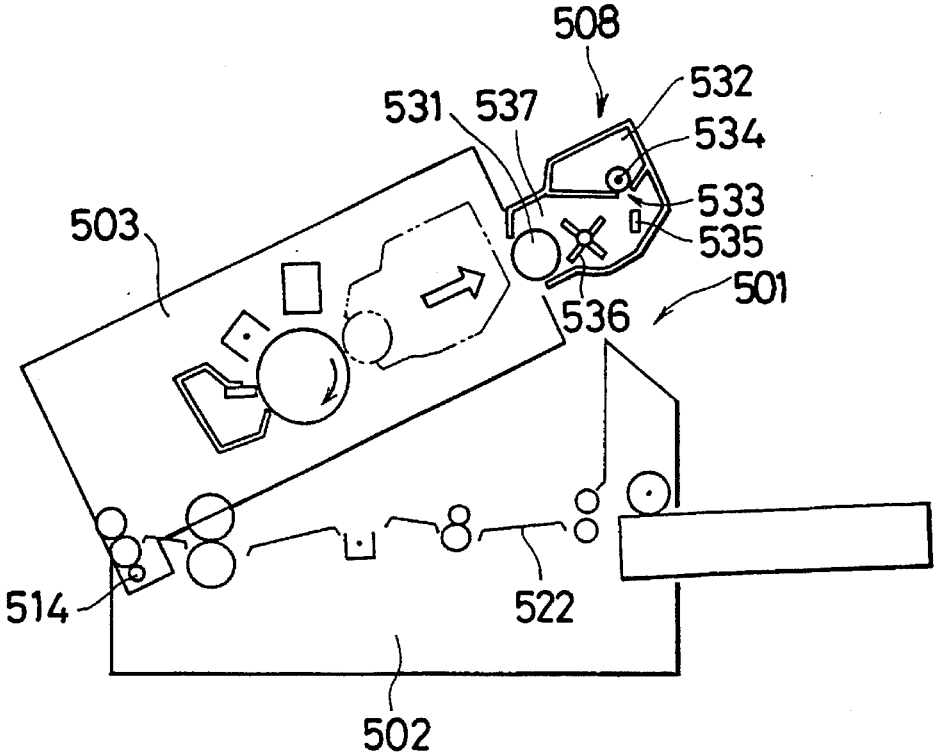
Fig. 70 Prior Art
FIG. 70 is a schematic view showing an upper housing turned upward.
Figure 71:
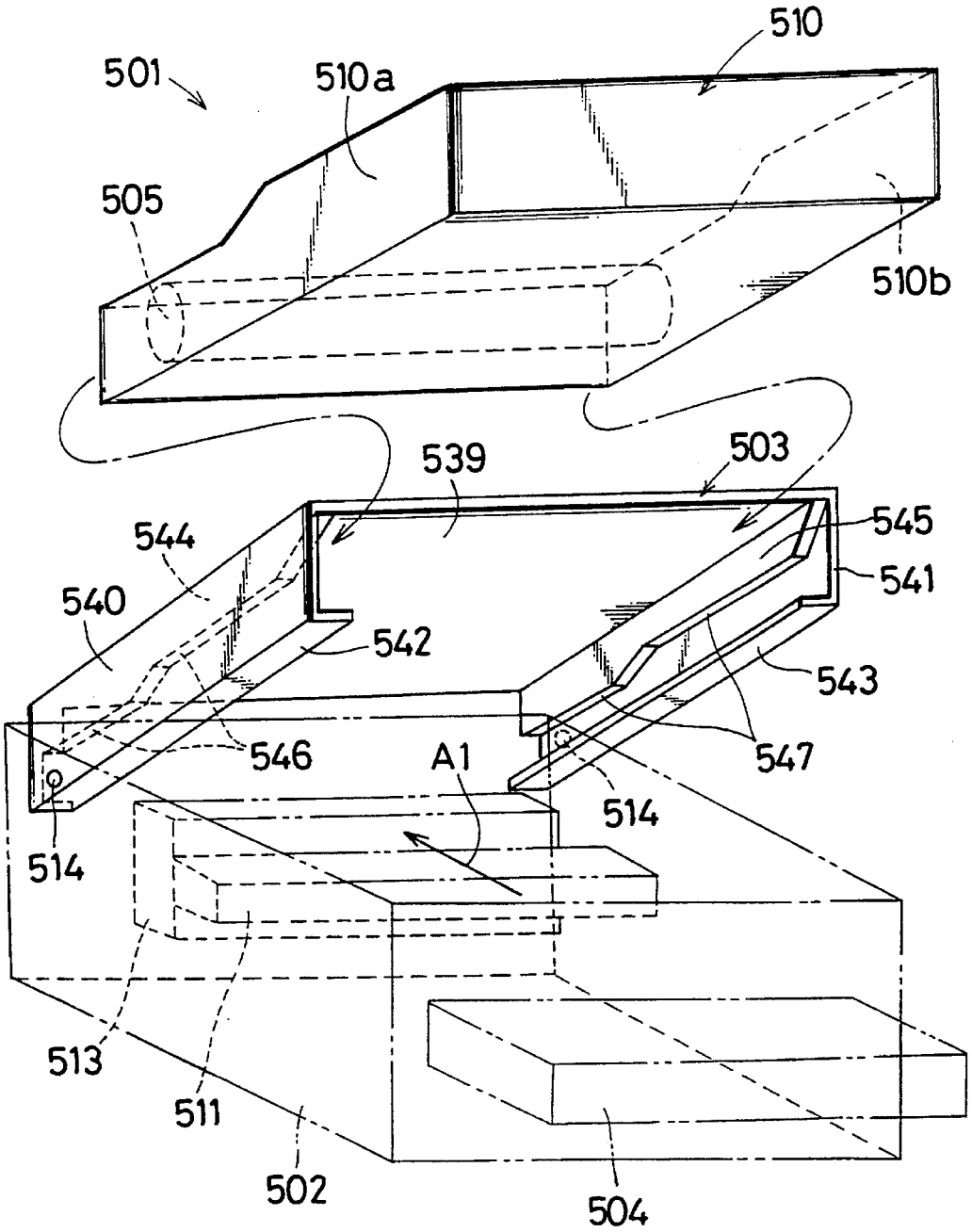
Fig. 71 Prior Art
FIG. 71 is a perspective view showing the upper housing turned upward.
Figure 72:
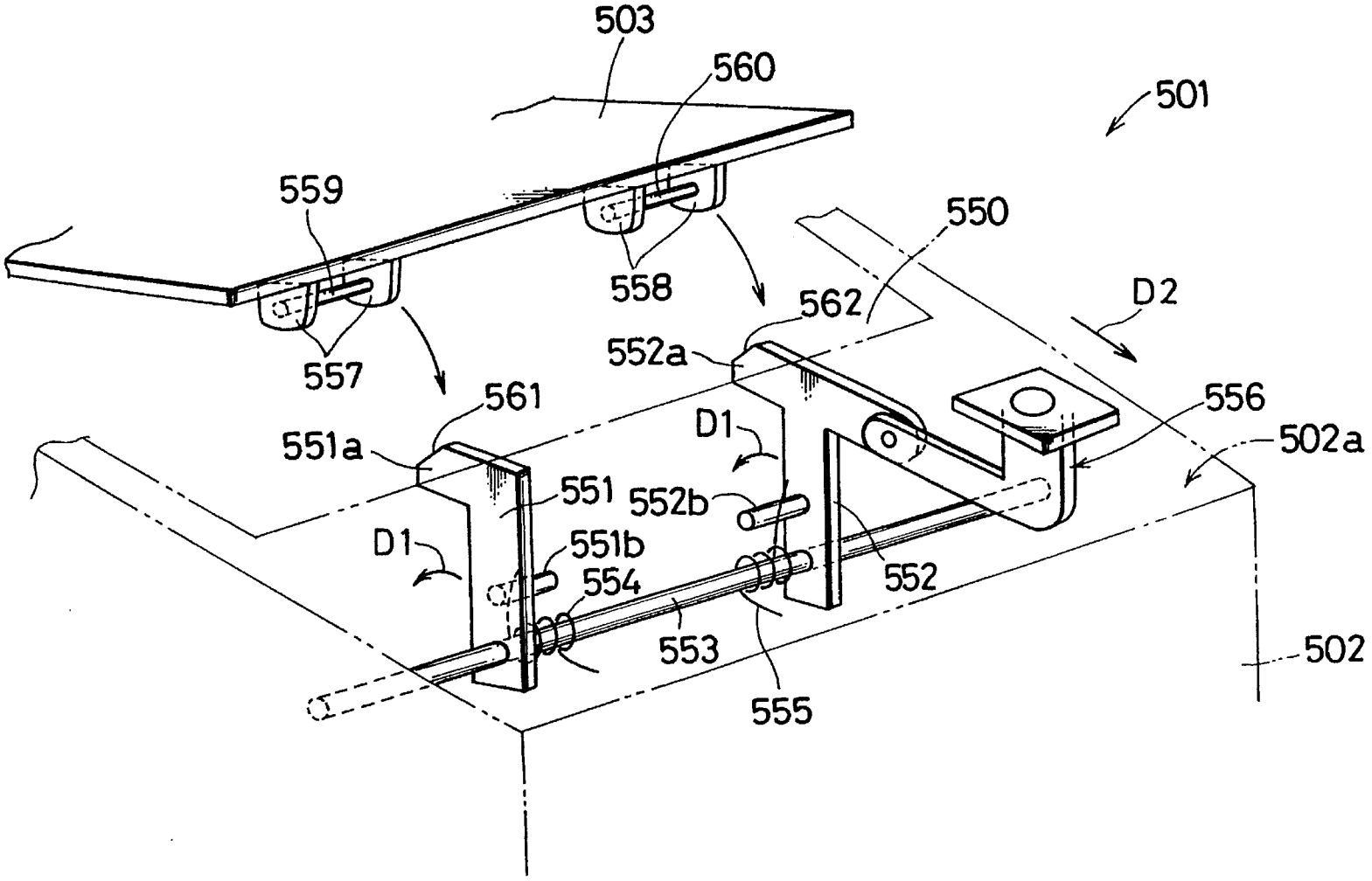
Fig. 72 Prior Art
FIG. 72 is a partial perspective view showing a housing construction of the electrophotographic apparatus typical of the prior art as shown in FIG. 68.
Figure 73:
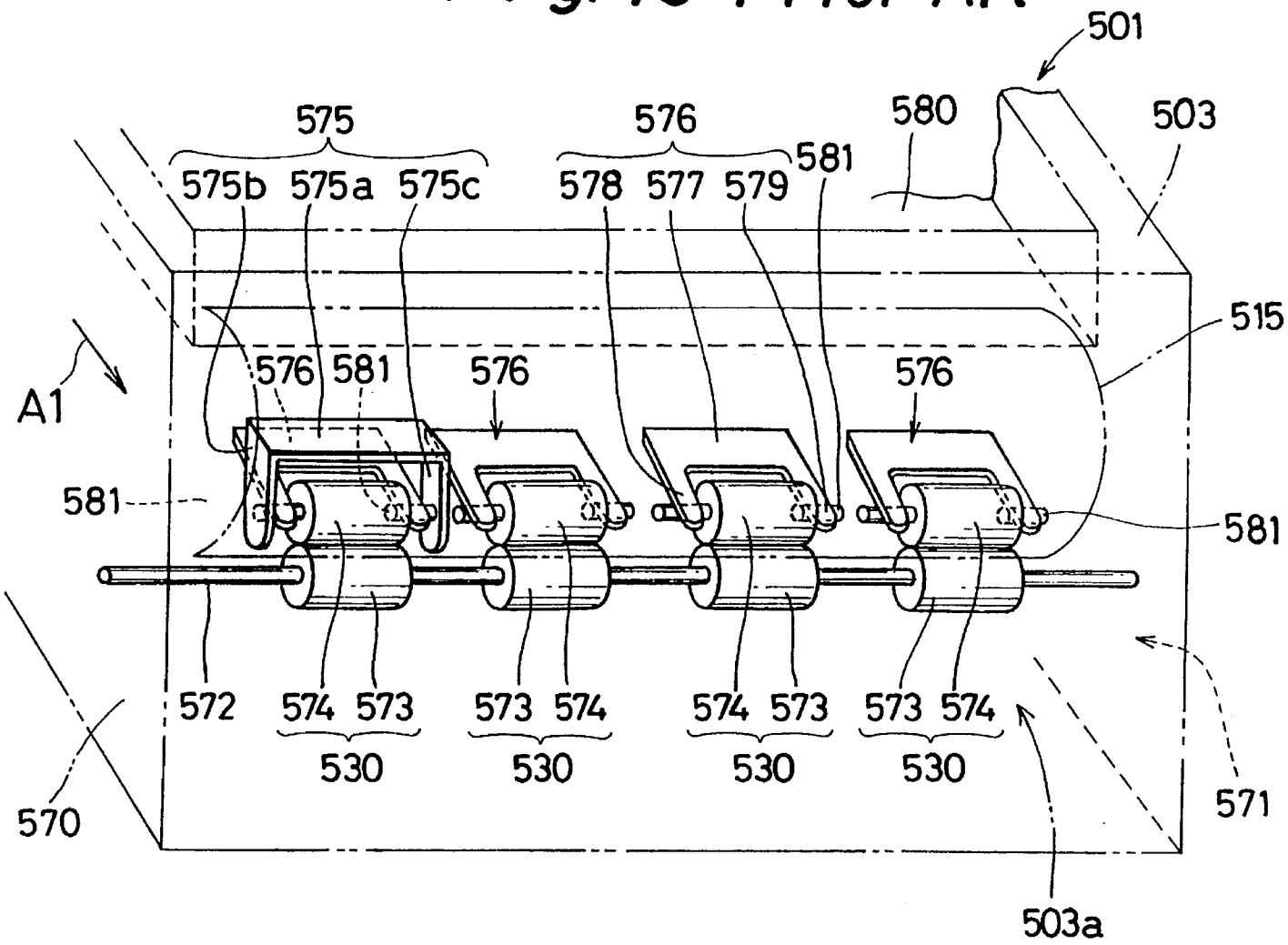
Fig. 73 Prior Art
FIG. 73 is a partial perspective view showing a paper exit section in the electrophotographic apparatus shown in FIG. 68.
Figure 74:
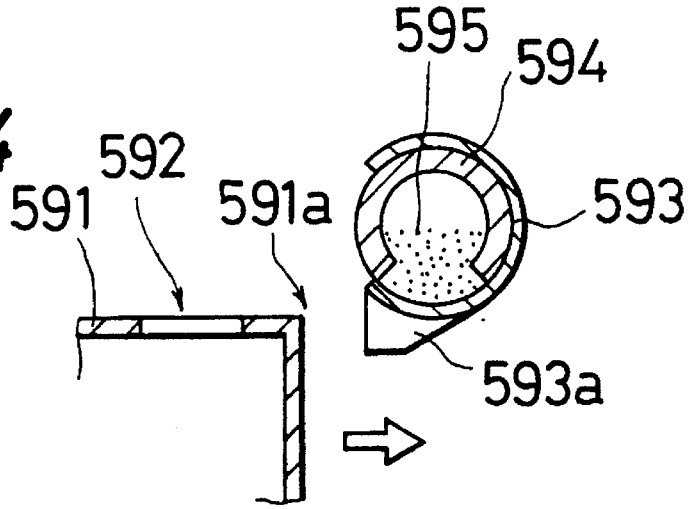
Fig. 74 Prior Art
FIGS. 74(*a*)–74(*c*) are schematic cross-sectional views showing a shutter mechanism of a waste toner exhaust port of the prior art.
Figure 74:
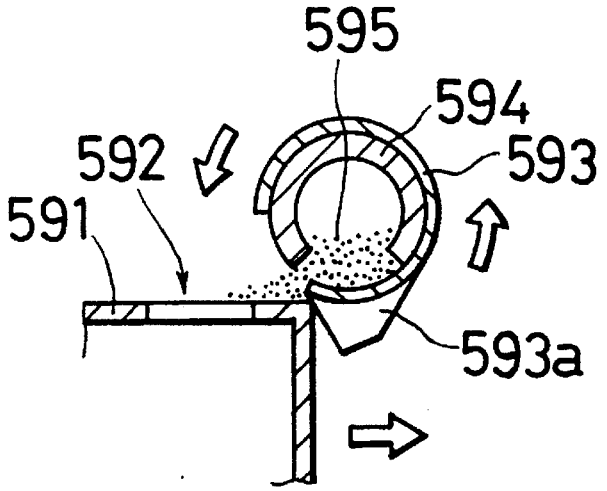
Fig. 74 Prior Art
Figure 74:
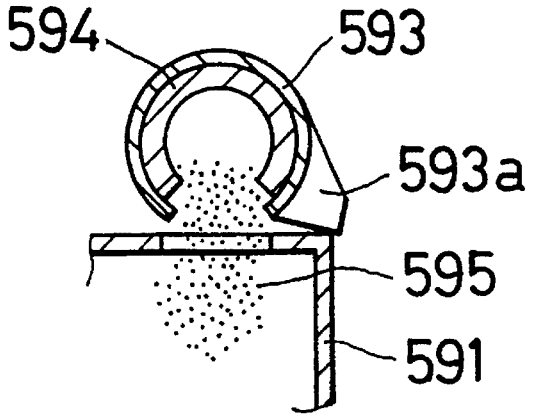
Fig. 74 Prior Art

FIG. 67 (*a*) is a front view showing the waste toner exhaust port shutter 401 and FIG. 67 (*b*) is a partial cross-sectional view as viewed from the waste toner exhaust port 410 of FIG. 67 (*a*). Under the opening portion of the waste toner exhaust port 410 is disposed the opening 354 of the waste toner box 99. The waste toner 411 accommodated in the cleaning device 80 of the process cartridge 73 is carried out to the waste toner exhaust port shutter 401 by the rotation of the screw 348 to be discharged out of the waste toner exhaust port 410 opened by the angular displacement of the lever 402. Therefore, the waste toner can be collected into the waste toner box 99 without leakage.

In the above-mentioned embodiment, it is noted that the waste toner box 99 may be mounted to the support member 66 holding the process cartridge 73. The present invention is applicable to a structure where the waste toner box 99 is not mounted to the support member 66 and is directly disposed on the chassis 406 of the lower housing 22.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An electrophotographic apparatus comprising:

a lower housing of box-shaped configuration with an open top;

an upper housing having first and second ends and swingably mounted at said first end to said lower housing for swinging movement relative thereto between a lower closed position, whereat said second end is relatively adjacent said lower housing, and an upper open position, whereat said second end is relatively spaced from said lower housing;

a support member;

a process cartridge, including a housing having a photoconductor drum and a developing device, detachably fixed to said support member to form an assembly having a first end composed of said support member and a second end;

said support member being swingably mounted to said upper housing for swinging movement of said second end of said assembly toward and away from said upper housing;

whereby when said upper housing is in said lower closed position said assembly is relatively adjacent said upper housing and said process cartridge is in a mounting position at said lower housing, and whereby when said upper housing is in said upper open position said assembly is swung away from said upper housing and said process cartridge is disengaged from said mounting position and spaced from said lower housing;

a guide piece extending from said support member; and a guide member on said lower housing, said guide member having a guide face to be abutted by said guide piece during said swinging movement of said upper housing from or toward said lower closed position, said guide face being configured to control movement of said assembly relative to said upper housing when said upper housing is moved from or toward said lower closed position to provide an alignment of said process cartridge during movement thereof from or toward said mounting position corresponding generally to an orientation thereof when in said mounting position.

2. An electrophotographic apparatus comprising:

a lower housing of box-shaped configuration with an open top;

an upper housing having first and second ends and swingably mounted at said first end to said lower housing for swinging movement relative thereto between a lower closed position, whereat said second end is relatively adjacent said lower housing, and an upper open position, whereat said second end is relatively spaced from said lower housing;

a process cartridge, including a housing having a photoconductor drum and a developing device, detachably fixed to said upper housing and swingably mounted thereto for swinging movement toward and away therefrom, said process cartridge having extending from at least one side thereof an engaging protrusion;

a mounting plate provided on said lower housing and having a positioning groove receiving said engaging protrusion when said upper housing is in said lower closed position; and a stop member swingably mounted on said mounting plate, said stop member having on a first end thereof a portion to contact said engaging protrusion from above, and said stop member having at a second end thereof a stop piece to be abutted by said upper housing when moving to said lower closed position, thereby swinging said stop member such that said portion contacts said engaging protrusion and prevents upward lifting thereof.

3. An apparatus as claimed in claim 2, wherein said engaging protrusion comprises a support shaft of said photoconductor drum.

* * * * *